US005825385A

United States Patent [19]

Silverbrook

[11] Patent Number: 5,825,385

[45] Date of Patent: Oct. 20, 1998

4

[54] CONSTRUCTIONS AND MANUFACTURING PROCESSES FOR THERMALLY ACTIVATED PRINT HEADS

[75] Inventor: Kia Silverbrook, Leichhardt, Australia

[73] Assignee: Eastman Kodak Company, Rochester, N.Y.

[21] Appl. No.: 765,038

[22] PCT Filed: Apr. 9, 1996

[86] PCT No.: PCT/US96/04855

§ 371 Date: Dec. 10, 1996

§ 102(e) Date: Dec. 10, 1996

[87] PCT Pub. No.: WO96/32267

PCT Pub. Date: Oct. 17, 1996

[30] Foreign Application Priority Data

Apr. 12, 1995 [AU] Australia ..... PN95/2303
Apr. 12, 1995 [AU] Australia ..... PN95/2305

[51] Int. Cl.[6] ..... B41J 2/05

[52] U.S. Cl. ..... 347/56

[58] Field of Search ..... 347/54, 55, 56, 347/57, 60, 61, 62, 66, 67

[56] References Cited

U.S. PATENT DOCUMENTS

| | | | |
|---|---|---|---|
| 1,941,001 | 12/1933 | Hansell . | |
| 3,373,437 | 3/1968 | Sweet et al. . | |
| 3,416,153 | 12/1968 | Hertz et al. . | |
| 3,946,398 | 3/1976 | Kyser et al. . | |
| 4,164,745 | 8/1979 | Cielo et al. . | |
| 4,166,277 | 8/1979 | Cielo et al. . | |
| 4,275,290 | 6/1981 | Cielo et al. . | |
| 4,293,865 | 10/1981 | Jinnai et al. . | |
| 4,312,009 | 1/1982 | Lange . | |
| 4,490,728 | 12/1984 | Vaught et al. . | |
| 4,580,158 | 4/1986 | Macheboeuf . | |
| 4,710,780 | 12/1987 | Saito et al. . | |
| 4,737,803 | 4/1988 | Fujimura et al. . | |
| 4,748,458 | 5/1988 | Inoue et al. . | |
| 4,751,532 | 6/1988 | Fujimura et al. . | |
| 4,751,533 | 6/1988 | Saito et al. . | |
| 4,752,783 | 6/1988 | Saito et al. . | |
| 4,980,703 | 12/1990 | Sakurai | 347/45 |
| 5,059,989 | 10/1991 | Eldridge et al. | 347/63 |
| 5,371,527 | 12/1994 | Miller et al. . | |
| 5,420,627 | 5/1995 | Keefe et al. | 347/58 |

FOREIGN PATENT DOCUMENTS

| | | | |
|---|---|---|---|
| 0 498 292 A3 | 8/1992 | European Pat. Off. | B41J 2/16 |
| 0 600 712 A2 | 6/1994 | European Pat. Off. | B41J 2/005 |
| 2 007 162 A | 5/1979 | United Kingdom | B41J 3/04 |
| WO 90/14233 | 11/1990 | WIPO | B41J 2/065 |

*Primary Examiner*—Matthew V. Nguyen
*Attorney, Agent, or Firm*—Milton S. Sales

[57] ABSTRACT

A monolithic printing head having a nozzle configuration in which the heater element is formed using a self-aligned process, where the thickness of the heater, the width of the heater, and the position of the heater in relation to the nozzle are all determined by deposition and etching steps, instead of lithographic processes. In this manner, much greater control of these parameters can be achieved than is generally possible with lithographic processes. No mask is required for the heater. A print head configuration also provides reduced power requirements and incorporates (1) the provision of a thermally insulating layer between the heater and the substrate; (2) minimizing the thermal mass of the heater and surrounding solid material; (3) minimizing the distance between the heater and the ink meniscus; (4) using a material of relatively high thermal conductivity to passivate the heater against corrosion by the ink; and (5) undercutting the substrate in the region of the heater. A method of manufacturing such a nozzle and heater configuration is disclosed.

20 Claims, 51 Drawing Sheets

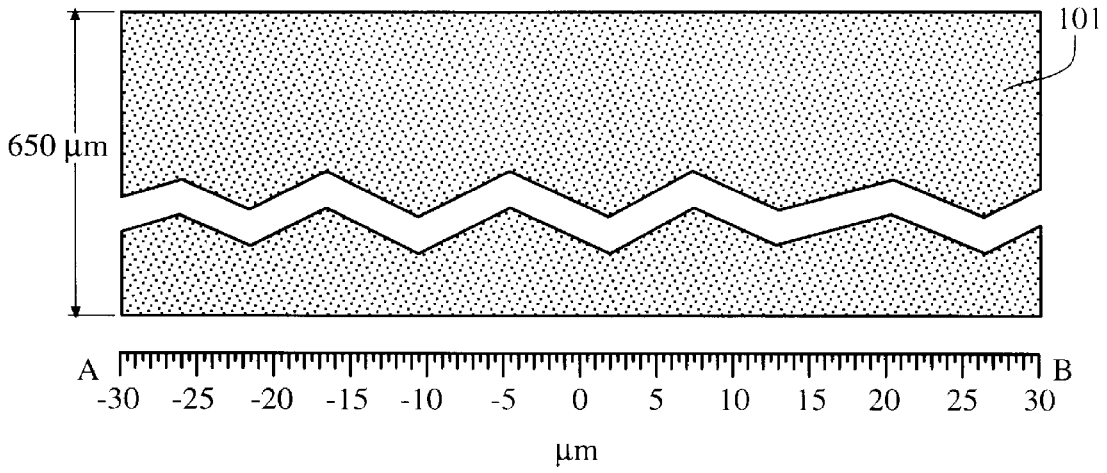
*Fig. 9(a)*
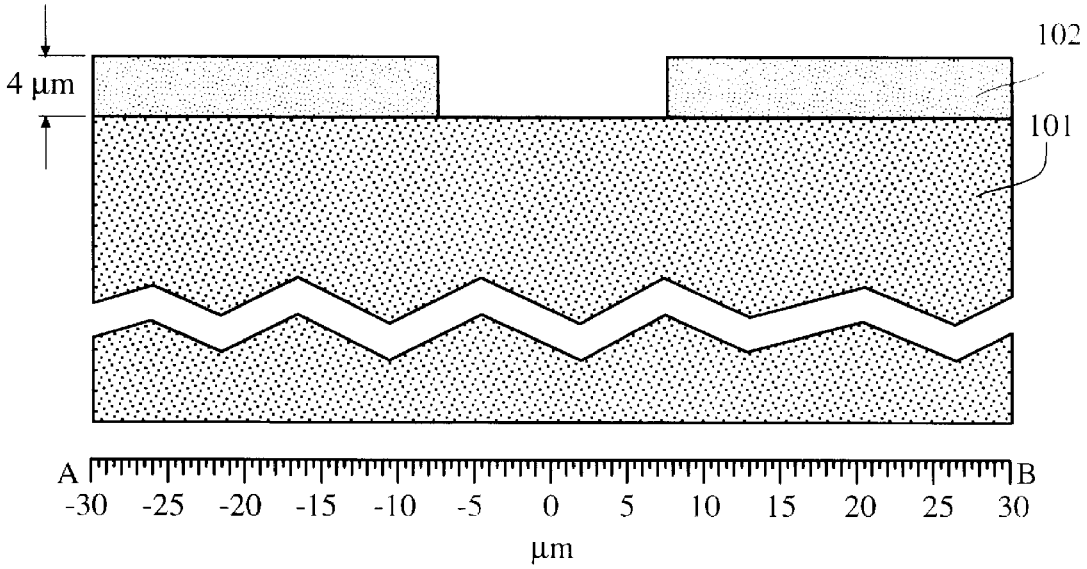
*Fig. 9(b)*
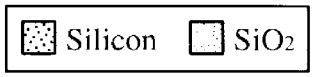

CONSTRUCTIONS AND MANUFACTURING PROCESSES FOR THERMALLY ACTIVATED PRINT HEADS

CROSS REFERENCE TO RELATED APPLICATIONS

Reference is made to my commonly assigned, co-pending U.S. patent applications: Ser. No. 08/701,021 entitled CMOS PROCESS COMPATIBLE FABRICATION OF PRINT HEADS filed Aug. 21, 1996; Ser. No. 08/733,711 entitled CONSTRUCTION AND MANUFACTURING PROCESS FOR DROP ON DEMAND PRINT HEADS WITH NOZZLE HEATERS filed Oct. 17, 1996; Ser. No. 08/734,822 entitled A MODULAR PRINT HEAD ASSEMBLY filed Oct. 22, 1996; Ser. No. 08/736,537 entitled PRINT HEAD CONSTRUCTIONS FOR REDUCED ELECTROSTATIC INTERACTION BETWEEN PRINTED DROPLETS filed Oct. 24, 1996; Ser. No. 08/750,320 entitled NOZZLE DUPLICATION FOR FAULT TOLERANCE IN INTEGRATED PRINTING HEADS and Ser. No. 08/750,312 entitled HIGH CAPACITY COMPRESSED DOCUMENT IMAGE STORAGE FOR DIGITAL COLOR PRINTERS both filed Nov. 26, 1996; Ser. No. 08/753,718 entitled NOZZLE PLACEMENT IN MONOLITHIC DROP-ON-DEMAND PRINT HEADS and Ser. No. 08/750,606 entitled A COLOR VIDEO PRINTER AND A PHOTO CD SYSTEM WITH INTEGRATED PRINTER both filed on Nov. 27, 1996; Ser. No. 08/750,438 entitled A LIQUID INK PRINTING APPARATUS AND SYSTEM, Ser. No. 08/750,599 entitled COINCIDENT DROP SELECTION, DROP SEPARATION PRINTING METHOD AND SYSTEM, Ser. No. 08/750,435 entitled MONOLITHIC PRINT HEAD STRUCTURE AND A MANUFACTURING PROCESS THEREFOR USING ANISTROPIC WET ETCHING, Ser. No. 08/750,436 entitled POWER SUPPLY CONNECTION FOR MONOLITHIC PRINT HEADS, Ser. No. 08/750,437 entitled MODULAR DIGITAL PRINTING, Ser. No. 08/750,439 entitled A HIGH SPEED DIGITAL FABRIC PRINTER, Ser. No. 08/750,763 entitled A COLOR PHOTOCOPIER USING A DROP ON DEMAND INK JET PRINTING SYSTEM, Ser. No. 08/765,756 entitled PHOTOGRAPH PROCESSING AND COPYING SYSTEMS, Ser. No. 08/750,646 entitled FAX MACHINE WITH CONCURRENT DROP SELECTION AND DROP SEPARATION INK JET PRINTING, Ser. No. 08/759,774 entitled FAULT TOLERANCE IN HIGH VOLUME PRINTING PRESSES, Ser. No. 08/750,429 entitled INTEGRATED DRIVE CIRCUITRY IN DROP ON DEMAND PRINT HEADS, Ser. No. 08/750,433 entitled HEATER POWER COMPENSATION FOR TEMPERATURE IN THERMAL PRINTING SYSTEMS, Ser. No. 08/750,640 entitled HEATER POWER COMPENSATION FOR THERMAL LAG IN THERMAL PRINTING SYSTEMS, Ser. No. 08/750,650 entitled DATA DISTRIBUTION IN MONOLITHIC PRINT HEADS, and Ser. No. 08/750,642 entitled PRESSURIZABLE LIQUID INK CARTRIDGE FOR COINCIDENT FORCES PRINTERS all filed Dec. 3, 1996; Ser. No. 08/750,647 entitled MONOLITHIC PRINTING HEADS AND MANUFACTURING PROCESSES THEREFOR, Ser. No. 08/750,604 entitled INTEGRATED FOUR COLOR PRINT HEADS, Ser. No. 08/750,605 entitled A SELF-ALIGNED CONSTRUCTION AND MANUFACTURING PROCESS FOR MONOLITHIC PRINT HEADS, Ser. No. 08/682,603 entitled A COLOR PLOTTER USING CONCURRENT DROP SELECTION AND DROP SEPARATION INK JET PRINTING TECHNOLOGY, Ser. No. 08/750,603 entitled A NOTEBOOK COMPUTER WITH INTEGRATED CONCURRENT DROP SELECTION AND DROP SEPARATION COLOR PRINTING SYSTEM, Ser. No. 08/765,130 entitled PRINTING MECHANISMS; Ser. No. 08/750,431 entitled BLOCK FAULT TOLERANCE IN INTEGRATED PRINTING HEADS, Ser. No. 08/750,607 entitled FOUR LEVEL INK SET FOR BI-LEVEL COLOR PRINTING, Ser. No. 08/750,430 entitled A NOZZLE CLEARING PROCEDURE FOR LIQUID INK PRINTING, Ser. No. 08/750,600 entitled METHOD AND APPARATUS FOR ACCURATE CONTROL OF TEMPERATURE PULSES IN PRINTING HEADS, Ser. No. 08/750,608 entitled A PORTABLE PRINTER USING A CONCURRENT DROP SELECTION AND DROP SEPARATION PRINTING SYSTEM, and Ser. No. 08/750,602 entitled IMPROVEMENTS IN IMAGE HALFTONING all filed Dec. 4, 1996; Ser. No. 08/765,127 entitled PRINTING METHOD AND APPARATUS EMPLOYING ELECTROSTATIC DROP SEPARATION, Ser. No. 08/750,643 entitled COLOR OFFICE PRINTER WITH A HIGH CAPACITY DIGITAL PAGE IMAGE STORE, and Ser. No. 08/765,035 entitled HEATER POWER COMPENSATION FOR PRINTING LOAD IN THERMAL PRINTING SYSTEMS all filed Dec. 5, 1996; Ser. No. 08/765,036 entitled APPARATUS FOR PRINTING MULTIPLE DROP SIZES AND FABRICATION THEREOF, Ser. No. 08/765,017 entitled HEATER STRUCTURE AND FABRICATION PROCESS FOR MONOLITHIC PRINT HEADS, Ser. No. 08/750,772 entitled DETECTION OF FAULTY ACTUATORS IN PRINTING HEADS, and Ser. No. 08/765,037 entitled PAGE IMAGE AND FAULT TOLERANCE CONTROL APPARATUS FOR PRINTING SYSTEMS all filed Dec. 9, 1996.

FIELD OF THE INVENTION

The present invention is in the field of computer controlled printing devices. In particular, the field is constructions and manufacturing processes for thermally activated drop on demand (DOD) printing heads which integrate multiple nozzles on a single substrate.

BACKGROUND OF THE INVENTION

Many different types of digitally controlled printing systems have been invented, and many types are currently in production. These printing systems use a variety of actuation mechanisms, a variety of marking materials, and a variety of recording media. Examples of digital printing systems in current use include: laser electrophotographic printers; LED electrophotographic printers; dot matrix impact printers; thermal paper printers; film recorders; thermal wax printers; dye diffusion thermal transfer printers; and ink jet printers. However, at present, such electronic printing systems have not significantly replaced mechanical printing presses, even though this conventional method requires very expensive setup and is seldom commercially viable unless a few thousand copies of a particular page are to be printed. Thus, there is a need for improved digitally controlled printing systems, for example, being able to produce high quality color images at a high-speed and low cost, using standard paper.

Inkjet printing has become recognized as a prominent contender in the digitally controlled, electronic printing arena because, e.g., of its non-impact, low-noise characteristics, its use of plain paper and its avoidance of toner transfers and fixing.

Many types of ink jet printing mechanisms have been invented. These can be categorized as either continuous ink jet (CIJ) or drop on demand (DOD) ink jet. Continuous ink jet printing dates back to at least 1929: Hansell, U.S. Pat. No. 1,941,001.

Sweet et al U.S. Pat. No. 3,373,437, 1967, discloses an array of continuous ink jet nozzles where ink drops to be printed are selectively charged and deflected towards the recording medium. This technique is known as binary deflection CIJ, and is used by several manufacturers, including Elmjet and Scitex.

Hertz et al U.S. Pat. No. 3,416,153, 1966, discloses a method of achieving variable optical density of printed spots in CIJ printing using the electrostatic dispersion of a charged drop stream to modulate the number of droplets which pass through a small aperture. This technique is used in ink jet printers manufactured by Iris Graphics.

Kyser et al U.S. Pat. No. 3,946,398, 1970, discloses a DOD ink jet printer which applies a high voltage to a piezoelectric crystal, causing the crystal to bend, applying pressure on an ink reservoir and jetting drops on demand. Many types of piezoelectric drop on demand printers have subsequently been invented, which utilize piezoelectric crystals in bend mode, push mode, shear mode, and squeeze mode. Piezoelectric DOD printers have achieved commercial success using hot melt inks (for example, Tektronix and Dataproducts printers), and at image resolutions up to 720 dpi for home and office printers (Seiko Epson). Piezoelectric DOD printers have an advantage in being able to use a wide range of inks. However, piezoelectric printing mechanisms usually require complex high voltage drive circuitry and bulky piezoelectric crystal arrays, which are disadvantageous in regard to manufacturability and performance.

Endo et al GB Pat. No. 2,007,162, 1979, discloses an electrothermal DOD ink jet printer which applies a power pulse to an electrothermal transducer (heater) which is in thermal contact with ink in a nozzle. The heater rapidly heats water based ink to a high temperature, whereupon a small quantity of ink rapidly evaporates, forming a bubble. The formation of these bubbles results in a pressure wave which cause drops of ink to be ejected from small apertures along the edge of the heater substrate. This technology is known as Bubblejet™ (trademark of Canon K.K. of Japan), and is used in a wide range of printing systems from Canon, Xerox, and other manufacturers.

Vaught et al U.S. Pat. No. 4,490,728, 1982, discloses an electrothermal drop ejection system which also operates by bubble formation. In this system, drops are ejected in a direction normal to the plane of the heater substrate, through nozzles formed in an aperture plate positioned above the heater. This system is known as Thermal Ink Jet, and is manufactured by Hewlett-Packard. In this document, the term Thermal Ink Jet is used to refer to both the Hewlett-Packard system and systems commonly known as Bubblejet™.

Thermal Ink Jet printing typically requires approximately 20 $\mu$J over a period of approximately 2 $\mu$s to eject each drop. The 10 Watt active power consumption of each heater is disadvantageous in itself and also necessitates special inks, complicates the driver electronics and precipitates deterioration of heater elements.

Other ink jet printing systems have also been described in technical literature, but are not currently used on a commercial basis. For example, U.S. Pat. No. 4,275,290 discloses a system wherein the coincident address of predetermined print head nozzles with heat pulses and hydrostatic pressure, allows ink to flow freely to spacer-separated paper, passing beneath the print head. U.S. Pat. Nos. 4,737,803; 4,737,803 and 4,748,458 disclose ink jet recording systems wherein the coincident address of ink in print head nozzles with heat pulses and an electrostatically attractive field cause ejection of ink drops to a print sheet.

Each of the above-described inkjet printing systems has advantages and disadvantages. However, there remains a widely recognized need for an improved ink jet printing approach, providing advantages for example, as to cost, speed, quality, reliability, power usage, simplicity of construction and operation, durability and consumables.

SUMMARY OF THE INVENTION

My concurrently filed applications, entitled "Liquid Ink Printing Apparatus and System" and "Coincident Drop-Selection, Drop-Separation Printing Method and System" describe new methods and apparatus that afford significant improvements toward overcoming the prior art problems discussed above. Those inventions offer important advantages, e.g., in regard to drop size and placement accuracy, as to printing speeds attainable, as to power usage, as to durability and operative thermal stresses encountered and as to other printer performance characteristics, as well as in regard to manufacturability and the characteristics of useful inks. One important purpose of the present invention is to further enhance the structures and methods described in those applications and thereby contribute to the advancement of printing technology.

Thus, one aspect of the invention constitutes a drop on demand printing head comprising at least one nozzle formed on a substrate and having an associated electrothermal heater, characterized by the substrate material in the region of the heater being removed to form said nozzle.

In another aspect, the invention constitutes a method of fabricating a printing head which includes a self-aligned heater comprising the steps of: (a) forming a nozzle tip hole on a printing head substrate; (b) coating said nozzle tip hole with a substance; (c) removing said substance to a depth below the surface of the nozzle tip hole equal to the desired width of said heater; (d) coating said nozzle tip hole with a layer of heater material to a thickness equal to the desired thickness of said heater; and (e) etching said heater material in a manner so as to remove heater material that is on the sidewall surface of said nozzle tip hole.

Thus, one advantage of the invention is that the nozzle assembly for the liquid ink printing head assembly includes a self-aligned heater. Another advantage is that the printing head is fabricated on a silicon wafer. A further advantage of the invention is that a plurality of nozzles are formed on a single substrate.

In preferred embodiments, the nozzles are formed as holes which pass from the front surface to the back surface of a planar substrate.

In another aspect, the invention provides a drop on demand printing including a plurality of nozzles, being characterized in that at least one of the nozzle includes an electrothermal actuator, and further characterized that the heater is located at the tip of the nozzle. A preferred feature of the invention is that the heater is situated on a rim which protrudes from the surface of the printing head in the immediate vicinity of the rim.

Another preferred feature of the invention is that the substrate material in the region of the heater being removed. A further preferred aspect of the invention is that such printing head is fabricated on a silicon wafer.

A further preferred aspect of the invention is that a layer of material with a thermal conductivity less than the thermal conductivity of the substrate is provided between the heater and the substrate.

A further preferred aspect of the invention is that the layer of material between the heater and the substrate is silicon dioxide.

A further preferred aspect of the invention is that the nozzle is formed by anisotropic etching of the dielectric layer containing the heater.

A further preferred aspect of the invention is that the nozzle formation process includes anisotropic etching of the substrate.

A further preferred aspect of the invention is that the nozzle formation process includes etching from both the front surface and the back surface of the substrate.

A further preferred aspect of the invention is that the substrate is undercut in the region of the heater by an isotropic etching process which etches the substrate at a faster rate than the process etches the dielectric layer containing the heater.

BRIEF DESCRIPTION OF THE DRAWINGS

FIG. 1(*b*) shows a cross section of one variety of nozzle tip in accordance with the invention.

FIG. 3(*b*) shows successive meniscus positions during drop selection and separation.

FIG. 3(*c*) shows the temperatures at various points during a drop selection cycle.

FIG. 3(*d*) shows measured surface tension versus temperature curves for various ink additives.

FIG. 3(*e*) shows the power pulses which are applied to the nozzle heater to generate the temperature curves of FIG. 3(*c*)

FIG. 8(*b*) is a detail of FIG. 8(*a*).

FIG. 11(*b*) shows an approximate isometric view of the self-aligned heater structure.

DETAILED DESCRIPTION OF PREFERRED EMBODIMENTS

Figure 1A:
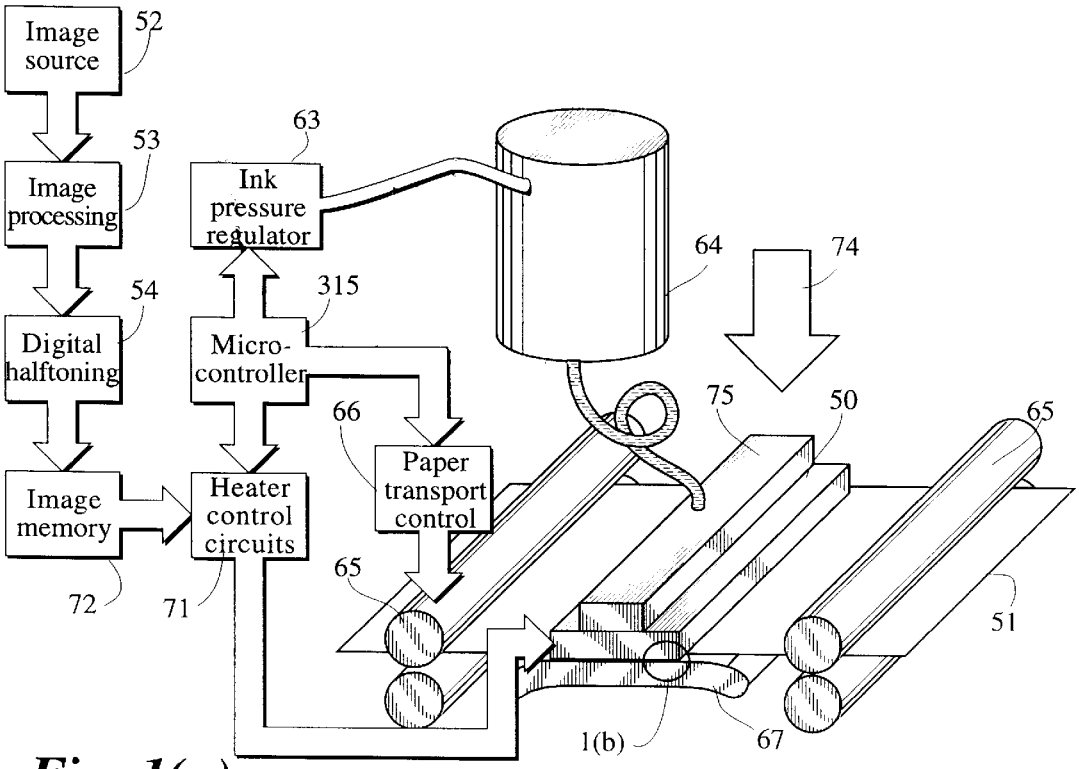
FIG. 1(*a*) shows a simplified block schematic diagram of one exemplary printing apparatus according to the present invention.

In one general aspect, the invention constitutes a drop-on-demand printing mechanism wherein the means of selecting drops to be printed produces a difference in position between selected drops and drops which are not selected, but which is insufficient to cause the ink drops to overcome the ink surface tension and separate from the body of ink, and wherein an alternative means is provided to cause separation of the selected drops from the body of ink.

The separation of drop selection means from drop separation means significantly reduces the energy required to select which ink drops are to be printed. Only the drop selection means must be driven by individual signals to each nozzle. The drop separation means can be a field or condition applied simultaneously to all nozzles.

The drop selection means may be chosen from, but is not limited to, the following list:

1) Electrothermal reduction of surface tension of pressurized ink
2) Electrothermal bubble generation, with insufficient bubble volume to cause drop ejection
3) Piezoelectric, with insufficient volume change to cause drop ejection
4) Electrostatic attraction with one electrode per nozzle The drop separation means may be chosen from, but is not limited to, the following list:

1) Proximity (recording medium in close proximity to print head)
2) Proximity with oscillating ink pressure
3) Electrostatic attraction
4) Magnetic attraction The table "DOD printing technology targets" shows some desirable characteristics of drop on demand printing technology. The table also lists some methods by which some embodiments described herein, or in other of my related applications, provide improvements over the prior art.

DOD printing technology targets

| Target | Method of achieving improvement over prior art |
|---|---|
| High speed operation | Practical, low cost, pagewidth printing heads with more than 10,000 nozzles. Monolithic A4 pagewidth print heads can be manufactured using standard 300 mm (12") silicon wafers |
| High image quality | High resolution (800 dpi is sufficient for most applications), six color process to reduce image noise |
| Full color operation | Halftoned process color at 800 dpi using stochastic screening |
| Ink flexibility | Low operating ink temperature and no requirement for bubble formation |
| Low power requirements | Low power operation results from drop selection means not being required to fully eject drop |
| Low cost | Monolithic print head without aperture plate, high manufacturing yield, small number of electrical connections, use of modified existing CMOS manufacturing facilities |
| High manufacturing yield | Integrated fault tolerance in printing head |
| High reliability | Integrated fault tolerance in printing head. Elimination of cavitation and kogation. Reduction of thermal shock. |
| Small number of electrical connections | Shift registers, control logic, and drive circuitry can be integrated on a monolithic print head using standard CMOS processes |
| Use of existing VLSI manufacturing facilities | CMOS compatibility. This can be achieved because the heater drive power is less is than 1% of Thermal Ink Jet heater drive power |
| Electronic collation | A new page compression system which can achieve 100:1 compression with insignificant image degradation, resulting in a compressed data rate low enough to allow real-time printing of any combination of thousands of pages stored on a low cost magnetic disk drive. |

In thermal ink jet (TIJ) and piezoelectric ink jet systems, a drop velocity of approximately 10 meters per second is preferred to ensure that the selected ink drops overcome ink surface tension, separate from the body of the ink, and strike the recording medium. These systems have a very low efficiency of conversion of electrical energy into drop kinetic energy. The efficiency of TIJ systems is approximately 0.02%). This means that the drive circuits for TIJ print heads must switch high currents. The drive circuits for piezoelectric ink jet heads must either switch high voltages, or drive highly capacitive loads. The total power consumption of pagewidth TIJ printheads is also very high. An 800 dpi A4 full color pagewidth TIJ print head printing a four color black image in one second would consume approximately 6 kW of electrical power, most of which is converted to waste heat. The difficulties of removal of this amount of heat precludes the production of low cost, high speed, high resolution compact pagewidth TIJ systems.

One important feature of embodiments of the invention is a means of significantly reducing the energy required to select which ink drops are to be printed. This is achieved by separating the means for selecting ink drops from the means for ensuring that selected drops separate from the body of ink and form dots on the recording medium. Only the drop selection means must be driven by individual signals to each nozzle. The drop separation means can be a field or condition applied simultaneously to all nozzles.

The table "Drop selection means" shows some of the possible means for selecting drops in accordance with the invention. The drop selection means is only required to create sufficient change in the position of selected drops that the drop separation means can discriminate between selected and unselected drops.

Drop selection means

| Method | Advantage | Limitation |
|---|---|---|
| 1. Electrothermal reduction of surface tension of pressurized ink | Low temperature increase and low drop selection energy. Can be used with many ink types. Simple fabrication. CMOS drive circuits can be fabricated on same substrate | Requires ink pressure regulating mechanism. Ink surface tension must reduce substantially as temperature increases |
| 2. Electrothermal reduction of ink viscosity, combined with oscillating ink pressure | Medium drop selection energy, suitable for hot melt and oil based inks. Simple fabrication. CMOS drive circuits can be fabricated on same substrate | Requires ink pressure oscillation mechanism. Ink must have a large decrease in viscosity as temperature increases |
| 3. Electrothermal bubble generation, with insufficient bubble volume to cause drop ejection | Well known technology, simple fabrication, bipolar drive circuits can be fabricated on same substrate | High drop selection energy, requires water based ink, problems with kogation, cavitation, thermal stress |
| 4. Piezoelectric, with insufficient volume change to cause drop ejection | Many types of ink base can be used | High manufacturing cost, incompatible with integrated circuit processes, high drive voltage, mechanical complexity, bulky |
| 5. Electrostatic attraction with one electrode per nozzle | Simple electrode fabrication | Nozzle pitch must be relatively large. Cross-talk between adjacent electric fields. Requires high voltage drive circuits |

Other drop selection means may also be used.

The preferred drop selection means for water based inks is method 1: "Electrothermal reduction of surface tension of pressurized ink". This drop selection means provides many advantages over other systems, including; low power operation (approximately 1% of TIJ), compatibility with CMOS VLSI chip fabrication, low voltage operation (approx. 10 V), high nozzle density, low temperature operation, and wide range of suitable ink formulations. The ink must exhibit a reduction in surface tension with increasing temperature.

The preferred drop selection means for hot melt or oil based inks is method 2: "Electrothermal reduction of ink viscosity, combined with oscillating ink pressure". This drop selection means is particularly suited for use with inks which exhibit a large reduction of viscosity with increasing temperature, but only a small reduction in surface tension. This occurs particularly with non-polar ink carriers with relatively high molecular weight. This is especially applicable to hot melt and oil based inks.

The table "Drop separation means" shows some of the possible methods for separating selected drops from the body of ink, and ensuring that the selected drops form dots on the printing medium. The drop separation means discriminates between selected drops and unselected drops to ensure that unselected drops do not form dots on the printing medium.

Drop separation means

| Means | Advantage | Limitation |
|---|---|---|
| 1. Electrostatic attraction | Can print on rough surfaces, simple implementation | Requires high voltage power supply |

-continued

| Drop separation means | | |
|---|---|---|
| Means | Advantage | Limitation |
| 2. AC electric field | Higher field strength is possible than electrostatic, operating margins can be increased, ink pressure reduced, and dust accumulation is reduced | Requires high voltage AC power supply synchronized to drop ejection phase. Multiple drop phase operation is difficult |
| 3. Proximity (print head in close proximity to, but not touching, recording medium) | Very small spot sizes can be achieved. Very low power dissipation. High drop position accuracy | Requires print medium to be very close to print head surface, not suitable for rough print media, usually requires transfer roller or belt |
| 4. Transfer Proximity (print head is in close proximity to a transfer roller or belt | Very small spot sizes can be achieved, very low power dissipation, high accuracy, can print on rough paper | Not compact due to size of transfer roller or transfer belt. |
| 5. Proximity with oscillating ink pressure | Useful for hot melt inks using viscosity reduction drop selection method, reduces possibility of nozzle clogging, can use pigments instead of dyes | Requires print medium to be very close to print head surface, not suitable for rough print media. Requires ink pressure oscillation apparatus |
| 6. Magnetic attraction | Can print on rough surfaces. Low power if permanent magnets are used | Requires uniform high magnetic field strength, requires magnetic ink |

Other drop separation means may also be used.

The preferred drop separation means depends upon the intended use. For most applications, method 1: "Electrostatic attraction", or method 2: "AC electric field" are most appropriate. For applications where smooth coated paper or film is used, and very high speed is not essential, method 3: "Proximity" may be appropriate. For high speed, high quality systems, method 4: "Transfer proximity" can be used. Method 6: "Magnetic attraction" is appropriate for portable printing systems where the print medium is too rough for proximity printing, and the high voltages required for electrostatic drop separation are undesirable. There is no clear 'best' drop separation means which is applicable to all circumstances.

Further details of various types of printing systems according to the present invention are described in the following Australian patent specifications filed on 12 Apr. 1995, the disclosure of which are hereby incorporated by reference:

- 'A Liquid ink Fault Tolerant (LIFT) printing mechanism' (Filing no.: PN2308);
- 'Electrothermal drop selection in LIFT printing' (Filing no.: PN2309);
- 'Drop separation in LIFT printing by print media proximity' (Filing no.: PN2310);
- 'Drop size adjustment in Proximity LIFT printing by varying head to media distance' (Filing no.: PN2311);
- 'Augmenting Proximity LIFT printing with acoustic ink waves' (Filing no.: PN2312);
- 'Electrostatic drop separation in LIFT printing' (Filing no.: PN2313);
- 'Multiple simultaneous drop sizes in Proximity LIFT printing' (Filing no.: PN2321);
- 'Self cooling operation in thermally activated print heads' (Filing no.: PN2322); and
- 'Thermal Viscosity Reduction LIFT printing' (Filing no.: PN2323).

Figure 1B:
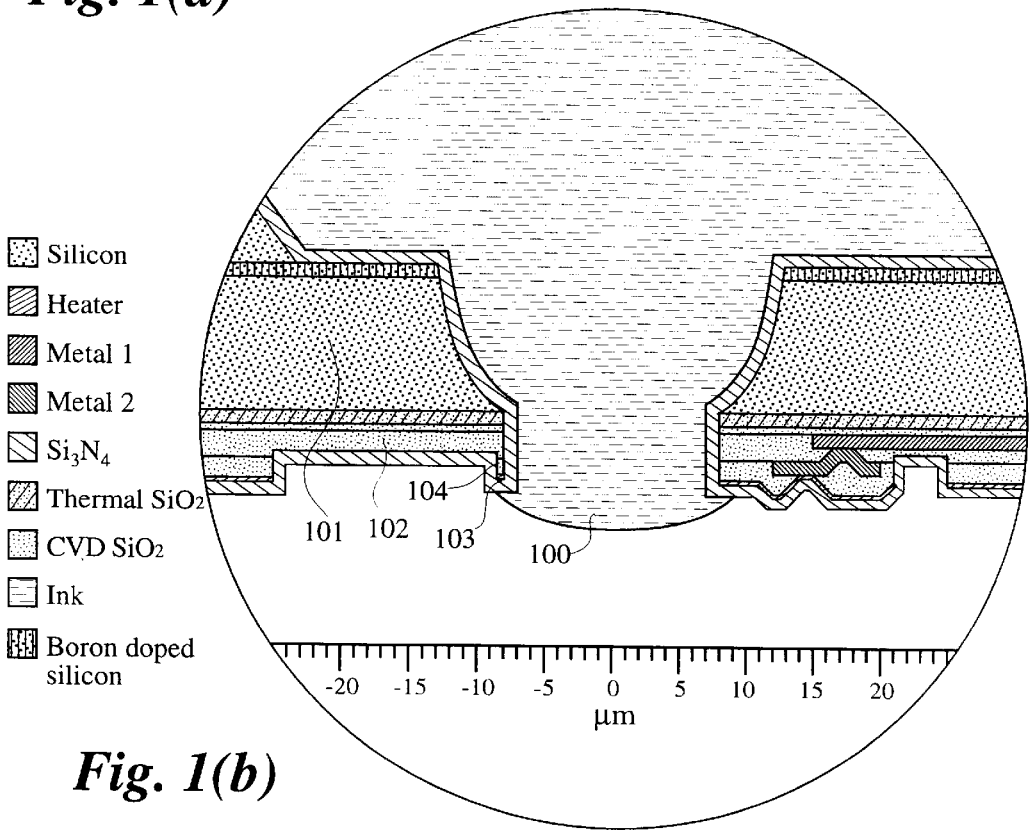
Figure 2A:
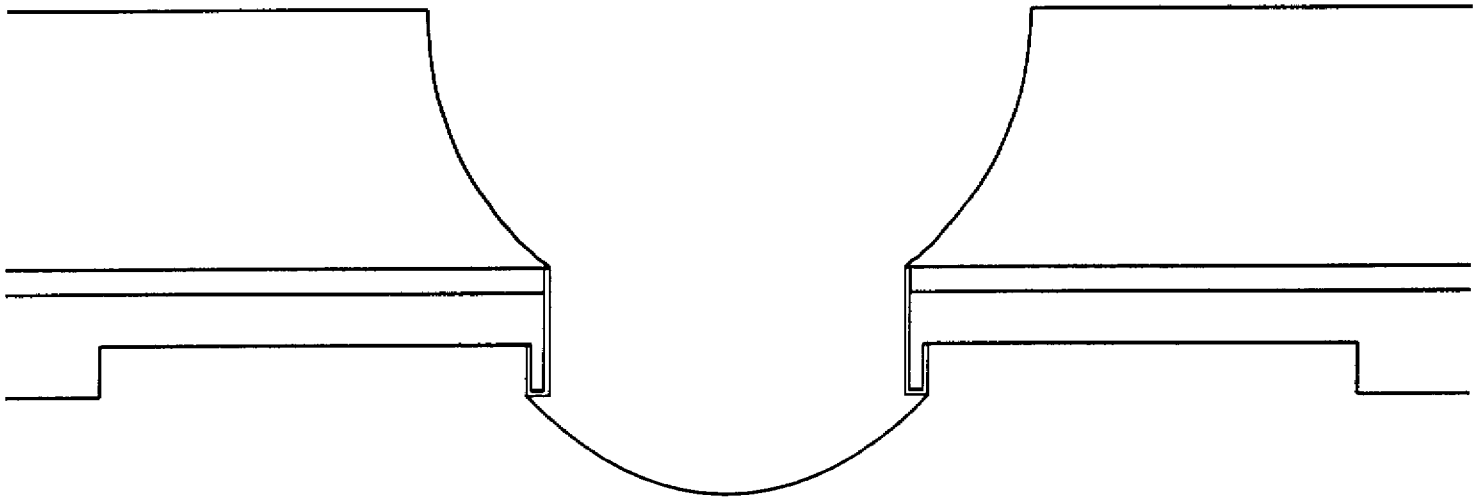
FIGS. 2(*a*) to 2(*f*) show fluid dynamic simulations of drop selection.
Figure 2B:
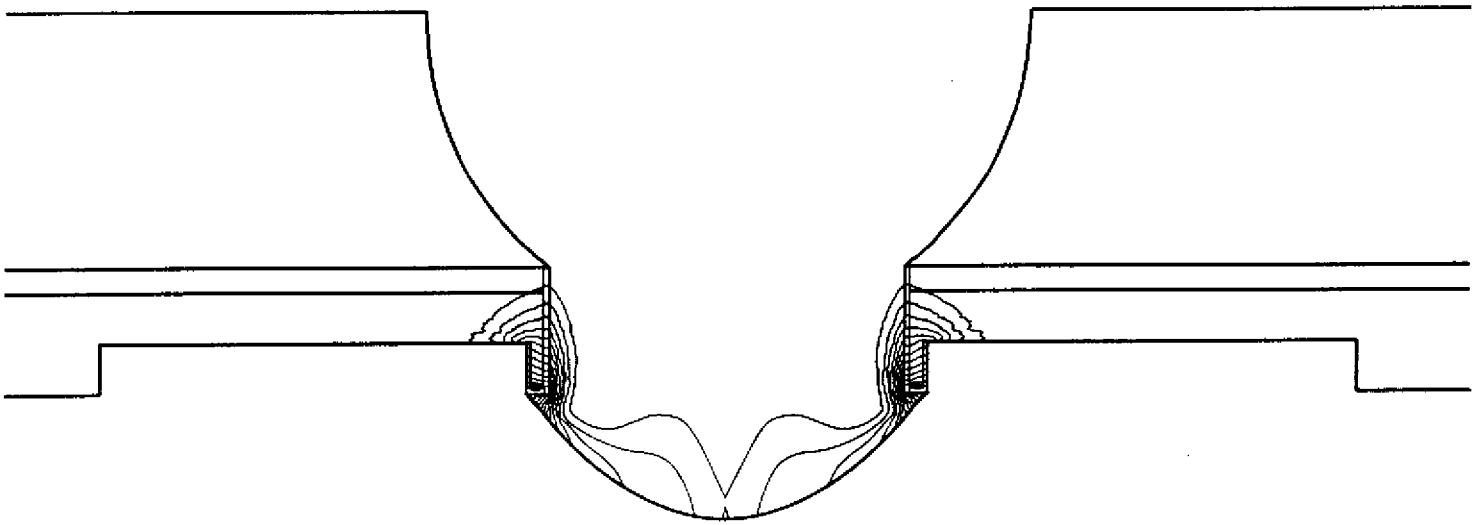
Figure 2C:
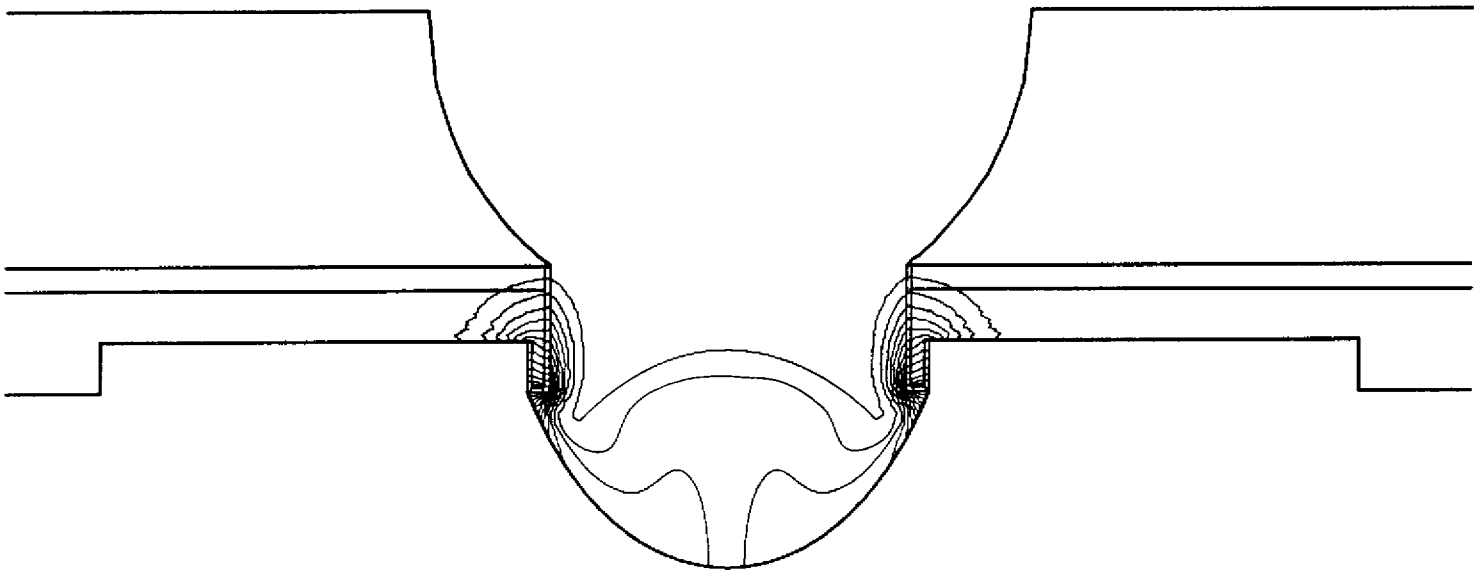
Figure 2D:
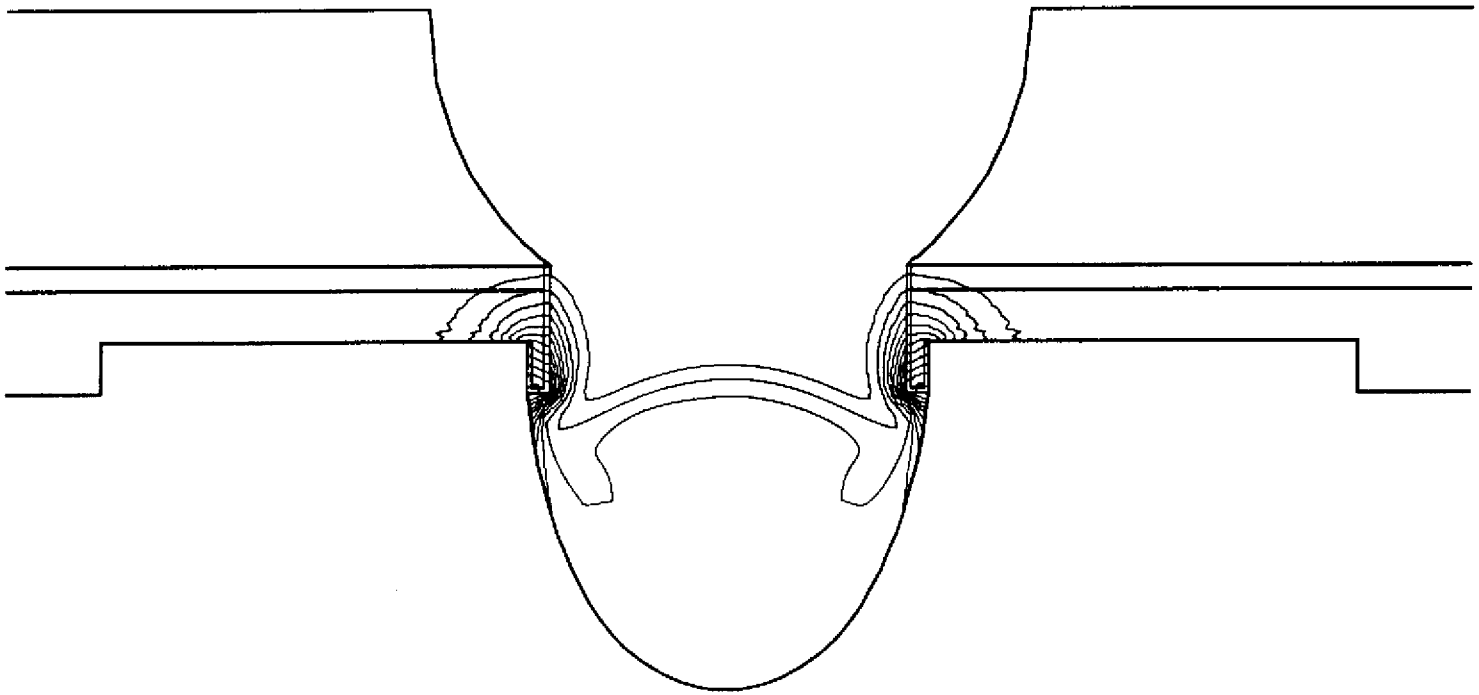
Figure 2E:
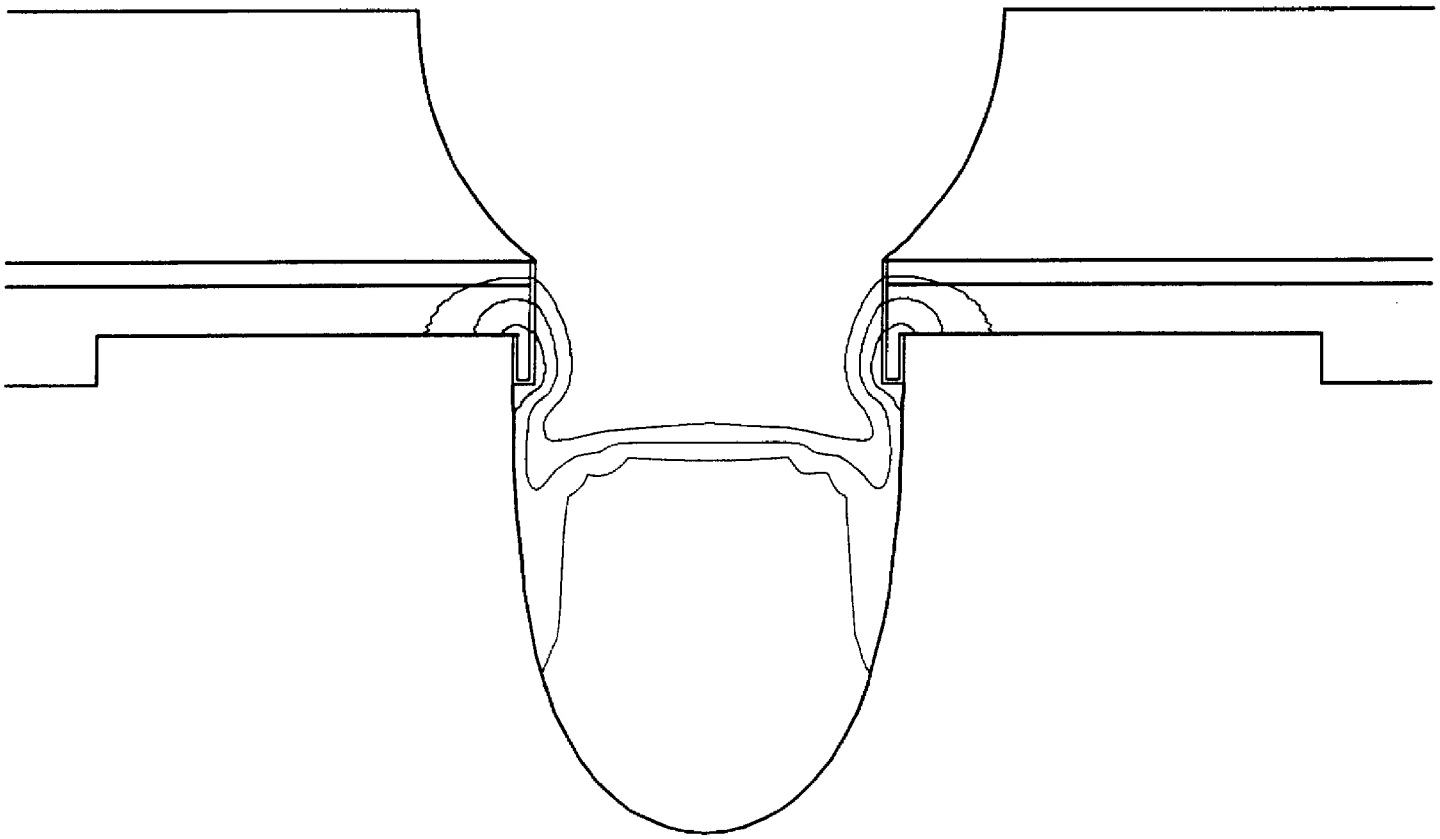
Figure 2F:
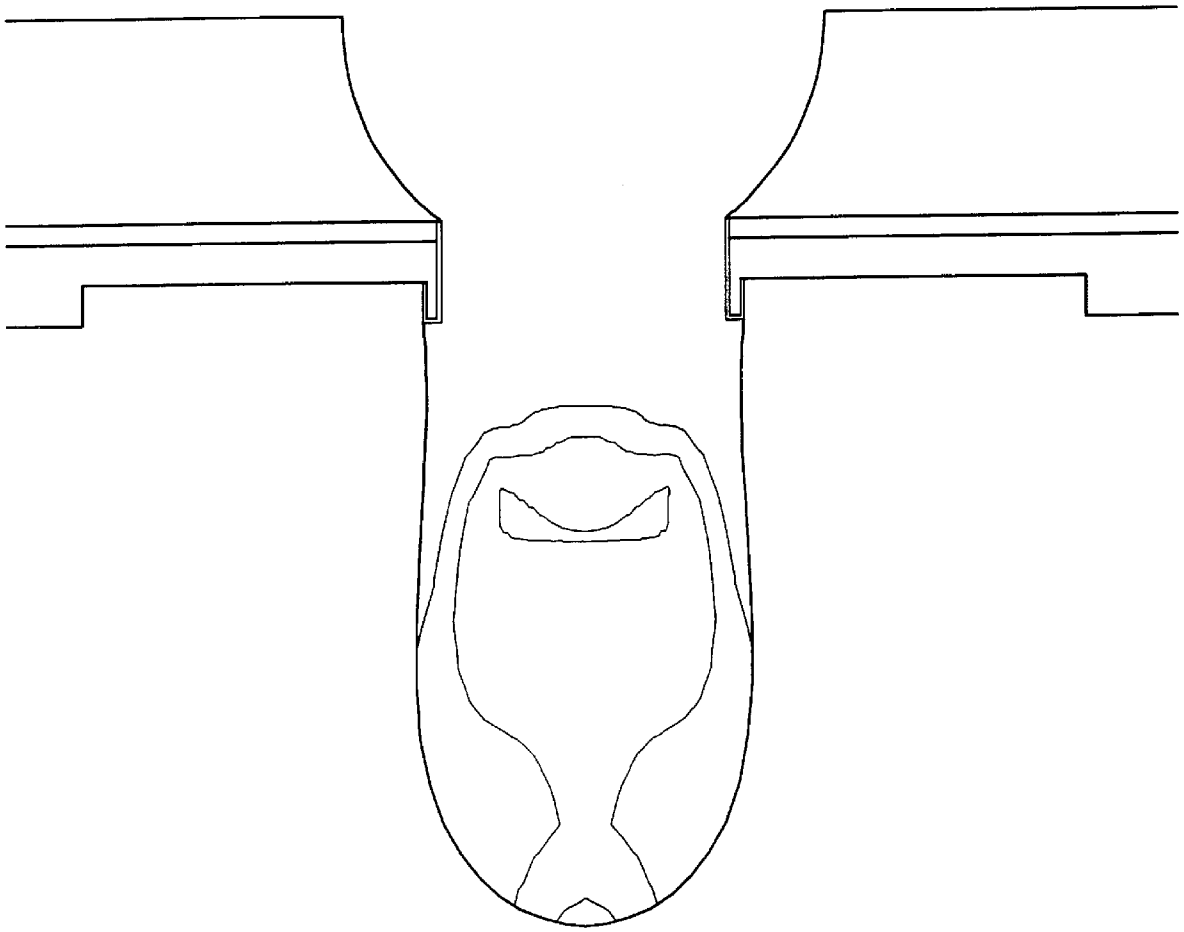
Figure 3A:
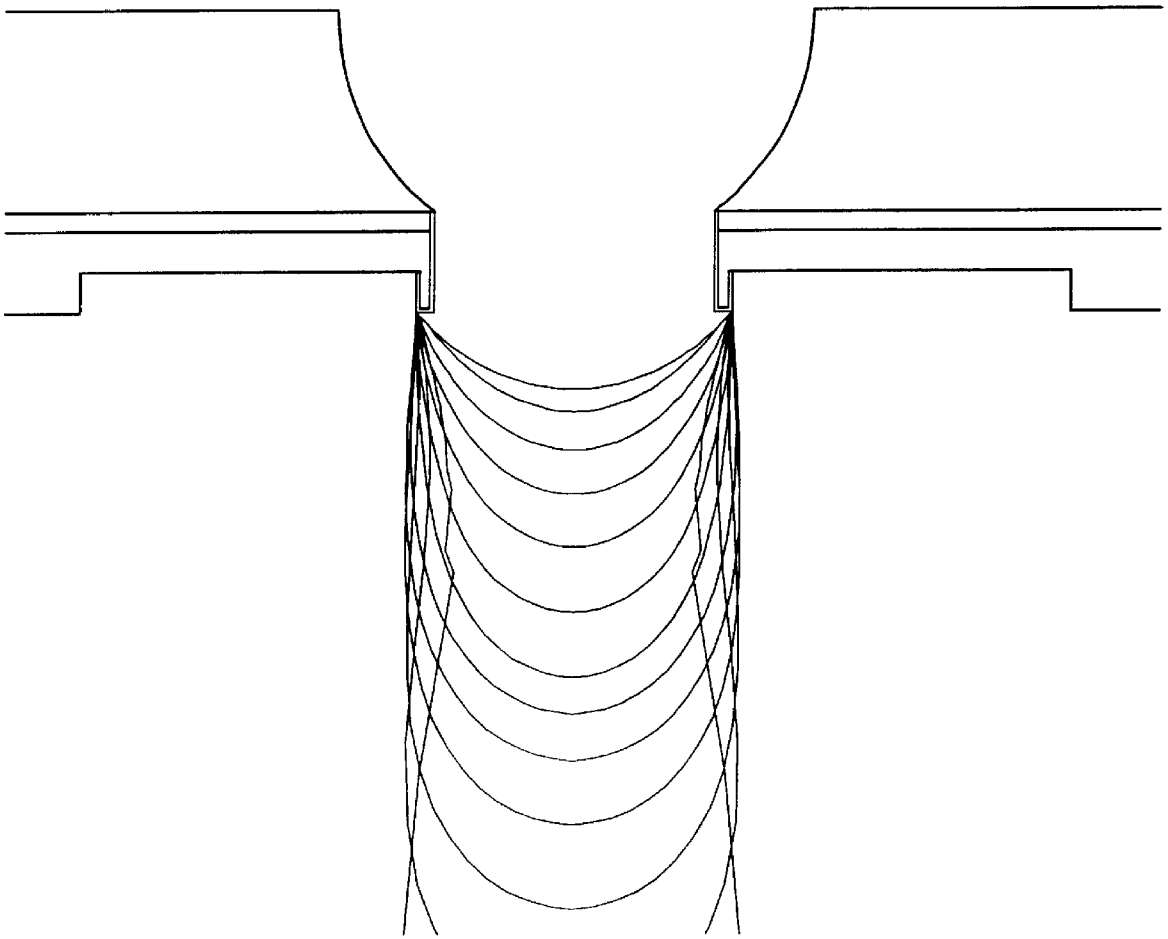
FIG. 3(*a*) shows a finite element fluid dynamic simulation of a nozzle in operation according to an embodiment of the invention.
Figure 3B:
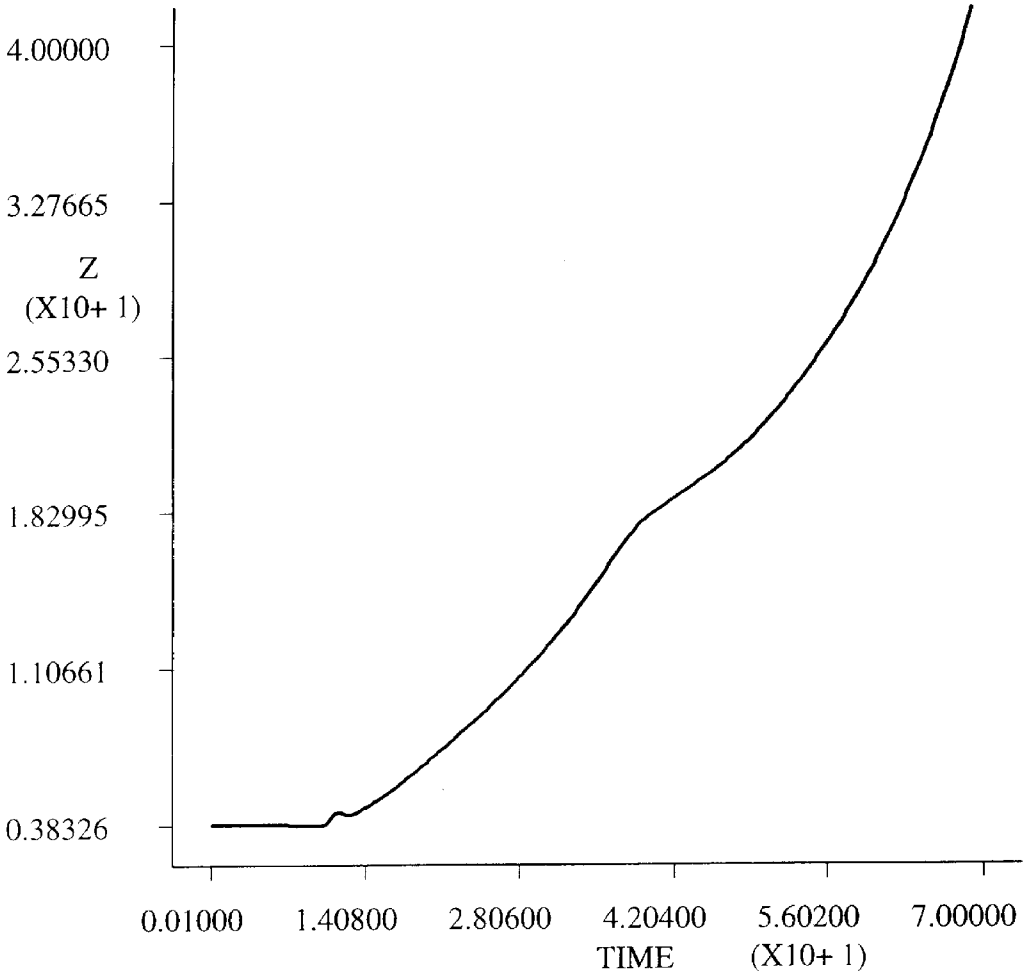
Figure 3C:
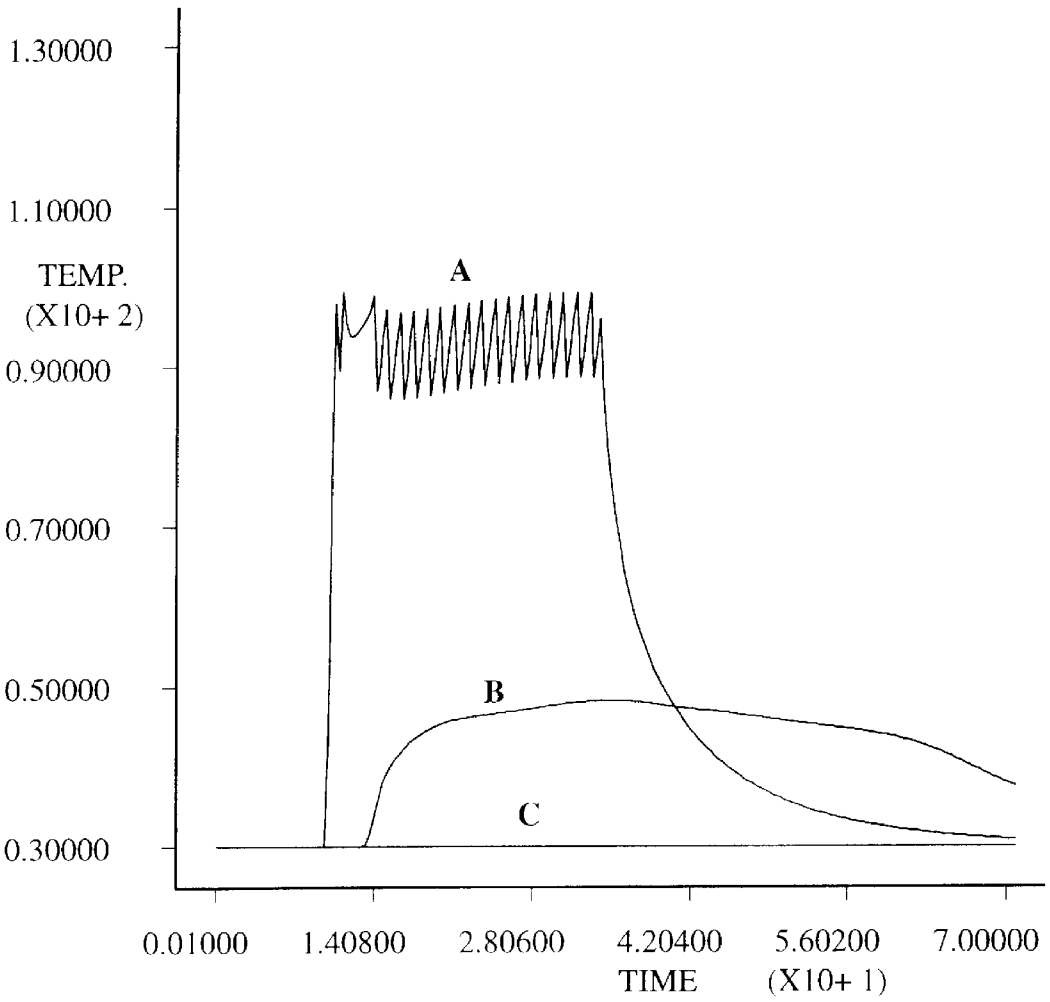
Figure 3D:
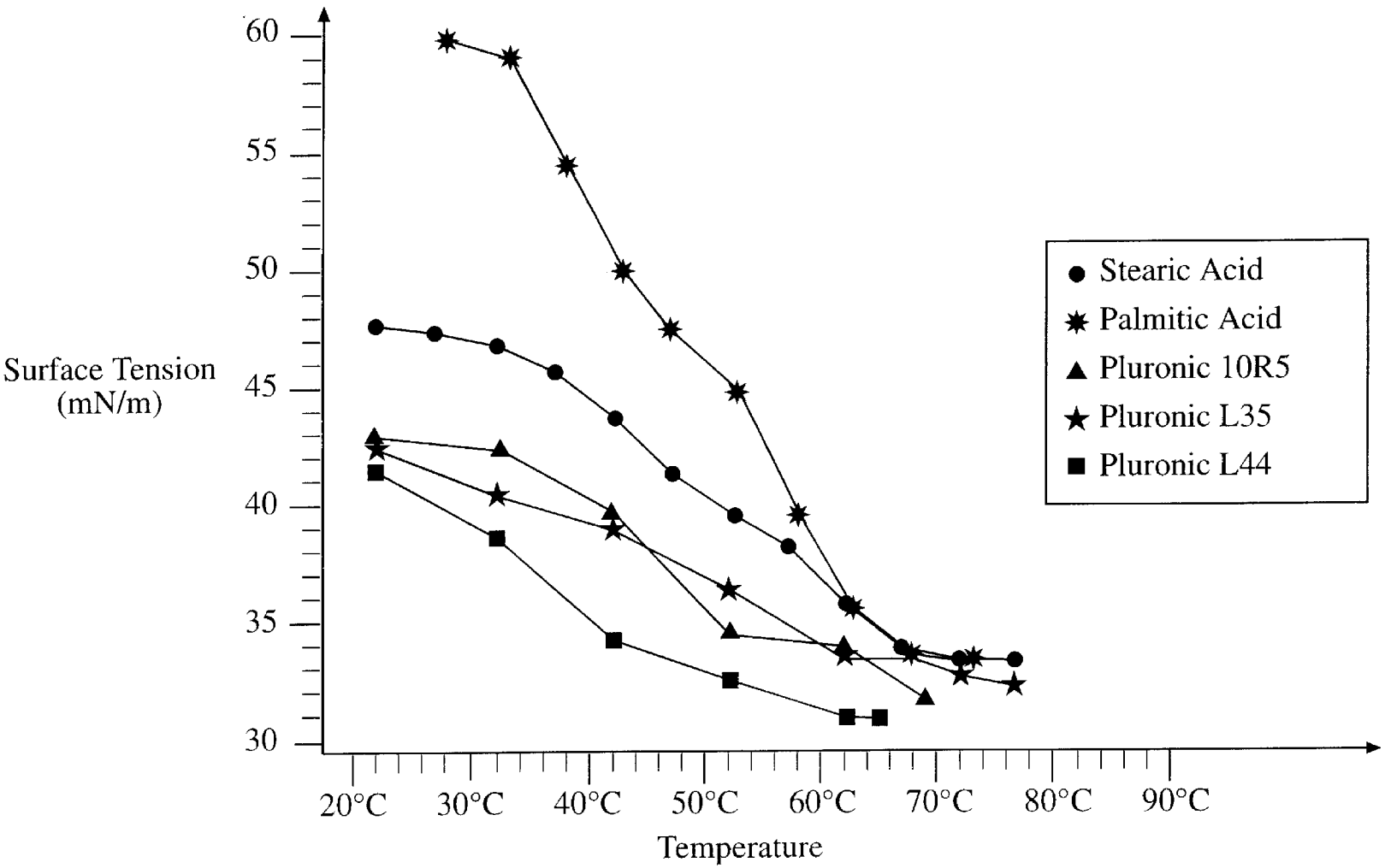
Figure 3E:
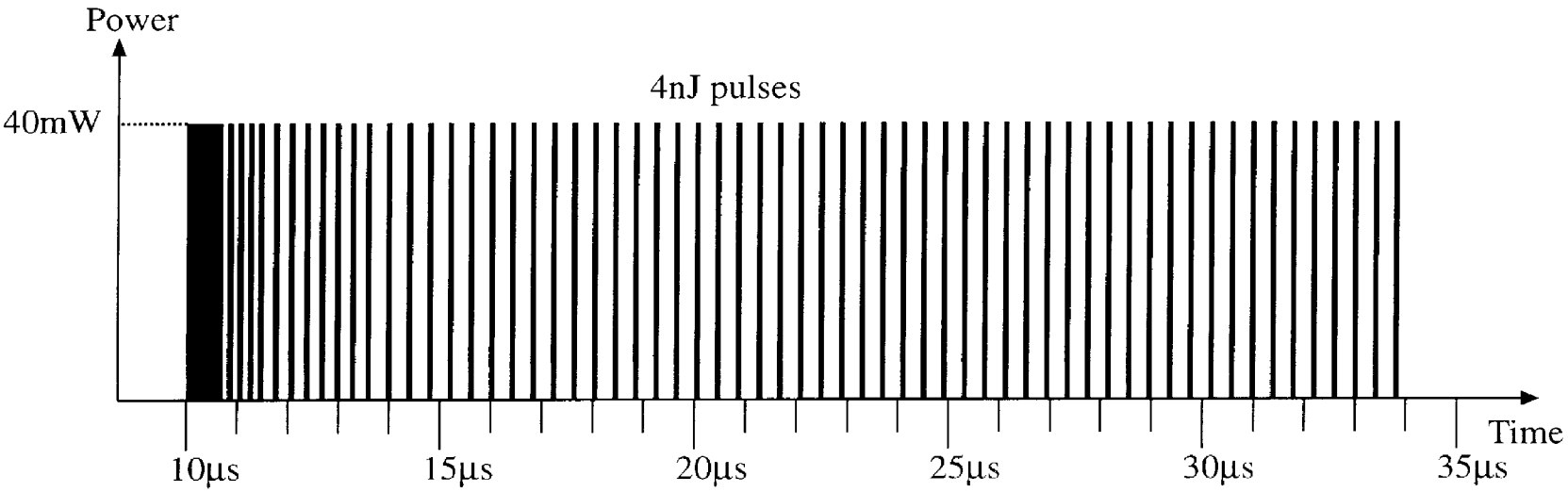

A simplified schematic diagram of one preferred printing system according to the invention appears in FIG. 1(*a*).

An image source 52 may be raster image data from a scanner or computer, or outline image data in the form of a page description language (PDL), or other forms of digital image representation. This image data is converted to a pixel-mapped page image by the image processing system 53. This may be a raster image processor (RIP) in the case of PDL image data, or may be pixel image manipulation in the case of raster image data. Continuous tone data produced by the image processing unit 53 is halftoned. Halftoning is performed by the Digital Halftoning unit 54. Halftoned bitmap image data is stored in the image memory 72. Depending upon the printer and system configuration, the image memory 72 may be a full page memory, or a band memory. Heater control circuits 71 read data from the image memory 72 and apply time-varying electrical pulses to the nozzle heaters (103 in FIG. 1(*b*)) that are part of the print head 50. These pulses are applied at an appropriate time, and to the appropriate nozzle, so that selected drops will form spots on the recording medium 51 in the appropriate position designated by the data in the image memory 72.

The recording medium 51 is moved relative to the head 50 by a paper transport system 65, which is electronically controlled by a paper transport control system 66, which in turn is controlled by a microcontroller 315. The paper transport system shown in FIG. 1(*a*) is schematic only, and many different mechanical configurations are possible. In the case of pagewidth print heads, it is most convenient to move the recording medium 51 past a stationary head 50. However, in the case of scanning print systems, it is usually most convenient to move the head 50 along one axis (the sub-scanning direction) and the recording medium 51 along the orthogonal axis (the main scanning direction), in a relative raster motion. The microcontroller 315 may also control the ink pressure regulator 63 and the heater control circuits 71.

For printing using surface tension reduction, ink is contained in an ink reservoir 64 under pressure. In the quiescent state (with no ink drop ejected), the ink pressure is insufficient to overcome the ink surface tension and eject a drop. A constant ink pressure can be achieved by applying pressure to the ink reservoir 64 under the control of an ink pressure regulator 63. Alternatively, for larger printing systems, the ink pressure can be very accurately generated and controlled by situating the top surface of the ink in the reservoir 64 an appropriate distance above the head 50. This ink level can be regulated by a simple float valve (not shown).

For printing using viscosity reduction, ink is contained in an ink reservoir 64 under pressure, and the ink pressure is caused to oscillate. The means of producing this oscillation may be a piezoelectric actuator mounted in the ink channels (not shown).

When properly arranged with the drop separation means, selected drops proceed to form spots on the recording medium 51, while unselected drops remain part of the body of ink.

The ink is distributed to the back surface of the head 50 by an ink channel device 75. The ink preferably flows through slots and/or holes etched through the silicon substrate of the head 50 to the front surface, where the nozzles and actuators are situated. In the case of thermal selection, the nozzle actuators are electrothermal heaters.

In some types of printers according to the invention, an external field 74 is required to ensure that the selected drop separates from the body of the ink and moves towards the recording medium 51. A convenient external field 74 is a constant electric field, as the ink is easily made to be electrically conductive. In this case, the paper guide or platen 67 can be made of electrically conductive material and used as one electrode generating the electric field. The other electrode can be the head 50 itself. Another embodiment uses proximity of the print medium as a means of discriminating between selected drops and unselected drops.

For small drop sizes gravitational force on the ink drop is very small; approximately $10^{-4}$ of the surface tension forces, so gravity can be ignored in most cases. This allows the print head 50 and recording medium 51 to be oriented in any direction in relation to the local gravitational field. This is an important requirement for portable printers.

FIG. 1(*b*) is a detail enlargement of a cross section of a single microscopic nozzle tip embodiment of the invention, fabricated using a modified CMOS process. The nozzle is etched in a substrate 101, which may be silicon, glass, metal, or any other suitable material. If substrates which are not semiconductor materials are used, a semiconducting material (such as amorphous silicon) may be deposited on the substrate, and integrated drive transistors and data distribution circuitry may be formed in the surface semiconducting layer. Single crystal silicon (SCS) substrates have several advantages, including:

1) High performance drive transistors and other circuitry can be fabricated in SCS;
2) Print heads can be fabricated in existing facilities (fabs) using standard VLSI processing equipment;
3) SCS has high mechanical strength and rigidity; and
4) SCS has a high thermal conductivity.

In this example, the nozzle is of cylindrical form, with the heater 103 forming an annulus. The nozzle tip 104 is formed from silicon dioxide layers 102 deposited during the fabrication of the CMOS drive circuitry. The nozzle tip is passivated with silicon nitride. The protruding nozzle tip controls the contact point of the pressurized ink 100 on the print head surface. The print head surface is also hydrophobized to prevent accidental spread of ink across the front of the print head.

Many other configurations of nozzles are possible, and nozzle embodiments of the invention may vary in shape, dimensions, and materials used. Monolithic nozzles etched from the substrate upon which the heater and drive electronics are formed have the advantage of not requiring an orifice plate. The elimination of the orifice plate has significant cost savings in manufacture and assembly. Recent methods for eliminating orifice plates include the use of 'vortex' actuators such as those described in Domoto et al U.S. Pat. No. 4,580,158, 1986, assigned to Xerox, and Miller et al U.S. Pat. No. 5,371,527, 1994 assigned to Hewlett-Packard. These, however are complex to actuate, and difficult to fabricate. The preferred method for elimination of orifice plates for print heads of the invention is incorporation of the orifice into the actuator substrate.

This type of nozzle may be used for print heads using various techniques for drop separation.

Operation with Electrostatic Drop Separation

As a first example, operation using thermal reduction of surface tension and electrostatic drop separation is shown in FIG. 2.

FIG. 2 shows the results of energy transport and fluid dynamic simulations performed using FIDAP, a commercial fluid dynamic simulation software package available from Fluid Dynamics Inc., of Illinois, U.S.A. This simulation is of a thermal drop selection nozzle embodiment with a diameter of 8 $\mu$m, at an ambient temperature of 30° C. The total energy applied to the heater is 276 nJ, applied as 69 pulses of 4 nJ each. The ink pressure is 10 kPa above ambient air pressure, and the ink viscosity at 30° C. is 1.84 cPs. The ink is water based, and includes a sol of 0.1% palmitic acid to achieve an enhanced decrease in surface tension with increasing temperature. A cross section of the nozzle tip from the central axis of the nozzle to a radial distance of 40 $\mu$m is shown. Heat flow in the various materials of the nozzle, including silicon, silicon nitride, amorphous silicon dioxide, crystalline silicon dioxide, and water based ink are simulated using the respective densities, heat capacities, and thermal conductivities of the materials. The time step of the simulation is 0.1 $\mu$s.

FIG. 2(*a*) shows a quiescent state, just before the heater is actuated. An equilibrium is created whereby no ink escapes the nozzle in the quiescent state by ensuring that the ink pressure plus external electrostatic field is insufficient to overcome the surface tension of the ink at the ambient temperature. In the quiescent state, the meniscus of the ink does not protrude significantly from the print head surface, so the electrostatic field is not significantly concentrated at the meniscus.

FIG. 2(*b*) shows thermal contours at 5° C. intervals 5 $\mu$s after the start of the heater energizing pulse. When the heater is energized, the ink in contact with the nozzle tip is rapidly heated. The reduction in surface tension causes the heated portion of the meniscus to rapidly expand relative to the cool ink meniscus. This drives a convective flow which rapidly transports this heat over part of the free surface of the ink at the nozzle tip. It is necessary for the heat to be distributed over the ink surface, and not just where the ink is in contact with the heater. This is because viscous drag against the solid heater prevents the ink directly in contact with the heater from moving.

FIG. 2(*c*) shows thermal contours at 5° C. intervals 10 $\mu$s after the start of the heater energizing pulse. The increase in temperature causes a decrease in surface tension, disturbing the equilibrium of forces. As the entire meniscus has been heated, the ink begins to flow.

FIG. 2(*d*) shows thermal contours at 5° C. intervals 20 $\mu$s after the start of the heater energizing pulse. The ink pressure has caused the ink to flow to a new meniscus position, which protrudes from the print head. The electrostatic field becomes concentrated by the protruding conductive ink drop.

FIG. 2(*e*) shows thermal contours at 5° C. intervals 30 $\mu$s after the start of the heater energizing pulse, which is also 6 $\mu$s after the end of the heater pulse, as the heater pulse duration is 24 $\mu$s. The nozzle tip has rapidly cooled due to conduction through the oxide layers, and conduction into the flowing ink. The nozzle tip is effectively 'water cooled' by the ink. Electrostatic attraction causes the ink drop to begin to accelerate towards the recording medium. Were the heater pulse significantly shorter (less than 16 $\mu$s in this case) the ink would not accelerate towards the print medium, but would instead return to the nozzle.

FIG. 2(*f*) shows thermal contours at 5° C. intervals 26 $\mu$s after the end of the heater pulse. The temperature at the nozzle tip is now less than 5° C. above ambient temperature. This causes an increase in surface tension around the nozzle tip. When the rate at which the ink is drawn from the nozzle exceeds the viscously limited rate of ink flow through the nozzle, the ink in the region of the nozzle tip 'necks', and the selected drop separates from the body of ink. The selected drop then travels to the recording medium under the influence of the external electrostatic field. The meniscus of the ink at the nozzle tip then returns to its quiescent position, ready for the next heat pulse to select the next ink drop. One ink drop is selected, separated and forms a spot on the recording medium for each heat pulse. As the heat pulses are electrically controlled, drop on demand ink jet operation can be achieved.

FIG. 3(*a*) shows successive meniscus positions during the drop selection cycle at 5 μs intervals, starting at the beginning of the heater energizing pulse.

FIG. 3(*b*) is a graph of meniscus position versus time, showing the movement of the point at the centre of the meniscus. The heater pulse starts 10 μs into the simulation.

FIG. 3(*c*) shows the resultant curve of temperature with respect to time at various points in the nozzle. The vertical axis of the graph is temperature, in units of 100° C. The horizontal axis of the graph is time, in units of 10 μs. The temperature curve shown in FIG. 3(*b*) was calculated by FIDAP, using 0.1 μs time steps. The local ambient temperature is 30 degrees C. Temperature histories at three points are shown:

A—Nozzle tip: This shows the temperature history at the circle of contact between the passivation layer, the ink, and air.

B—Meniscus midpoint: This is at a circle on the ink meniscus midway between the nozzle tip and the centre of the meniscus.

C—Chip surface: This is at a point on the print head surface 20 μm from the centre of the nozzle. The temperature only rises a few degrees. This indicates that active circuitry can be located very close to the nozzles without experiencing performance or lifetime degradation due to elevated temperatures.

FIG. 3(*e*) shows the power applied to the heater. Optimum operation requires a sharp rise in temperature at the start of the heater pulse, a maintenance of the temperature a little below the boiling point of the ink for the duration of the pulse, and a rapid fall in temperature at the end of the pulse. To achieve this, the average energy applied to the heater is varied over the duration of the pulse. In this case, the variation is achieved by pulse frequency modulation of 0.1 μs sub-pulses, each with an energy of 4 nJ. The peak power applied to the heater is 40 mW, and the average power over the duration of the heater pulse is 11.5 mW. The sub-pulse frequency in this case is 5 Mhz. This can readily be varied without significantly affecting the operation of the print head. A higher sub-pulse frequency allows finer control over the power applied to the heater. A sub-pulse frequency of 13.5 Mhz is suitable, as this frequency is also suitable for minimizing the effect of radio frequency interference (RFI).

Ink

FIG. 3(*d*) shows the measured effect of temperature on the surface tension of various aqueous preparations containing the following additives:

1) 0.1% sol of Stearic Acid 2) 0.1% sol of Palmitic acid 3) 0.1% solution of Pluronic 10R5 (trade mark of BASF)

4) 0.1% solution of Pluronic L35 (trade mark of BASF)

5) 0.1% solution of Pluronic L44 (trade mark of BASF)

Inks suitable for printing systems of the present invention are described in the following Australian patent specifications, the disclosure of which are hereby incorporated by reference:

'Ink composition based on a microemulsion' (Filing no.: PN5223, filed on 6 Sep. 1995);

'Ink composition containing surfactant sol' (Filing no.: PN5224, filed on 6 Sep. 1995);

'Ink composition for DOD printers with Krafft point near the drop selection temperature sol' (Filing no.: PN6240, filed on 30 Oct. 1995);

'Dye and pigment in a microemulsion based ink' (Filing no.: PN6241, filed on 30 Oct. 1995);

Operation Using Reduction of Viscosity

As a second example, operation of an embodiment using thermal reduction of viscosity and proximity drop separation, in combination with hot melt ink, is as follows. Prior to operation of the printer, solid ink is melted in the reservoir 64. The reservoir, ink passage to the print head, ink channels 75, and print head 50 are maintained at a temperature at which the ink 100 is liquid, but exhibits a relatively high viscosity (for example, approximately 100 cP). The Ink 100 is retained in the nozzle by the surface tension of the ink. The ink 100 is formulated so that the viscosity of the ink reduces with increasing temperature. The ink pressure oscillates at a frequency which is an integral multiple of the drop ejection frequency from the nozzle. The ink pressure oscillation causes oscillations of the ink meniscus at the nozzle tips, but this oscillation is small due to the high ink viscosity. At the normal operating temperature, these oscillations are of insufficient amplitude to result in drop separation. When the heater 103 is energized, the ink forming the selected drop is heated, causing a reduction in viscosity to a value which is preferably less than 5 cP. The reduced viscosity results in the ink meniscus moving further during the high pressure part of the ink pressure cycle. The recording medium 51 is arranged sufficiently close to the print head 50 so that the selected drops contact the recording medium 51, but sufficiently far away that the unselected drops do not contact the recording medium 51. Upon contact with the recording medium 51, part of the selected drop freezes, and attaches to the recording medium. As the ink pressure falls, ink begins to move back into the nozzle. The body of ink separates from the ink which is frozen onto the recording medium. The meniscus of the ink 100 at the nozzle tip then returns to low amplitude oscillation. The viscosity of the ink increases to its quiescent level as remaining heat is dissipated to the bulk ink and print head. One ink drop is selected, separated and forms a spot on the recording medium 51 for each heat pulse. As the heat pulses are electrically controlled, drop on demand ink jet operation can be achieved.

Manufacturing of Print Heads

Manufacturing processes for monolithic print heads in accordance with the present invention are described in the following Australian patent specifications filed on 12 Apr. 1995, the disclosure of which are hereby incorporated by reference:

'A monolithic LIFT printing head' (Filing no.: PN2301);

'A manufacturing process for monolithic LIFT printing heads' (Filing no.: PN2302);

'A self-aligned heater design for LIFT print heads' (Filing no.: PN2303);

'Integrated four color LIFT print heads' (Filing no.: PN2304);

'Power requirement reduction in monolithic LIFT printing heads' (Filing no.: PN2305);

'A manufacturing process for monolithic LIFT print heads using anisotropic wet etching' (Filing no.: PN2306);

'Nozzle placement in monolithic drop-on-demand print heads' (Filing no.: PN2307);

'Heater structure for monolithic LIFT print heads' (Filing no.: PN2346);

'Power supply connection for monolithic LIFT print heads' (Filing no.: PN2347);

'External connections for Proximity LIFT print heads' (Filing no.: PN2348); and

'A self-aligned manufacturing process for monolithic LIFT print heads' (Filing no.: PN2349); and 'CMOS process compatible fabrication of LIFT print heads' (Filing no.: PN5222, 6 Sep. 1995).

'A manufacturing process for LIFT print heads with nozzle rim heaters' (Filing no.: PN6238, 30 Oct. 1995);

'A modular LIFT print head' (Filing no.: PN6237, 30 Oct. 1995);

'Method of increasing packing density of printing nozzles' (Filing no.: PN6236, 30 Oct. 1995); and 'Nozzle dispersion for reduced electrostatic interaction between simultaneously printed droplets' (Filing no.: PN6239, 30 Oct. 1995).

Control of Print Heads

Means of providing page image data and controlling heater temperature in print heads of the present invention is described in the following Australian patent specifications filed on 12 Apr. 1995, the disclosure of which are hereby incorporated by reference:

'Integrated drive circuitry in LIFT print heads' (Filing no.: PN2295);

'A nozzle clearing procedure for Liquid Ink Fault Tolerant (LIFT) printing' (Filing no.: PN2294);

'Heater power compensation for temperature in LIFT printing systems' (Filing no.: PN2314);

'Heater power compensation for thermal lag in LIFT printing systems' (Filing no.: PN2315);

'Heater power compensation for print density in LIFT printing systems' (Filing no.: PN2316);

'Accurate control of temperature pulses in printing heads' (Filing no.: PN2317);

'Data distribution in monolithic LIFT print heads' (Filing no.: PN2318);

'Page image and fault tolerance routing device for LIFT printing systems' (Filing no.: PN2319); and 'A removable pressurized liquid ink cartridge for LIFT printers' (Filing no.: PN2320).

Image Processing for Print Heads

An objective of printing systems according to the invention is to attain a print quality which is equal to that which people are accustomed to in quality color publications printed using offset printing. This can be achieved using a print resolution of approximately 1,600 dpi. However, 1,600 dpi printing is difficult and expensive to achieve. Similar results can be achieved using 800 dpi printing, with 2 bits per pixel for cyan and magenta, and one bit per pixel for yellow and black. This color model is herein called CC'MM'YK. Where high quality monochrome image printing is also required, two bits per pixel can also be used for black. This color model is herein called CC'MM'YKK'. Color models, halftoning, data compression, and real-time expansion systems suitable for use in systems of this invention and other printing systems are described in the following Australian patent specifications filed on 12 Apr. 1995, the disclosure of which are hereby incorporated by reference:

'Four level ink set for bi-level color printing' (Filing no.: PN2339);

'Compression system for page images' (Filing no.: PN2340);

'Real-time expansion apparatus for compressed page images' (Filing no.: PN2341); and 'High capacity compressed document image storage for digital color printers' (Filing no.: PN2342);

'Improving JPEG compression in the presence of text' (Filing no.: PN2343);

'An expansion and halftoning device for compressed page images' (Filing no.: PN2344); and 'Improvements in image halftoning' (Filing no.: PN2345).

Applications Using Print Heads According to this Invention

Printing apparatus and methods of this invention are suitable for a wide range of applications, including (but not limited to) the following: color and monochrome office printing, short run digital printing, high speed digital printing, process color printing, spot color printing, offset press supplemental printing, low cost printers using scanning print heads, high speed printers using pagewidth print heads, portable color and monochrome printers, color and monochrome copiers, color and monochrome facsimile machines, combined printer, facsimile and copying machines, label printing, large format plotters, photographic duplication, printers for digital photographic processing, portable printers incorporated into digital 'instant' cameras, video printing, printing of PhotoCD images, portable printers for 'Personal Digital Assistants', wallpaper printing, indoor sign printing, billboard printing, and fabric printing.

Printing systems based on this invention are described in the following Australian patent specifications filed on 12 Apr. 1995, the disclosure of which are hereby incorporated by reference:

'A high speed color office printer with a high capacity digital page image store' (Filing no.: PN2329);

'A short run digital color printer with a high capacity digital page image store' (Filing no.: PN2330);

'A digital color printing press using LIFT printing technology' (Filing no.: PN2331);

'A modular digital printing press' (Filing no.: PN2332);

'A high speed digital fabric printer' (Filing no.: PN2333);

'A color photograph copying system' (Filing no.: PN2334);

'A high speed color photocopier using a LIFT printing system' (Filing no.: PN2335);

'A portable color photocopier using LIFT printing technology' (Filing no.: PN2336);

'A photograph processing system using LIFT printing technology' (Filing no.: PN2337);

'A plain paper facsimile machine using a LIFT printing system' (Filing no.: PN2338);

'A PhotoCD system with integrated printer' (Filing no.: PN2293);

'A color plotter using LIFT printing technology' (Filing no.: PN2291);

'A notebook computer with integrated LIFT color printing system' (Filing no.: PN2292);

'A portable printer using a LIFT printing system' (Filing no.: PN2300);

'Fax machine with on-line database interrogation and customized magazine printing' (Filing no.: PN2299);

'Miniature portable color printer' (Filing no.: PN2298);

'A color video printer using a LIFT printing system' (Filing no.: PN2296); and

'An integrated printer, copier, scanner, and facsimile using a LIFT printing system' (Filing no.: PN2297)

Compensation of Print Heads for Environmental Conditions

It is desirable that drop on demand printing systems have consistent and predictable ink drop size and position. Unwanted variation in ink drop size and position causes variations in the optical density of the resultant print, reducing the perceived print quality. These variations should be kept to a small proportion of the nominal ink drop volume and pixel spacing respectively. Many environmental variables can be compensated to reduce their effect to insignificant levels. Active compensation of some factors can be achieved by varying the power applied to the nozzle heaters.

An optimum temperature profile for one print head embodiment involves an instantaneous raising of the active region of the nozzle tip to the ejection temperature, maintenance of this region at the ejection temperature for the duration of the pulse, and instantaneous cooling of the region to the ambient temperature.

This optimum is not achievable due to the stored heat capacities and thermal conductivities of the various materials used in the fabrication of the nozzles in accordance with the invention. However, improved performance can be achieved by shaping the power pulse using curves which can be derived by iterative refinement of finite element simulation of the print head. The power applied to the heater can be varied in time by various techniques, including, but not limited to:

1) Varying the voltage applied to the heater
2) Modulating the width of a series of short pulses (PWM)
3) Modulating the frequency of a series of short pulses (PFM)

To obtain accurate results, a transient fluid dynamic simulation with free surface modeling is required, as convection in the ink, and ink flow, significantly affect the temperature achieved with a specific power curve.

By the incorporation of appropriate digital circuitry on the print head substrate, it is practical to individually control the power applied to each nozzle. One way to achieve this is by 'broadcasting' a variety of different digital pulse trains across the print head chip, and selecting the appropriate pulse train for each nozzle using multiplexing circuits.

An example of the environmental factors which may be compensated for is listed in the table "Compensation for environmental factors". This table identifies which environmental factors are best compensated globally (for the entire print head), per chip (for each chip in a composite multi-chip print head), and per nozzle.

Compensation for environmental factors

| Factor compensated | Scope | Sensing or user control method | Compensation mechanism |
|---|---|---|---|
| Ambient Temperature | Global | Temperature sensor mounted on print head | Power supply voltage or global PFM patterns |
| Power supply voltage fluctuation with number of active nozzles | Global | Predictive active nozzle count based on print data | Power supply voltage or global PFM patterns |
| Local heat build-up with successive nozzle actuation | Per nozzle | Predictive active nozzle count based on print data | Selection of appropriate PFM pattern for each printed drop |
| Drop size control for multiple bits per pixel | Per nozzle | Image data | Selection of appropriate PFM pattern for each printed drop |
| Nozzle geometry variations between wafers | Per chip | Factory measurement, datafile supplied with print head | Global PFM patterns per print head chip |
| Heater resistivity variations between wafers | Per chip | Factory measurement, datafile supplied with print head | Global PFM patterns per print head chip |
| User image intensity adjustment | Global | User selection | Power supply voltage, electrostatic acceleration voltage, or ink pressure |
| Ink surface tension reduction method and threshold temperature | Global | Ink cartridge sensor or user selection | Global PFM patterns |
| Ink viscosity | Global | Ink cartridge sensor or user selection | Global PFM patterns and/or clock rate |
| Ink dye or pigment concentration | Global | Ink cartridge sensor or user selection | Global PFM patterns |
| Ink response time | Global | Ink cartridge sensor or user selection | Global PFM patterns |

Most applications will not require compensation for all of these variables. Some variables have a minor effect, and compensation is only necessary where very high image quality is required.

Print head drive circuits

Figure 4:
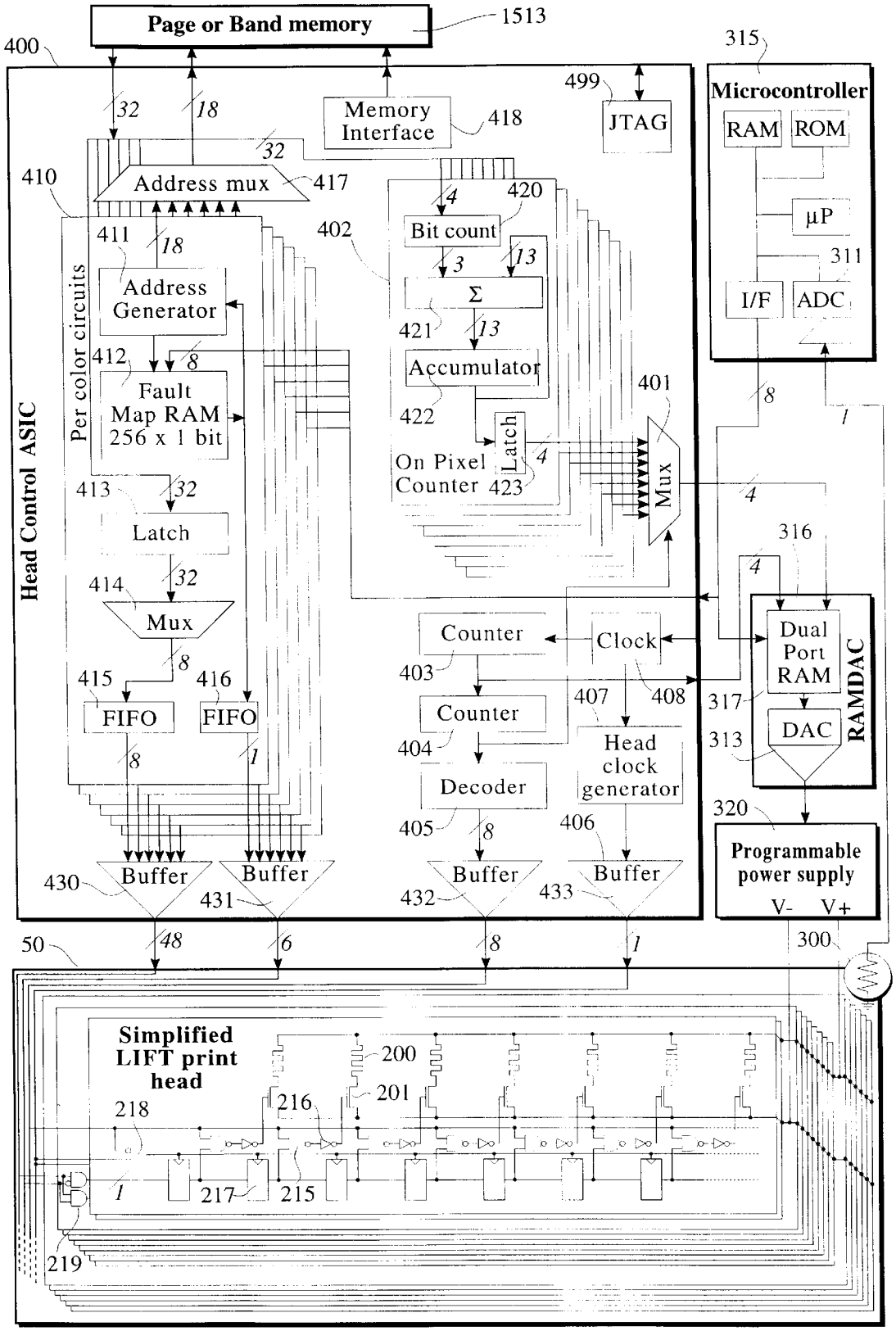
FIG. 4 shows a block schematic diagram of print head drive circuitry for practice of the invention.

FIG. 4 is a block schematic diagram showing electronic operation of an example head driver circuit in accordance with this invention. This control circuit uses analog modulation of the power supply voltage applied to the print head to achieve heater power modulation, and does not have individual control of the power applied to each nozzle. FIG. 4 shows a block diagram for a system using an 800 dpi pagewidth print head which prints process color using the CC'MM'YK color model. The print head 50 has a total of 79,488 nozzles, with 39,744 main nozzles and 39,744 redundant nozzles. The main and redundant nozzles are divided into six colors, and each color is divided into 8 drive phases. Each drive phase has a shift register which converts the serial data from a head control ASIC 400 into parallel data for enabling heater drive circuits. There is a total of 96 shift registers, each providing data for 828 nozzles. Each shift register is composed of 828 shift register stages 217, the outputs of which are logically anded with phase enable signal by a nand gate 215. The output of the nand gate 215 drives an inverting buffer 216, which in turn controls the drive transistor 201. The drive transistor 201 actuates the electrothermal heater 200, which may be a heater 103 as shown in FIG. 1(*b*). To maintain the shifted data valid during the enable pulse, the clock to the shift register is stopped the enable pulse is active by a clock stopper 218, which is shown as a single gate for clarity, but is preferably any of a range of well known glitch free clock control circuits. Stopping the clock of the shift register removes the requirement for a parallel data latch in the print head, but adds some complexity to the control circuits in the Head Control ASIC 400. Data is routed to either the main nozzles or the redundant nozzles by the data router 219 depending on the state of the appropriate signal of the fault status bus.

The print head shown in FIG. 4 is simplified, and does not show various means of improving manufacturing yield, such as block fault tolerance. Drive circuits for different configurations of print head can readily be derived from the apparatus disclosed herein.

Digital information representing patterns of dots to be printed on the recording medium is stored in the Page or Band memory 1513, which may be the same as the Image memory 72 in FIG. 1(*a*). Data in 32 bit words representing dots of one color is read from the Page or Band memory 1513 using addresses selected by the address mux 417 and control signals generated by the Memory Interface 418. These addresses are generated by Address generators 411, which forms part of the 'Per color circuits' 410, for which there is one for each of the six color components. The addresses are generated based on the positions of the nozzles in relation to the print medium. As the relative position of the nozzles may be different for different print heads, the Address generators 411 are preferably made programmable. The Address generators 411 normally generate the address corresponding to the position of the main nozzles. However, when faulty nozzles are present, locations of blocks of nozzles containing faults can be marked in the Fault Map RAM 412. The Fault Map RAM 412 is read as the page is printed. If the memory indicates a fault in the block of nozzles, the address is altered so that the Address generators 411 generate the address corresponding to the position of the redundant nozzles. Data read from the Page or Band memory 1513 is latched by the latch 413 and converted to four sequential bytes by the multiplexer 414. Timing of these bytes is adjusted to match that of data representing other colors by the FIFO 415. This data is then buffered by the buffer 430 to form the 48 bit main data bus to the print head 50. The data is buffered as the print head may be located a relatively long distance from the head control ASIC. Data from the Fault Map RAM 412 also forms the input to the FIFO 416. The timing of this data is matched to the data output of the FIFO 415, and buffered by the buffer 431 to form the fault status bus.

The programmable power supply 320 provides power for the head 50. The voltage of the power supply 320 is controlled by the DAC 313, which is part of a RAM and DAC combination (RAMDAC) 316. The RAMDAC 316 contains a dual port RAM 317. The contents of the dual port RAM 317 are programmed by the Microcontroller 315. Temperature is compensated by changing the contents of the dual port RAM 317. These values are calculated by the microcontroller 315 based on temperature sensed by a thermal sensor 300. The thermal sensor 300 signal connects to the Analog to Digital Converter (ADC) 311. The ADC 311 is preferably incorporated in the Microcontroller 315.

The Head Control ASIC 400 contains control circuits for thermal lag compensation and print density. Thermal lag compensation requires that the power supply voltage to the head 50 is a rapidly time-varying voltage which is synchronized with the enable pulse for the heater. This is achieved by programming the programmable power supply 320 to produce this voltage. An analog time varying programming voltage is produced by the DAC 313 based upon data read from the dual port RAM 317. The data is read according to an address produced by the counter 403. The counter 403 produces one complete cycle of addresses during the period of one enable pulse. This synchronization is ensured, as the counter 403 is clocked by the system clock 408, and the top count of the counter 403 is used to clock the enable counter 404. The count from the enable counter 404 is then decoded by the decoder 405 and buffered by the buffer 432 to produce the enable pulses for the head 50. The counter 403 may include a prescaler if the number of states in the count is less than the number of clock periods in one enable pulse. Sixteen voltage states are adequate to accurately compensate for the heater thermal lag. These sixteen states can be specified by using a four bit connection between the counter 403 and the dual port RAM 317. However, these sixteen states may not be linearly spaced in time. To allow non-linear timing of these states the counter 403 may also include a ROM or other device which causes the counter 403 to count in a non-linear fashion. Alternatively, fewer than sixteen states may be used.

For print density compensation, the printing density is detected by counting the number of pixels to which a drop is to be printed ('on' pixels) in each enable period. The 'on' pixels are counted by the On pixel counters 402. There is one On pixel counter 402 for each of the eight enable phases. The number of enable phases in a print head in accordance with the invention depend upon the specific design. Four, eight, and sixteen are convenient numbers, though there is no requirement that the number of enable phases is a power of two. The On Pixel Counters 402 can be composed of combinatorial logic pixel counters 420 which determine how many bits in a nibble of data are on. This number is then accumulated by the adder 421 and accumulator 422. A latch 423 holds the accumulated value valid for the duration of the enable pulse. The multiplexer 401 selects the output of the latch 423 which corresponds to the current enable phase, as determined by the enable counter 404. The output of the multiplexer 401 forms part of the address of the dual port RAM 317. An exact count of the number of 'on' pixels is not necessary, and the most significant four bits of this count are adequate.

Combining the four bits of thermal lag compensation address and the four bits of print density compensation address means that the dual port RAM 317 has an 8 bit address. This means that the dual port RAM 317 contains 256 numbers, which are in a two dimensional array. These two dimensions are time (for thermal lag compensation) and print density. A third dimension—temperature—can be included. As the ambient temperature of the head varies only slowly, the microcontroller 315 has sufficient time to calculate a matrix of 256 numbers compensating for thermal lag and print density at the current temperature. Periodically (for example, a few times a second), the microcontroller senses the current head temperature and calculates this matrix.

The clock to the print head 50 is generated from the system clock 408 by the Head clock generator 407, and buffered by the buffer 406. To facilitate testing of the Head control ASIC, JTAG test circuits 499 may be included.

Comparison with thermal ink jet technology

The table "Comparison between Thermal ink jet and Present Invention" compares the aspects of printing in accordance with the present invention with thermal ink jet printing technology.

A direct comparison is made between the present invention and thermal ink jet technology because both are drop on demand systems which operate using thermal actuators and liquid ink. Although they may appear similar, the two technologies operate on different principles.

Thermal ink jet printers use the following fundamental operating principle. A thermal impulse caused by electrical resistance heating results in the explosive formation of a bubble in liquid ink. Rapid and consistent bubble formation can be achieved by superheating the ink, so that sufficient heat is transferred to the ink before bubble nucleation is complete. For water based ink, ink temperatures of approximately 280° C. to 400° C. are required. The bubble formation causes a pressure wave which forces a drop of ink from the aperture with high velocity. The bubble then collapses, drawing ink from the ink reservoir to re-fill the nozzle. Thermal ink jet printing has been highly successful commercially due to the high nozzle packing density Thermal ink jet printers use the following and the use of well established integrated circuit manufacturing techniques. However, thermal ink jet printing technology faces significant technical problems including multi-part precision fabrication, device yield, image resolution, 'pepper' noise, printing speed, drive transistor power, waste power dissipation, satellite drop formation, thermal stress, differential thermal expansion, kogation, cavitation, rectified diffusion, and difficulties in ink formulation.

Printing in accordance with the present invention has many of the advantages of thermal ink jet printing, and completely or substantially eliminates many of the inherent problems of thermal ink jet technology.

Comparison between Thermal ink jet and Present Invention

| | Thermal Ink-Jet | Present Invention |
|---|---|---|
| Drop selection mechanism | Drop ejected by pressure wave caused by thermally induced bubble | Choice of surface tension or viscosity reduction mechanisms |
| Drop separation mechanism | Same as drop selection mechanism | Choice of proximity, electrostatic, magnetic, and other methods |
| Basic ink carrier | Water | Water, microemulsion, alcohol, glycol, or hot melt |
| Head construction | Precision assembly of nozzle plate, ink channel, and substrate | Monolithic |
| Per copy printing cost | Very high due to limited print head life and expensive inks | Can be low due to permanent print heads and wide range of possible inks |
| Satellite drop formation | Significant problem which degrades image quality | No satellite drop formation |
| Operating ink temperature | 280° C. to 400° C. (high temperature limits dye use and ink formulation) | Approx. 70° C. (depends upon ink formulation) |
| Peak heater temperature | 400° C. to 1,000° C. (high temperature reduces device life) | Approx. 130° C. |
| Cavitation (heater erosion by bubble collapse) | Serious problem limiting head life | None (no bubbles are formed) |
| Kogation (coating of heater by ink ash) | Serious problem limiting head life and ink formulation | None (water based ink temperature does not exceed 100° C.) |
| Rectified diffusion (formation of ink bubbles due to pressure cycles) | Serious problem limiting ink formulation | Does not occur as the ink pressure does not go negative |
| Resonance | Serious problem limiting nozzle design and repetition rate | Very small effect as pressure waves are small |
| Practical resolution | Approx. 800 dpi max. | Approx. 1,600 dpi max. |
| Self-cooling operation | No (high energy required) | Yes: printed ink carries away drop selection energy |
| Drop ejection velocity | High (approx. 10 m/sec) | Low (approx. 1 m/sec) |
| Crosstalk | Serious problem requiring careful acoustic design, which limits nozzle refill rate. | Low velocities and pressures associated with drop ejection make cross-talk very small. |
| Operating thermal stress | Serious problem limiting print-head life. | Low: maximum temperature increase approx. 90° C. at center of heater. |
| Manufacturing thermal stress | Serious problem limiting print-head size. | Same as standard CMOS manufacturing process. |
| Drop selection energy | Approx. 20 μJ | Approx. 270 nJ |
| Heater pulse | Approx. 2–3 μs | Approx. 15–30 μs |

-continued

Comparison between Thermal ink jet and Present Invention

| | Thermal Ink-Jet | Present Invention |
|---|---|---|
| period | | |
| Average heater pulse power | Approx. 8 Watts per heater. | Approx. 12 mW per heater. This is more than 500 times less than Thermal Ink-Jet. |
| Heater pulse voltage | Typically approx. 40 V. | Approx. 5 to 10 V. |
| Heater peak pulse current | Typically approx. 200 mA per heater. This requires bipolar or very large MOS drive transistors. | Approx. 4 mA per heater. This allows the use of small MOS drive transistors. |
| Fault tolerance | Not implemented. Not practical for edge shooter type. | Simple implementation results in better yield and reliability |
| Constraints on ink composition | Many constraints including kogation, nucleation, etc. | Temperature coefficient of surface tension or viscosity must be negative. |
| Ink pressure | Atmospheric pressure or less | Approx. 1.1 atm |
| Integrated drive circuitry | Bipolar circuitry usually required due to high drive current | CMOS, nMOS, or bipolar |
| Differential thermal expansion | Significant problem for large print heads | Monolithic construction reduces problem |
| Pagewidth print heads | Major problems with yield, cost, precision construction, head life, and power dissipation | High yield, low cost and long life due to fault tolerance. Self cooling due to low power dissipation. |

Yield and Fault Tolerance

In most cases, monolithic integrated circuits cannot be repaired if they are not completely functional when manufactured. The percentage of operational devices which are produced from a wafer run is known as the yield. Yield has a direct influence on manufacturing cost. A device with a yield of 5% is effectively ten times more expensive to manufacture than an identical device with a yield of 50%.

There are three major yield measurements:

1) Fab yield
2) Wafer sort yield
3) Final test yield

For large die, it is typically the wafer sort yield which is the most serious limitation on total yield. Full pagewidth color heads in accordance with this invention are very large in comparison with typical VLSI circuits. Good wafer sort yield is critical to the cost-effective manufacture of such heads.

Figure 5:
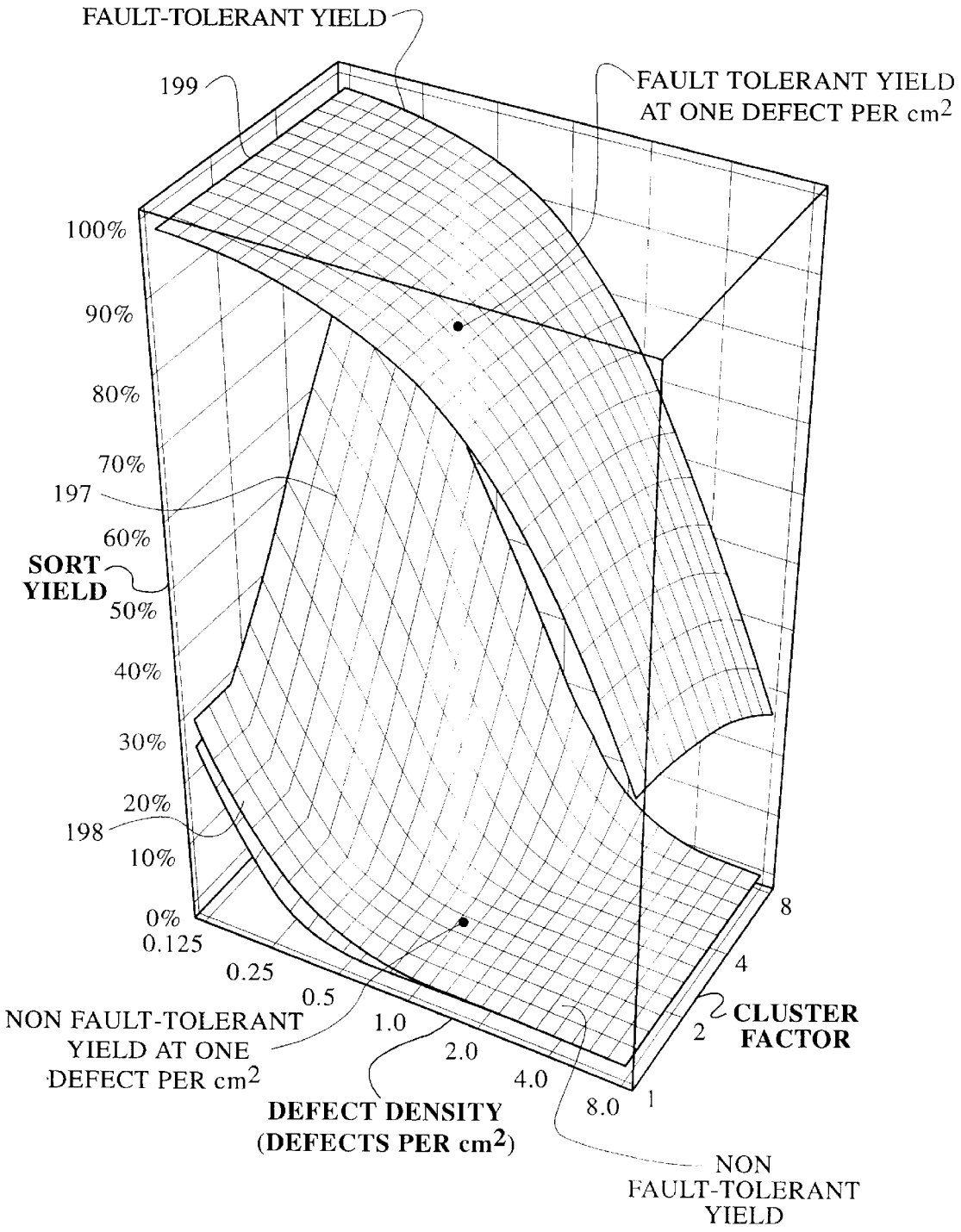
FIG. 5 shows projected manufacturing yields for an A4 page width color print head embodying features of the invention, with and without fault tolerance.

FIG. 5 is a graph of wafer sort yield versus defect density for a monolithic full width color A4 head embodiment of the invention. The head is 215 mm long by 5 mm wide. The non fault tolerant yield 198 is calculated according to Murphy's method, which is a widely used yield prediction method. With a defect density of one defect per square cm, Murphy's method predicts a yield less than 1%. This means that more than 99% of heads fabricated would have to be discarded. This low yield is highly undesirable, as the print head manufacturing cost becomes unacceptably high.

Murphy's method approximates the effect of an uneven distribution of defects. FIG. 5 also includes a graph of non fault tolerant yield 197 which explicitly models the clustering of defects by introducing a defect clustering factor. The defect clustering factor is not a controllable parameter in manufacturing, but is a characteristic of the manufacturing process. The defect clustering factor for manufacturing processes can be expected to be approximately 2, in which case yield projections closely match Murphy's method.

A solution to the problem of low yield is to incorporate fault tolerance by including redundant functional units on the chip which are used to replace faulty functional units.

In memory chips and most Wafer Scale Integration (WSI) devices, the physical location of redundant sub-units on the chip is not important. However, in printing heads the redundant sub-unit may contain one or more printing actuators. These must have a fixed spatial relationship to the page being printed. To be able to print a dot in the same position as a faulty actuator, redundant actuators must not be displaced in the non-scan direction. However, faulty actuators can be replaced with redundant actuators which are displaced in the scan direction. To ensure that the redundant actuator prints the dot in the same position as the faulty actuator, the data timing to the redundant actuator can be altered to compensate for the displacement in the scan direction.

To allow replacement of all nozzles, there must be a complete set of spare nozzles, which results in 100% redundancy. The requirement for 100% redundancy would normally more than double the chip area, dramatically reducing the primary yield before substituting redundant units, and thus eliminating most of the advantages of fault tolerance.

However, with print head embodiments according to this invention, the minimum physical dimensions of the head chip are determined by the width of the page being printed, the fragility of the head chip, and manufacturing constraints on fabrication of ink channels which supply ink to the back surface of the chip. The minimum practical size for a full width, full color head for printing A4 size paper is approximately 215 mm×5 mm. This size allows the inclusion of 100% redundancy without significantly increasing chip area, when using 1.5 $\mu$m CMOS fabrication technology. Therefore, a high level of fault tolerance can be included without significantly decreasing primary yield.

When fault tolerance is included in a device, standard yield equations cannot be used. Instead, the mechanisms and degree of fault tolerance must be specifically analyzed and included in the yield equation. FIG. 5 shows the fault tolerant sort yield 199 for a full width color A4 head which includes various forms of fault tolerance, the modeling of which has been included in the yield equation. This graph shows projected yield as a function of both defect density and defect clustering. The yield projection shown in FIG. 5 indicates that thoroughly implemented fault tolerance can increase wafer sort yield from under 1% to more than 90% under identical manufacturing conditions. This can reduce the manufacturing cost by a factor of 100.

Fault tolerance is highly recommended to improve yield and reliability of print heads containing thousands of printing nozzles, and thereby make pagewidth printing heads practical. However, fault tolerance is not to be taken as an essential part of the present invention.

Fault tolerance in drop-on-demand printing systems is described in the following Australian patent specifications filed on 12 Apr. 1995, the disclosure of which are hereby incorporated by reference:

- 'Integrated fault tolerance in printing mechanisms' (Filing no.: PN2324);
- 'Block fault tolerance in integrated printing heads' (Filing no.: PN2325);
- 'Nozzle duplication for fault tolerance in integrated printing heads' (Filing no.: PN2326);
- 'Detection of faulty nozzles in printing heads' (Filing no.: PN2327); and
- 'Fault tolerance in high volume LIFT printing presses' (Filing no.: PN2328).

Printing System Embodiments

Figure 6:
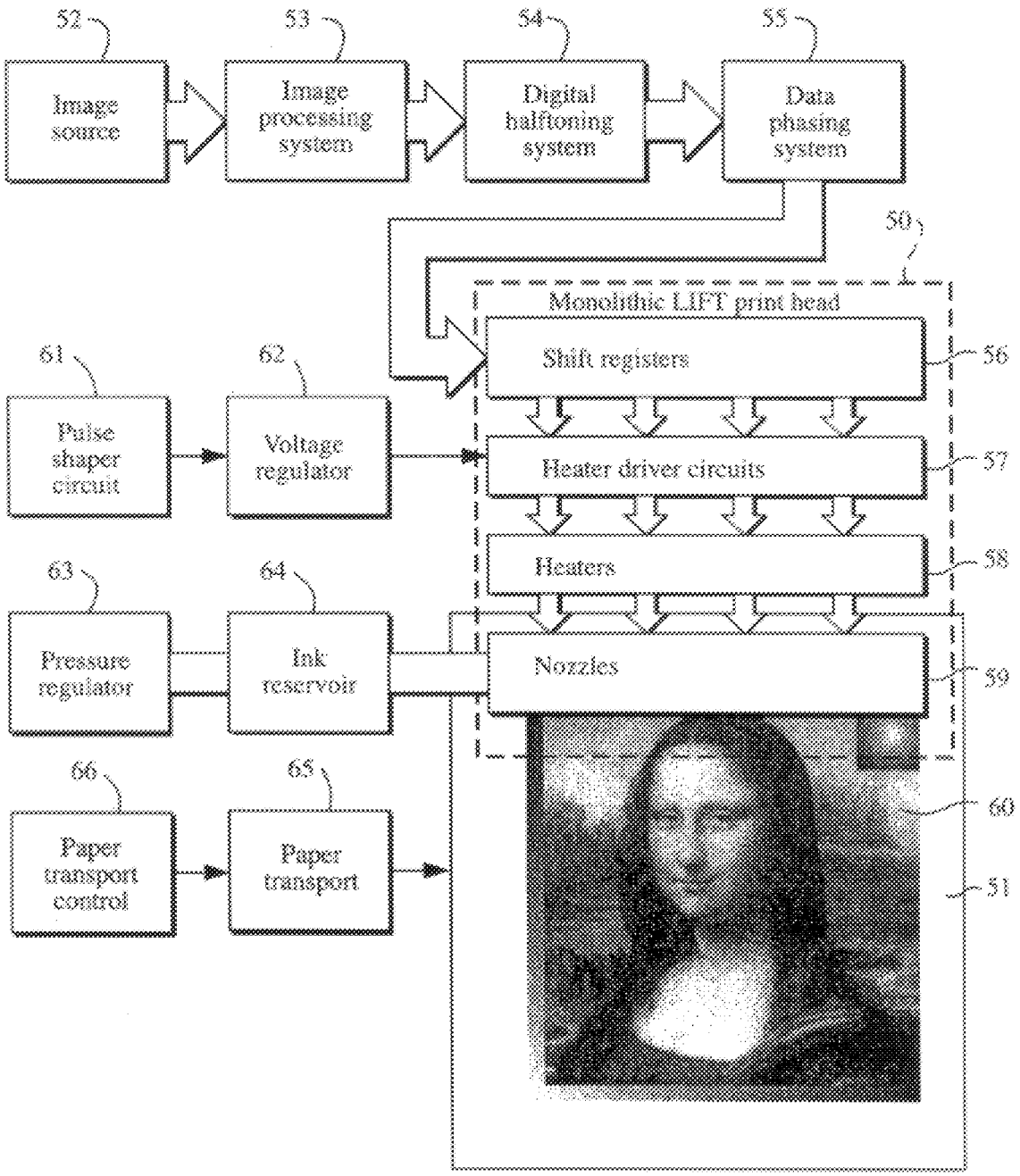
FIG. 6 shows a generalized block diagram of a printing system using a print head

A schematic diagram of a digital electronic printing system using a print head of this invention is shown in FIG. 6. This shows a monolithic printing head 50 printing an image 60 composed of a multitude of ink drops onto a recording medium 51. This medium will typically be paper, but can also be overhead transparency film, cloth, or many other substantially flat surfaces which will accept ink drops. The image to be printed is provided by an image source 52, which may be any image type which can be converted into a two dimensional array of pixels. Typical image sources are image scanners, digitally stored images, images encoded in a page description language (PDL) such as Adobe Postscript, Adobe Postscript level 2, or Hewlett-Packard PCL 5, page images generated by a procedure-call based rasterizer, such as Apple QuickDraw, Apple Quickdraw GX, or Microsoft GDI, or text in an electronic form such as ASCII. This image data is then converted by an image processing system 53 into a two dimensional array of pixels suitable for the particular printing system. This may be color or monochrome, and the data will typically have between 1 and 32 bits per pixel, depending upon the image source and the specifications of the printing system. The image processing system may be a raster image processor (RIP) if the source image is a page description, or may be a two dimensional image processing system if the source image is from a scanner.

If continuous tone images are required, then a halftoning system 54 is necessary. Suitable types of halftoning are based on dispersed dot ordered dither or error diffusion. Variations of these, commonly known as stochastic screening or frequency modulation screening are suitable. The halftoning system commonly used for offset printing—clustered dot ordered dither—is not recommended, as effective image resolution is unnecessarily wasted using this technique. The output of the halftoning system is a binary monochrome or color image at the resolution of the printing system according to the present invention.

The binary image is processed by a data phasing circuit 55 (which may be incorporated in a Head Control ASIC 400 as shown in FIG. 4) which provides the pixel data in the correct sequence to the data shift registers 56. Data sequencing is required to compensate for the nozzle arrangement and the movement of the paper. When the data has been loaded into the shift registers 56, it is presented in parallel to the heater driver circuits 57. At the correct time, the driver circuits 57 will electronically connect the corresponding heaters 58 with the voltage pulse generated by the pulse shaper circuit 61 and the voltage regulator 62. The heaters 58 heat the tip of the nozzles 59, affecting the physical characteristics of the ink. Ink drops 60 escape from the nozzles in a pattern which corresponds to the digital impulses which have been applied to the heater driver circuits. The pressure of the ink in the ink reservoir 64 is regulated by the pressure regulator 63. Selected drops of ink drops 60 are separated from the body of ink by the chosen drop separation means, and contact the recording medium 51. During printing, the recording medium 51 is continually moved relative to the print head 50 by the paper transport system 65. If the print head 50 is the full width of the print region of the recording medium 51, it is only necessary to move the recording medium 51 in one direction, and the print head 50 can remain fixed. If a smaller print head 50 is used, it is necessary to implement a raster scan system. This is typically achieved by scanning the print head 50 along the short dimension of the recording medium 51, while moving the recording medium 51 along its long dimension.

Multiple nozzles in a single monolithic print head

It is desirable that a new printing system intended for use in equipment such as office printers or photocopiers is able to print quickly. A printing speed of 60 A4 pages per minute (one page per second) will generally be adequate for many applications. However, achieving an electronically controlled print speed of 60 pages per minute is not simple.

The minimum time taken to print a page is equal to the number of dot positions on the page times the time required to print a dot, divided by the number of dots of each color which can be printed simultaneously.

The image quality that can be obtained is affected by the total number of ink dots which can be used to create an image. For full color magazine quality printing using dispersed dot digital halftoning, approximately 800 dots per inch (31.5 dots per mm) are required. The spacing between dots on the paper is 31.75 $\mu$m.

A standard A4 page is 210 mm times 297 mm. At 31.5 dots per mm, 61,886,632 dots are required for a monochrome full bleed A4 page. High quality process color printing requires four colors—cyan, magenta, yellow, and black. Therefore, the total number of dots required is 247,546,528. While this can be reduced somewhat by not allowing printing in a small margin at the edge of the paper, the total number of dots required is still very large. If the time taken to print a dot is 144 ms, and only one nozzle per color is provided, then it will take more than two hours to print a single page.

To achieve high speed, high quality printing with my printing system described above, printing heads with many small nozzles are required. The printing of a 800 dpi color A4 page in one second can be achieved if the printing head is the full width of the paper. The printing head can be stationary, and the paper can travel past it in the one second period. A four color 800 dpi printing head 210 mm wide requires 26,460 nozzles.

Such a print head may contain 26,460 active nozzles, and 26,460 redundant (spare) nozzles, giving a total of 52,920 nozzles. There are 6,615 active nozzles for each of the cyan, magenta, yellow, and black process colors.

Print heads with large numbers of nozzles can be manufactured at low cost. This can be achieved by using semiconductor manufacturing processes to simultaneously fabricate many thousands of nozzles in a silicon wafer. To eliminate problems with mechanical alignment and differential thermal expansion that would occur if the print head were to be manufactured in several parts and assembled, the head can be manufactured from a single piece of silicon. Nozzles and ink channels are etched into the silicon. Heater elements are formed by evaporation of resistive materials, and subsequent photolithography using standard semiconductor manufacturing processes.

To reduce the large number of connections that would be required on a print head with thousands of nozzles, data distribution circuits and drive circuits can also be integrated on the print head.

Figure 7:
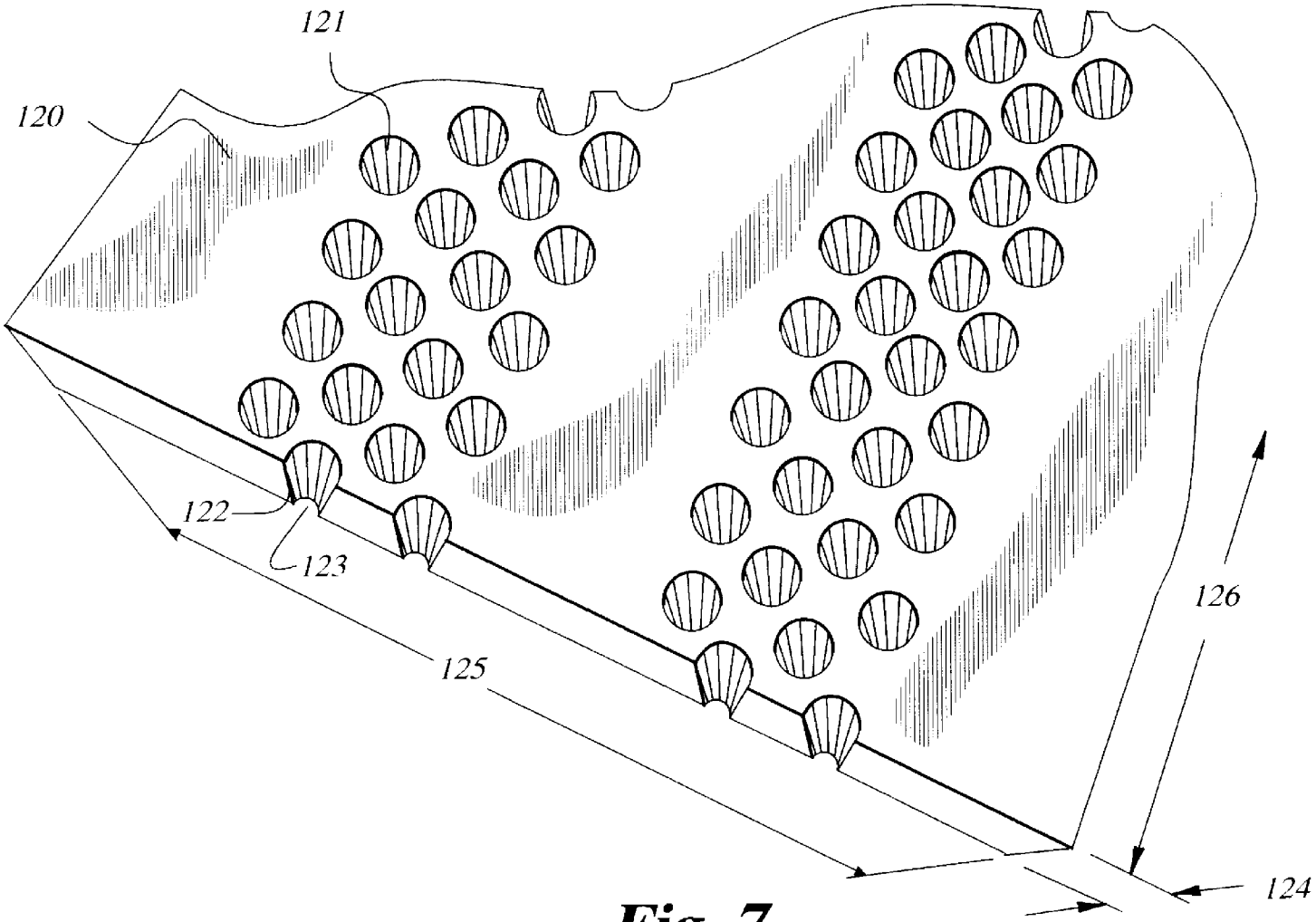
FIG. 7 shows a single silicon substrate with a multitude of nozzles etched in accordance with an embodiment of the invention.

FIG. 7 is a simplified view of a portion of a print head, seen from the back surface of the chip, and cut through some of the nozzles. The substrate 120 can be made from a single silicon crystal. Nozzles 121 are fabricated in the substrate, e.g., by semiconductor photolithography and chemical wet etch or plasma etching processes. Ink enters the nozzle at the top surface of the head, passes through the substrate, and leaves via the nozzle tip 123. Planar fabrication of the heaters and the drive circuitry is on the underside of the wafer; that is, the print head is shown 'upside down' in relation the surface upon which active circuitry is fabricated. The substrate thickness 124 can be that of a standard silicon wafer, approximately 650 $\mu$m. The head width 125 is related to the number of colors, the arrangement of nozzles, the spacing between the nozzles, and the head area required for drive circuitry and interconnections. For a monochrome head, an appropriate width would be approximately 2 mm. For a process color head, an appropriate width would be approximately 5 mm. For a CC'MM'YK color print head, the appropriate head width is approximately 8 mm. The length of the head 126 depends upon the application. Very low cost applications may use short heads, which must be scanned over a page. High speed applications can use fixed page-width monolithic or multi-chip print heads. A typical range of lengths for print heads is between 1 cm and 21 cm, though print heads longer than 21 cm are appropriate for high volume paper or fabric printing.

Print head manufacturing

The manufacture of monolithic printing heads for my above-described systems is similar to standard silicon integrated circuit manufacture. However, the normal process flow should be modified in several ways to form the nozzles, the barrels for the nozzles, the heaters, and the nozzle tips. There are many different semiconductor processes upon which monolithic print head production can be based. For each of these semiconductor processes, there are many different ways the basic process can be modified to form the necessary structures. To reduce the cost of establishing factories to produce such print heads, it is desirable to base the production on a simple process. It is also desirable to use a set of design rules which is as coarse as practical. This is because equipment to produce fine line widths is more expensive, and requires a cleaner environment to achieve equivalent yields.

The minimum length of a monolithic print head is determined by the width of the required printing capability. The minimum width of a monolithic print head is determined by the mechanical strength requirements, and by the ability to provide ink supply channels to the back of the silicon chip. As an example, the minimum size of a photograph type full width four color head is at least 100 mm long by approximately 5 mm wide. This gives an area of approximately 5 square cm. However, less than 300,000 transistors are required for the shift registers and drive circuitry. It is therefore not necessary to use recent lithographic equipment. The process described herein is based on standard semiconductor manufacturing processes, and can use equipment designed for 2 $\mu$m line widths. The use of lithographic equipment which is essentially obsolete (at the time of writing, the latest production IC manufacturing equipment is capable of 0.25 $\mu$m line widths) can substantially reduce the cost of establishing factories for the production of print heads.

It is also not necessary to use a low power, high speed process such as VLSI CMOS. The speeds required are moderate, and the power consumption is dominated by the heater power required for the ink jet nozzles. Therefore, a simple technology such as nMOS is adequate. However, CMOS is likely to be the most practical production solution, as there is a significant amount of idle CMOS manufacturing capability available with line widths between 1 $\mu$m and 2 $\mu$m Suitable basic manufacturing processes The manufacturing steps required for fabricating print head nozzles can be incorporated into many different semiconductor processing systems. For example, it is possible to manufacture print heads by modifying the following technologies:

1) nMOS
2) pMOS
3) CMOS
4) Bipolar
5) ECL
6) Various gallium arsenide processes
7) Thin Film Transistors (TFT) on glass substrates
8) Micromechanical fabrication without active semiconductor circuits The choice of the base technology is largely independent of the ability to fabricate nozzles. The method of incorporation of nozzle manufacturing steps into semiconductor processing procedures which have not yet been invented is also likely to be obvious to those skilled in the art. The simplest fabrication process is to manufacture the nozzles using silicon micromechanical processing, without fabricating active semiconductor devices on the same wafer. However, this approach is not practical for print heads with large numbers of nozzles, as at least one external connection to the print head is required for each nozzle. For large print heads, it is highly advantageous to fabricate drive transistors and data distribution circuits on the same chip as the nozzles.

CMOS is currently the most popular integrated circuit process. At present, many CMOS processes are in commercial use, with line widths as small as 0.35 $\mu$m being in common use. CMOS offers the following advantages for the fabrication of print heads:

1) Well known and well characterized production process.
2) Quiescent current is almost zero
3) High reliability
4) High noise immunity
5) Wide power supply operating range
6) Reduced electromigration in metal lines
7) Simpler circuit design of shift registers and fault tolerance logic
8) The substrate can be grounded from the front side of the wafer.

CMOS has, however, some disadvantages over nMOS and other technologies in the fabrication of print heads which include integrated drive circuitry. These include:

1) A large number of processing steps are required to simultaneously manufacture high quality NMOS and PMOS devices on the same chip.
2) CMOS is susceptible to latchup. This is of particular concern due to the high currents at a voltage typically greater than Vdd that are required for the heater circuits.
3) Like other MOS technologies, CMOS is susceptible to electrostatic discharge damage. This can be minimized by including protection circuits at the inputs, and by careful handling.

There is no absolute 'best' base manufacturing process which is applicable to all possible configurations of printing head for my above-described systems. Instead, the manufacturing steps which are specific to the nozzles should be incorporated into the manufacturer's preferred process. In most cases, there will need to be minor alterations to the specific details of nozzle manufacturing steps to be compatible with the existing process flow, equipment used, preferred photoresists, and preferred chemical processes. These modifications are obvious to those skilled in the art, and can be made without departing from the scope of the invention.

Heater design

High quality printing using print heads of my systems requires consistent size ink drops. To produce consistently sized ink drops, the nozzle diameter must be accurately controlled, as must the thickness, width and length of the heater. Of equal importance is the position of the heater in relation to the nozzle, and the thickness and thermal properties of the materials which isolate the heater from the ink. For best results, these characteristics of a high resolution print head should be controlled to better than 0.5 $\mu$m accuracy. This may be achieved by using modern production semiconductor lithographic equipment. However, use of the latest generation of semiconductor equipment is very expensive.

It is possible to produce the heater element of a monolithic printing nozzle configuration using a self-aligned process, where the thickness of the heater, the width of the heater, and the position of the heater in relation to the nozzle are all determined by deposition and etching steps, instead of lithographic processes. This allows high accuracy and small dimensions to be achieved even when using relatively coarse lithography. Using this method, much greater control of these parameters can be achieved than is generally possible with lithographic processes. Also no mask is required for the heater.

Layout example

Figure 8A:
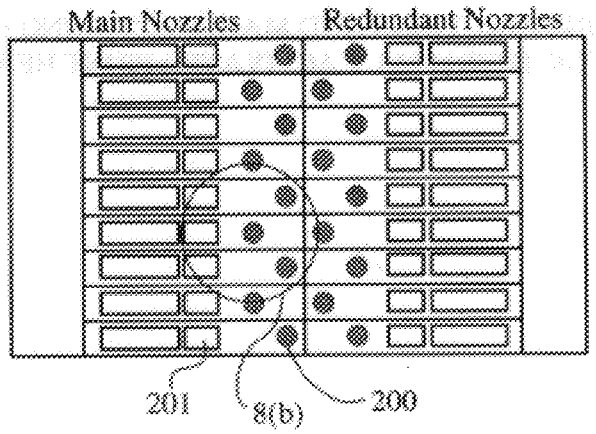
FIG. 8(*a*) shows one example of a layout of a small section of a print head in accordance with the invention.
Figure 8B:
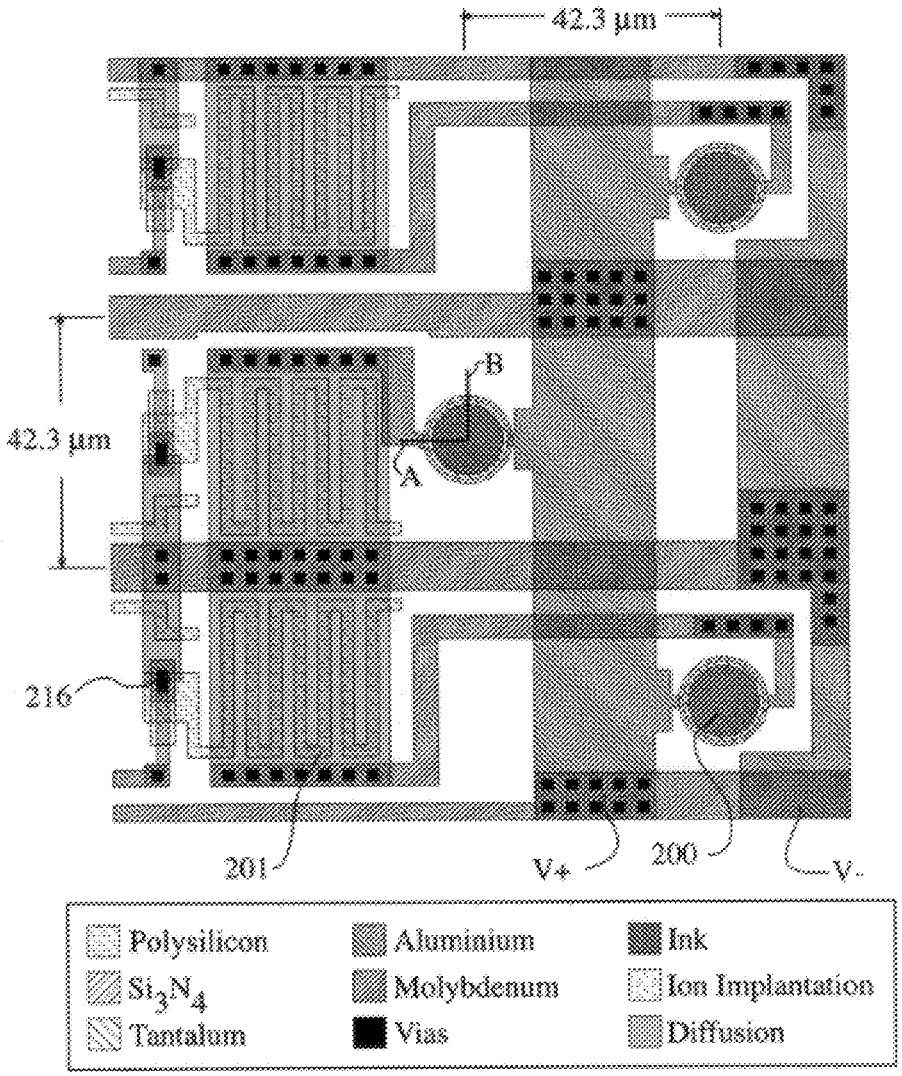
Figure 9C:
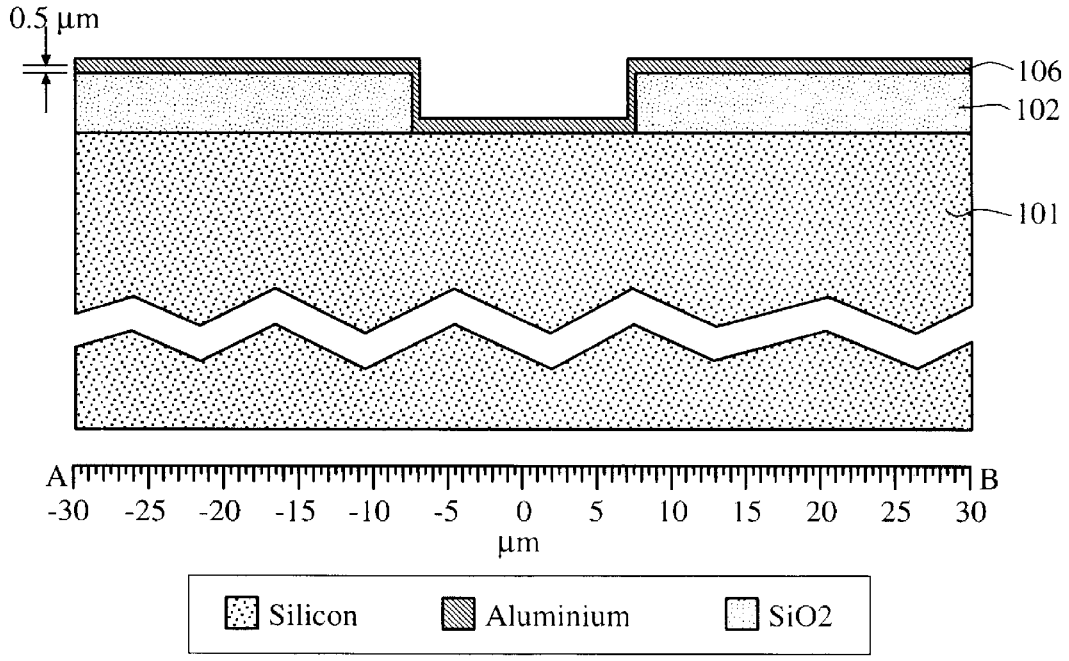
FIGS. 9(*a*) to 9(*r*) show simplified manufacturing steps for the processes added to a standard integrated circuit fabrication.
Figure 9D:
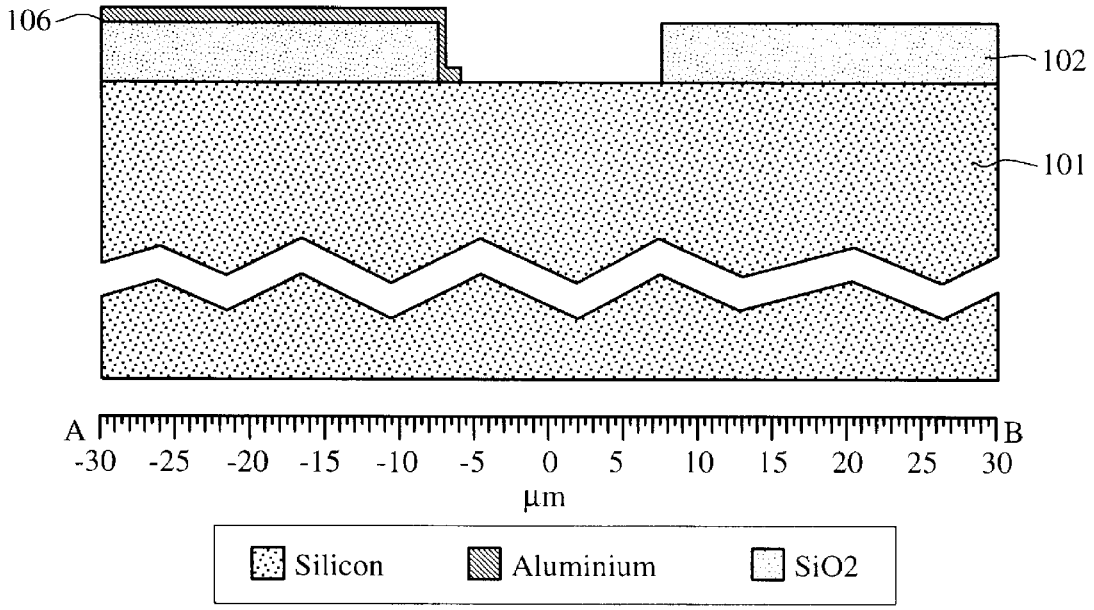
Figure 9E:
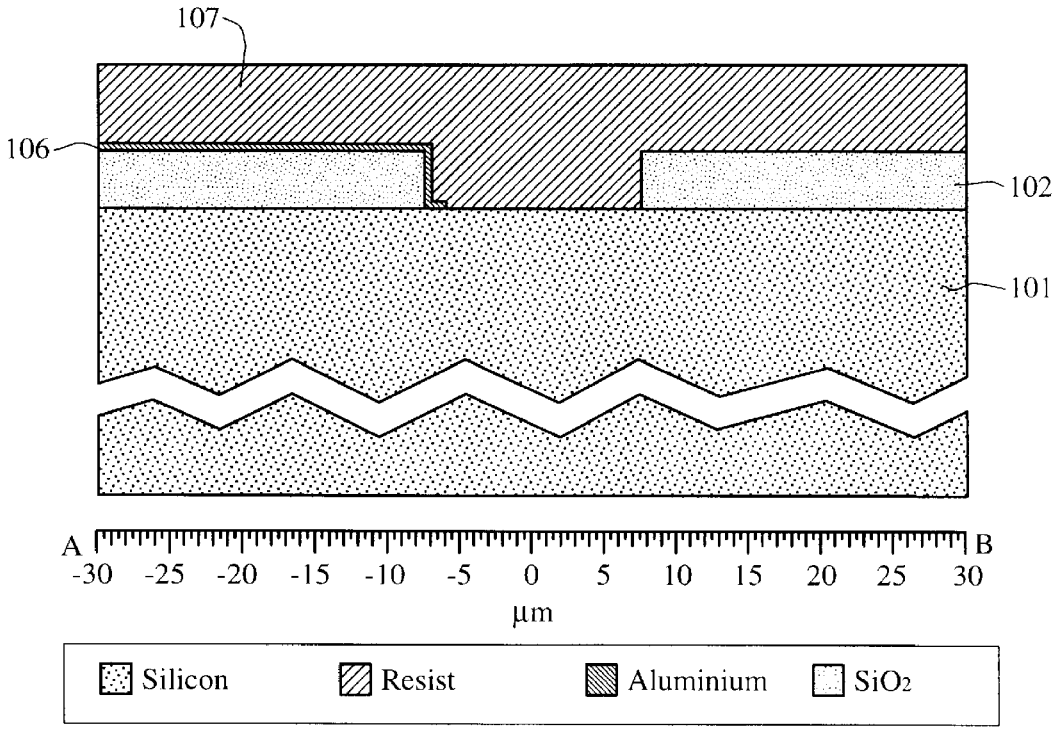
Figure 9F:
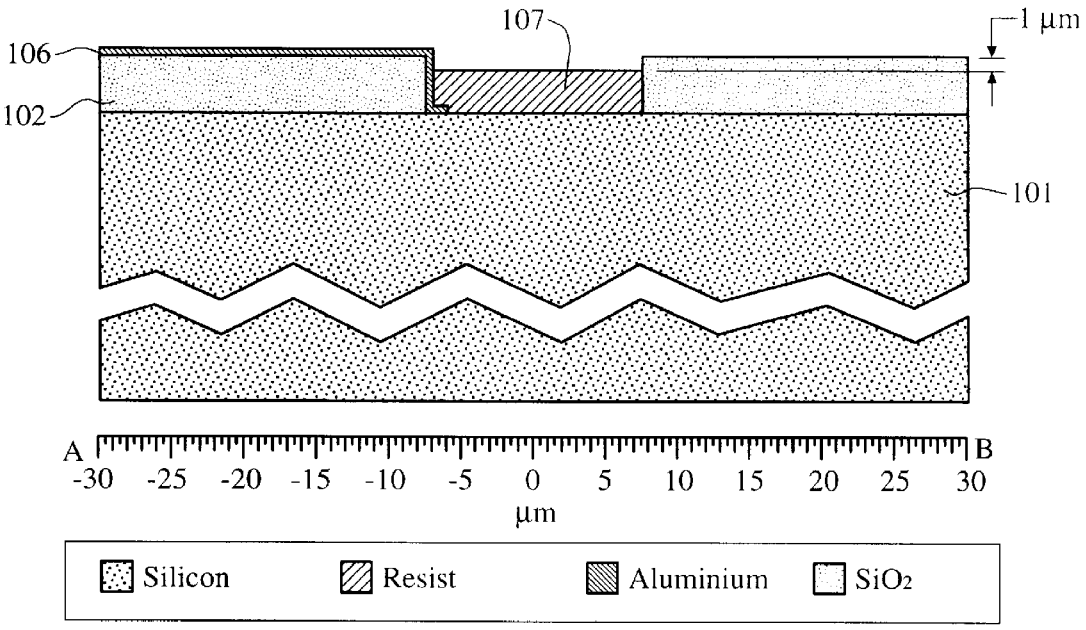
Figure 9G:
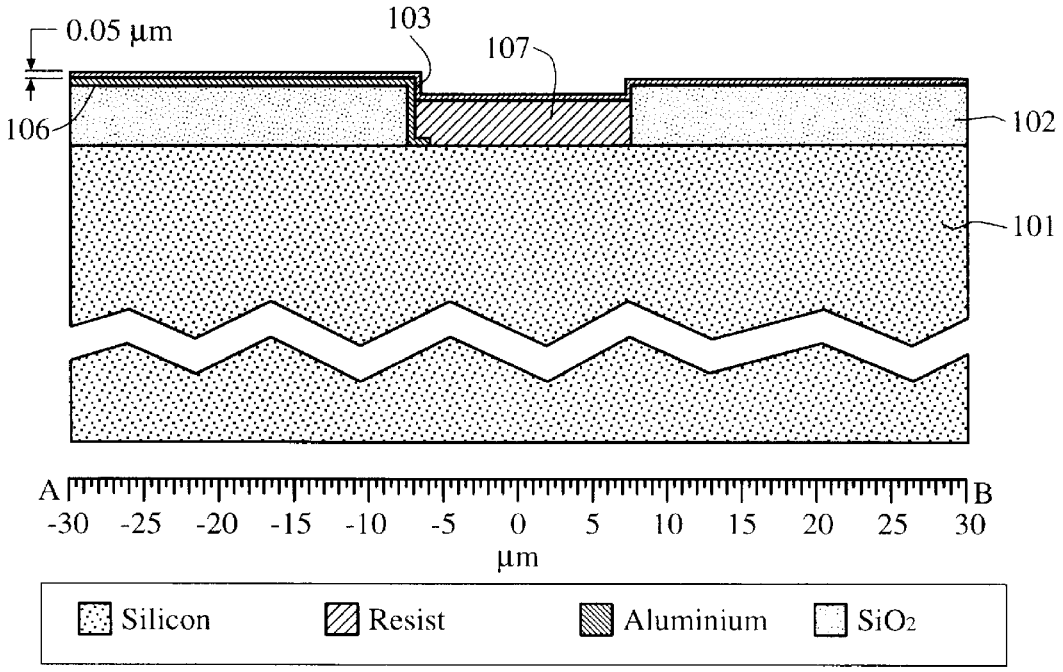
Figure 9H:
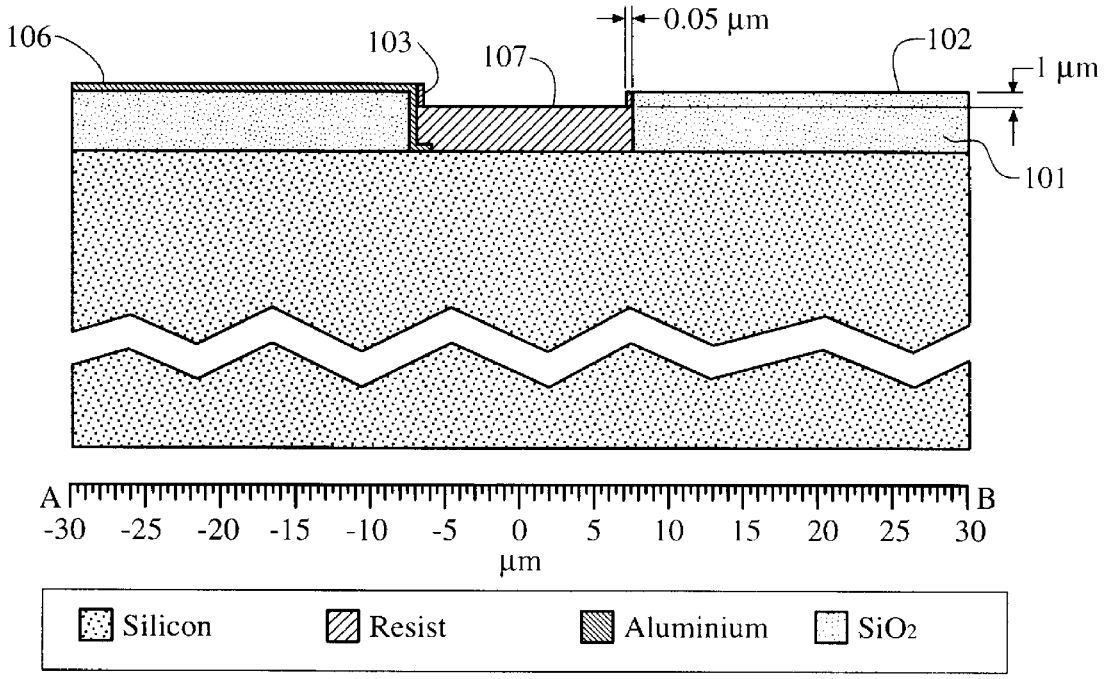
Figure 9I:
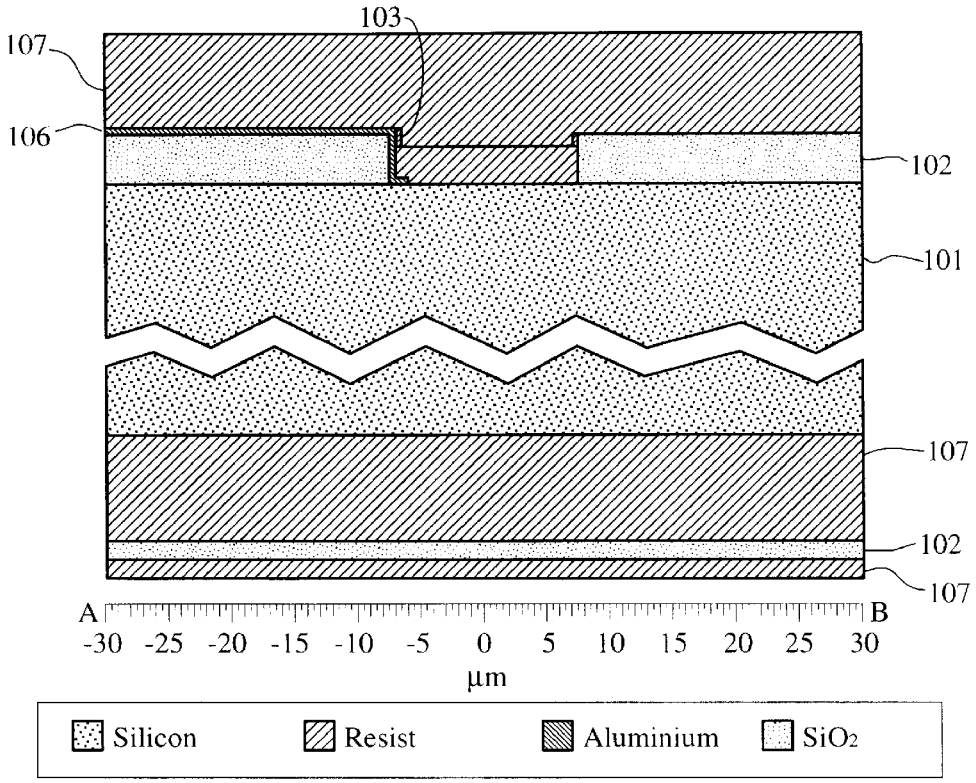
Figure 9J:
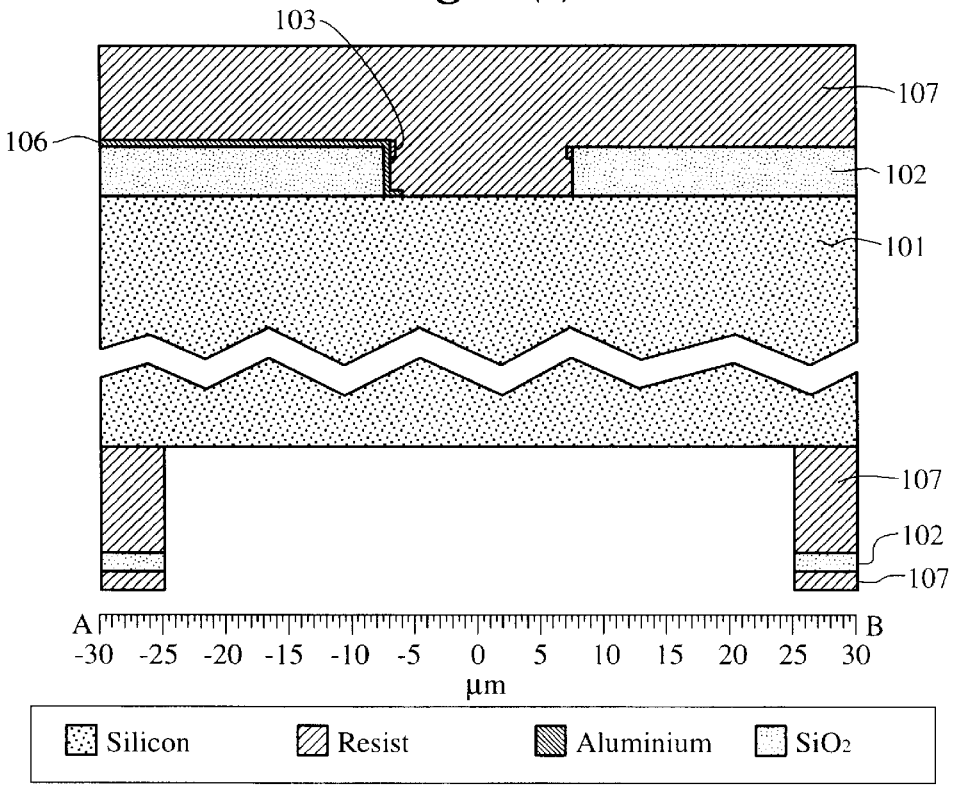
Figure 9K:
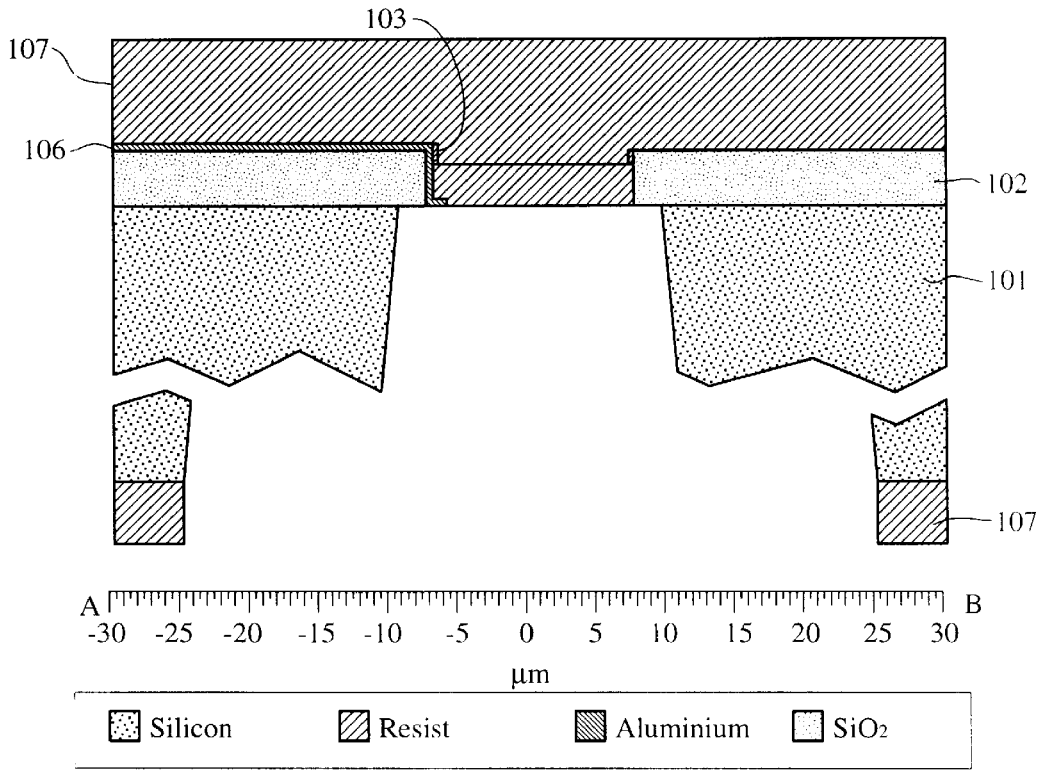
Figure 9L:
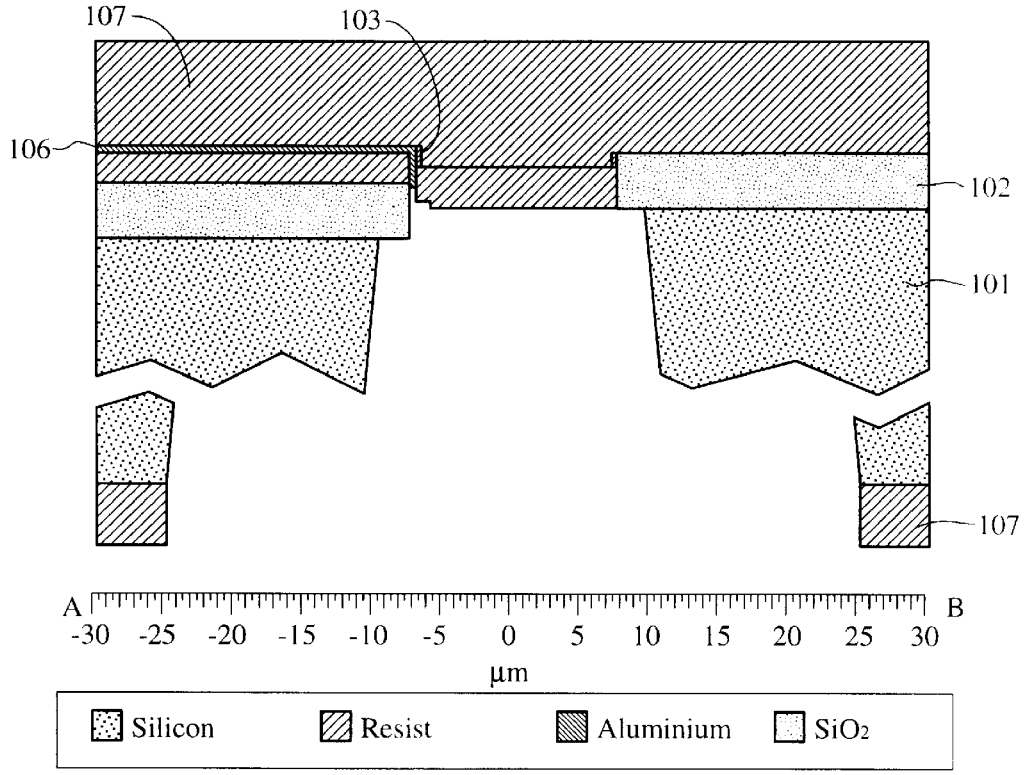
Figure 9M:
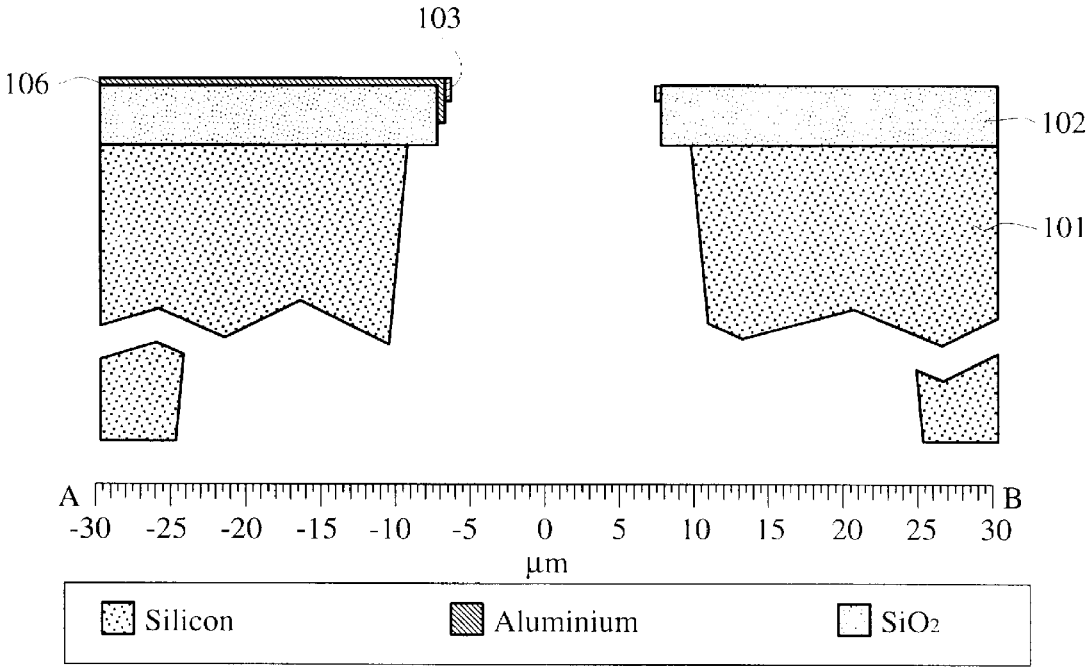
Figure 9N:
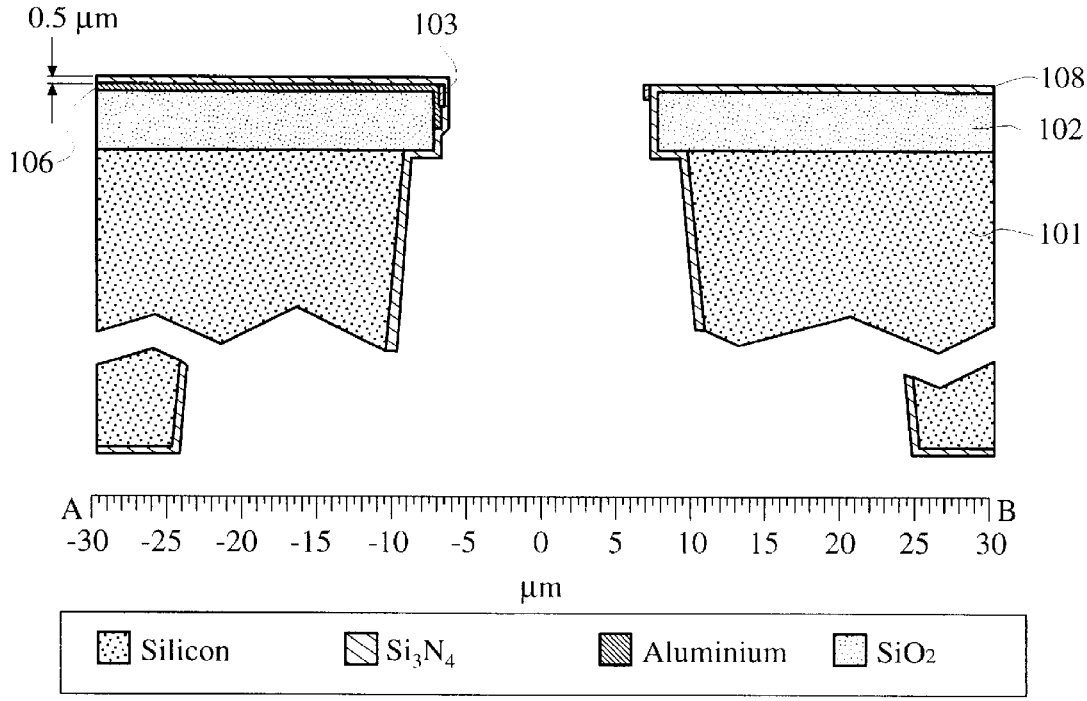
Figure 9O:
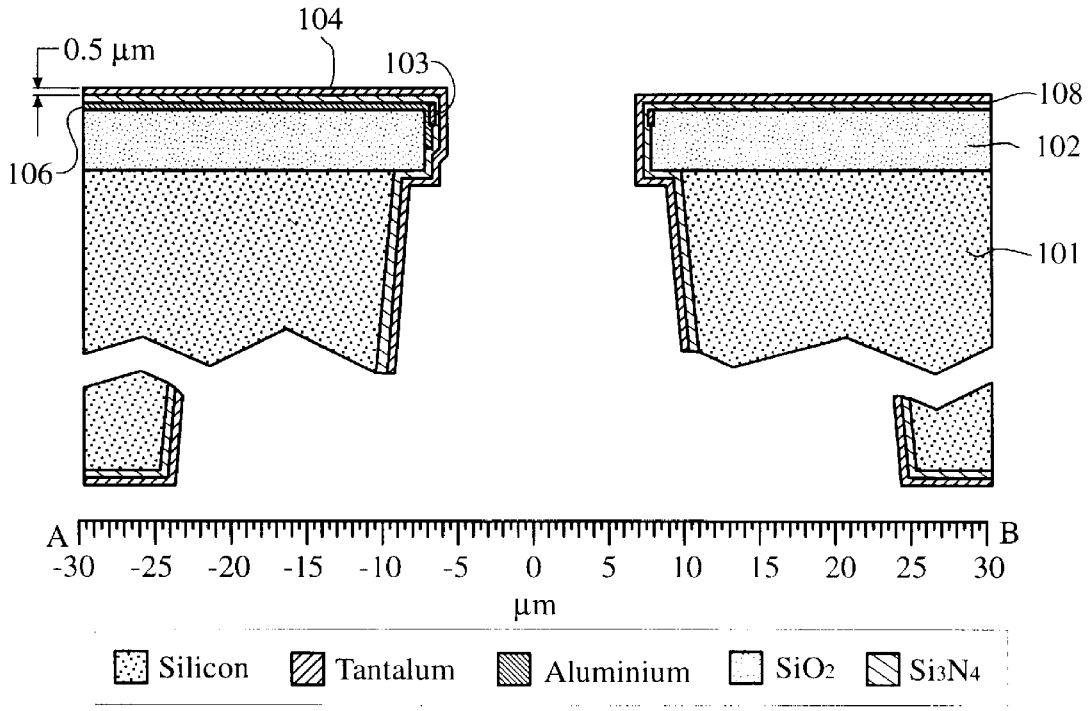
Figure 9P:
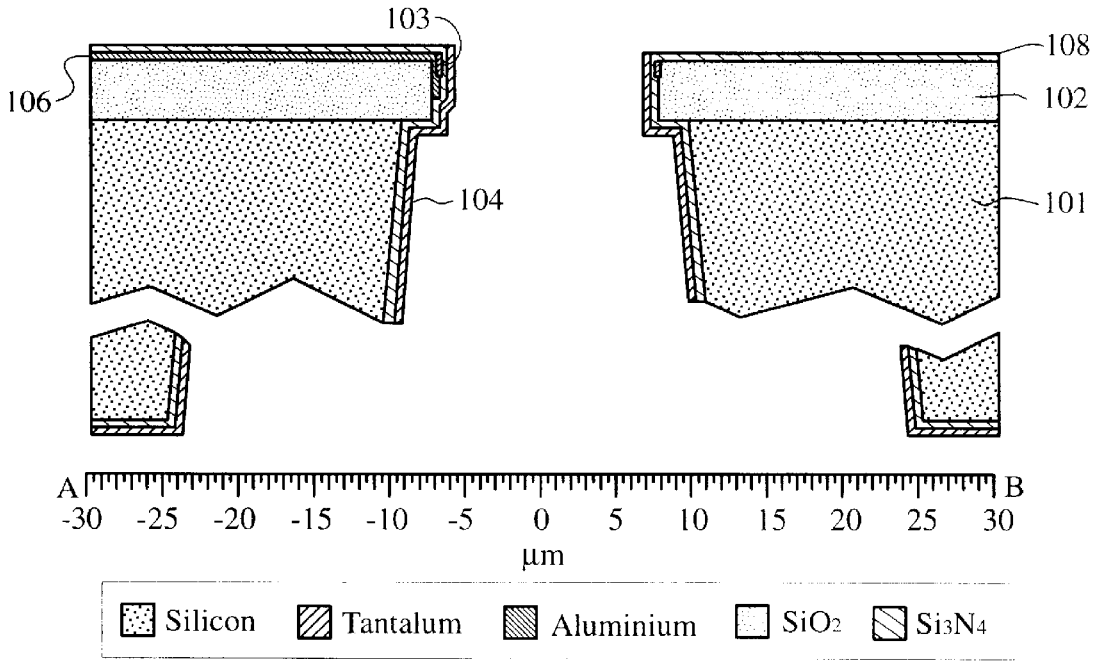
Figure 9Q:
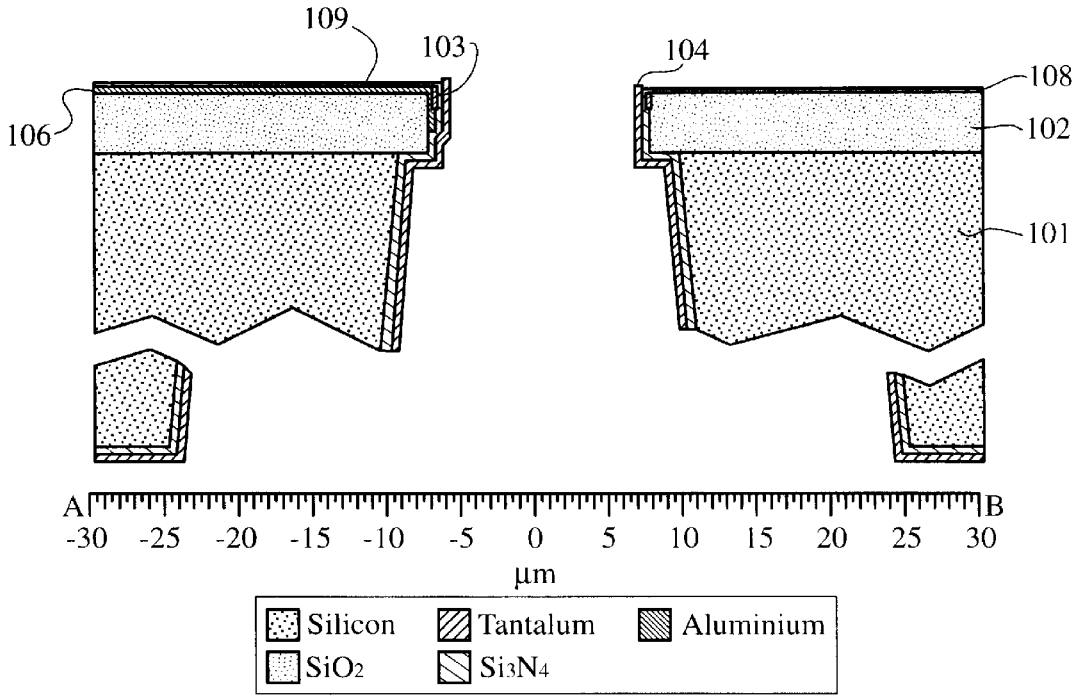
Figure 9R:
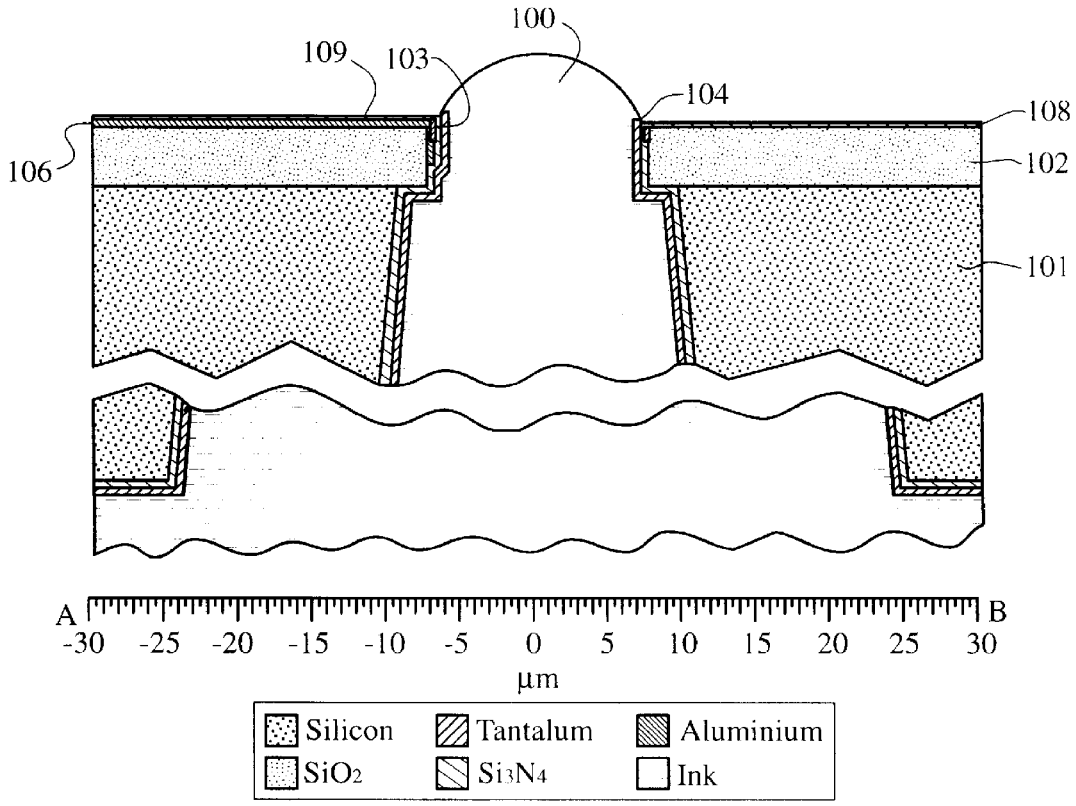

FIG. 8(*a*) shows an example layout for a small section of a print head. This shows two columns of nozzles. One of these columns contains the main printing nozzles. The other column contains the redundant nozzles for fault tolerance. The nozzle 200 and drive transistor 201 are shown.

FIG. 8(*b*) is a detail enlargement of a section of FIG. 8(*a*). The layout is for 2 micron nMOS, though little change is required for CMOS, as the drive transistor of a CMOS design would be fabricated as an nMOS transistor. The layout shows three nozzles 200, with their drive transistors 201 and inverting drivers 216. The three nozzles are in a staggered (zig-zag) pattern to increase the distance between the nozzles, and thereby increase the strength of the silicon wafer after the nozzles have been etched through the substrate. The large $V^+$ and $V^-$ currents are carried by a matrix of wide first and second level metal lines which covers the chip. The $V^+$ and $V^-$ terminals can extend along the entire two long edges of the chip.

The line from A to B in FIG. 8(*b*) is the line through which the cross section diagrams of FIG. 9(*a*) to FIG. 9(*r*) are taken. This line includes a heater connection on the "A" side, and goes through a 'normal' section of the heater on the "B" side.

Manufacturing process summary

A summary of the preferred manufacturing method is shown in FIG. 9(*a*) to FIG. 9(*r*). This consists of the following major steps:

1) The first manufacturing step is the delivery of the wafers. Silicon wafers are highly recommended over other materials such as gallium arsenide, due to the availability of large, high quality wafers at low cost, the strength of silicon as a substrate, and the general maturity of fabrication processes and equipment. The wafers must be manufactured with good thickness control. This is because holes must be etched all of the way through the wafer. Variations in wafer thickness will affect relative etch times. To ensure that holes in regions where the wafer is thicker are etched, holes in regions where the wafer is thin must be over-etched. Excessive over-etching will also substantially etch the glass in the heater region, changing the thermal characteristics of the nozzle. It is also possible that the heater element will be etched if the wafer is excessively over-etched. Actual thickness of the wafer is not critical, as the etching equipment can be automatically configured to detect waste gasses from the etching of silicon dioxide, and an etch stop can be programmed from this point. However, it is essential that the thickness variation of a particular wafer, and thickness variations between wafers in a batch which are to be simultaneously etched, are less than 5 μm. 150 mm wafers manufactured to standard Semiconductor Equipment and Materials Institute (SEMI) specifications allow 25 μm total thickness variation. 200 mm wafers manufactured to SEMI specifications allow 75 μm total thickness variation. In both cases, the thickness variation on an individual wafer must be reduced to less than 5 μm. The wafer thickness is here assumed to be 650 μm. The wafers should not be mechanically or laser gettered, as this will affect back surface etching processes. Oxygen gradient gettering can be used. FIG. 9(*a*) shows a cross section of the wafer in the region of a nozzle after this step. At the time of writing, 200 mm (8") wafers are in use, and international standards are being set for 300 mm (12") silicon wafers. 300 mm wafers are especially useful for manufacturing LIFT heads, as pagewidth A4 (also US letter) print heads can be fabricated as a single chip on these wafers.

2) Fabricate the active devices using a prior art integrated circuit fabrication process with double layer metal. The prior art process may be nMOS, pMOS, CMOS, Bipolar, or other process. In general, the active circuits can be fabricated using unmodified processes. However, some processes will need modification to allow for the large currents which may flow though a print head. As a large head may have in excess of 8 Amperes of current flowing through the heater circuits when fully energized, it is essential to prevent electromigration. Molybdenum should be used instead of aluminum for first level metal, as it is resistant to electromigration. Also, the metallization layers should also be thicker than the minimum normally required in a CMOS circuit. Also, the inter-metal dielectric should be increased in thickness. With a normal process this dielectric layer will be made of CVD $SiO_2$, approximately 1 μm thick. The dielectric layer should be increased to approximately 3 μm, for a total $SiO_2$ thickness in the nozzle region of 4 μm. The reason for this increase is for mechanical strength in the nozzle region, to increase thermal resistance to the substrate, and to prevent destruction of the heater while back-etching the nozzle chambers. The nozzle tip must be etched through the $SiO_2$ with high accuracy. For this processing step the lithographic resolution must be substantially better than 2 μm, as the nozzle diameter must not vary significantly. The nozzle tip should be etched with a highly anisotropic etch, for example an RIE etch using $CF_4$—$H_2$ gas mixture. The etch is down to molybdenum in the contact vias, and down to silicon in the nozzle region. If the etching process is sufficiently selective against molybdenum, the inter-level vias can be etched using the same processing step. However, as the $SiO_2$ thickness to be etched in the nozzle tip is approximately 1 μm thicker than over the first level metal, care must be taken when using the same mask to etch the nozzles and vias. FIG. 9(*b*) shows a cross section of the wafer in the region of a nozzle after this step.

3) Application of second level metal. As with the first level metal, electromigration must be taken into account. However, the difficulty of bonding to molybdenum thin films requires that molybdenum is not used for the second level metal where the bonding pads are located. Instead, this level can be formed from aluminum. Electromigration can be minimized by using large line-widths for all high current traces, and by using an aluminum alloy containing 2% copper. The step coverage of the second level metal is important, as the inter-level oxide is thicker than normal. Also, via tapering should not be used to improve step coverage, as this will also cause tapering of the nozzle tip. Alternatively, a separate mask and separate processing steps can be used to taper vias without affecting the nozzle tip. However, adequate step coverage is possible by using low pressure evaporation. Via step coverage can be improved by placing vias only to areas where the first level metal covers field oxide. At these points the thickness of the inter-metal oxide is less due to the previous planarization steps. The preferred process is the deposition by low pressure evaporation of 1 mm of 98% aluminum, 2% copper, with 0.5 μm coverage on sidewalls. FIG. 9(*c*) shows a cross section of the wafer in the region of a nozzle after this step.

4) Mask and etch second level metal. FIG. 9(*d*) shows a cross section of the wafer in the region of a nozzle after this step. This step can be performed with the same lithographic accuracy as the main process. The contacts to the heater can overlap the edge of the nozzle tip by several mm.

5) Application of a resist filler to define the heater width. In this example process, the heater is deposited on the sidewalls of the nozzle. This is to increase the thermal transfer between the heater and the ink by allowing only thin intermediate layers. The heater is self aligned to the nozzle tip, and the width of the heater is accurately controlled by the depth of RIE etching of the resist. This allows the heater parameters to be controlled to an accuracy beyond that achievable with 2 μm lithography. FIG. 9(*e*) shows a cross section of the wafer in the region of a nozzle after spin coating a thick layer of resist, and postbaking to planarize.

6) RIE etch the resist with $O_2$ to a level equal to the heater width (approximately 1 μm) below the surface of the CVD glass. No mask is required for this step. FIG. 9(*f*) shows a cross section of the wafer in the region of a nozzle after this step.

7) Form the heater. The heater is formed by applying a thin conformal film of heater material, and anisotropically etching that material. This leaves heater material remaining only on the vertical surfaces. The heater material (for example 0.05 μm of TaAl alloy, or refractory materials such as $HfB_2$ or $ZrB_2$) can be applied conformally by low pressure evaporation. FIG. 9(*g*) shows a cross section of the wafer in the region of a nozzle after this step.

8) Anisotropically etch the heater material. This can be achieved by a reactive ion beam etch (RIBE) of the heater material without using a mask. RIBE is used due to the very high selectivity of vertical directions over horizontal directions. At this stage, heater material will be left on all vertical surfaces. If the inter-metal oxide is sufficiently planarized, then the only unwanted heater material remaining should be on the sidewalls of the second level metal. Depending upon the details of the process used, it may be possible to leave this excess heater material in place with no ill effects. However, if planarization is insufficient or if the heater material cannot be left on the aluminum sidewalls for other reasons, then it must be removed. This can be achieved by masking the nozzle region (2 μm lithography is sufficient, as the mask can be oversized) and isotropically stripping all exposed heater material. FIG. 9(*h*) shows a cross section of the wafer in the region of a nozzle after this step.

9) Apply a thick resist to both sides of the wafer. The resist on the front side of the wafer is just to prevent handling damage or stray etching. The resist on the backface of the wafer should be a three level resist as the nozzle barrel is etched all of the way through the wafer. As the wafer is approximately 650 μm thick, this requires substantially more etching than is normally required in silicon processing. The selectivity of available etchants is typically no more than 25:1 of silicon over resist. This means that the resist layer must be at least 26 μm thick to avoid thinning the wafer. As some wafer thinning should not cause problems, the resist thickness can be approximately 25 μm. This thickness of resist cannot be accurately exposed using current lithography equipment. Therefore, a multilevel level resist should be used. A suitable process is a three level resist, using an inorganic intermediate resist level. The thickness of the first level resist is approximately ten times that commonly used in three level resists, so the intermediate oxide level must also be correspondingly thicker. Suitable processes are a spin-coat of 25 μm of optical novalak positive poly methyl methacrylate (PMMA) followed by spin coating 1 μm spin-on-glass (SOG) followed by spin coating of 0.5 μm of resist (soft and hardbaking cycles are, of course, also required). FIG. 9(*i*) shows a cross section of the wafer in the region of a nozzle after this step (resist thicknesses not shown to scale).

10) Expose and develop the resist on the back surface of the wafer using a mask of the nozzle barrels Alignment is taken from the front surface of the wafer by specially modifying the alignment optics of the lithography equipment. RIE etch the $SiO_2$ with $CF_4O_2$ using the second level resist as a mask. Oxygen RIE etch the first resist level using the $SiO_2$ as a mask. FIG. 9(*j*) shows a cross section of the wafer in the region of a nozzle after this step.

11) Etch the nozzle barrel. This stage is critical, as a full 650 μm must be etched. Several factors must be accurately controlled. The relative etch rates over the entire wafer must be tightly controlled to prevent excessive etching of the back surface of the nozzle tip. If the etch rate is controlled to be within 2% over the entire wafer, when the fastest etching portions are etched the slowest will still have 13 μm of silicon remaining to etch. When this is combined with 5 μm variation in wafer thickness, the variation is 18 μm. This variation can be compensated by an overetch of 20 μm from first detection of end stop conditions. If the etchant used has a selectivity of 20:1 of silicon over $SiO_2$, then the undersurface of the $SiO_2$ will be etched 1 μm. This is within the design constraints of the process. It is also essential that the sidewalls of the barrel are substantially vertical. The required radius of the nozzle at the nozzle tip is approximately 7 μm. The radius of the nozzle barrels must be less than 29 μm or they will coalesce, making the design of a mask with properly defined nozzle formations impossible. This means that the etch angle must be no greater than 1.9 degrees (this is calculated as arctan ((29 μm–7 μm)/650 μm)). The etch angle strongly affects the size of the unexposed regions on the backface mask. This design has considerable tolerance of etch angle and backface mask accuracy, as the alignment and diameter of the barrel at the nozzle tip is not critical. However, if the barrel is narrower than the nozzle tip, ink may not flow from the barrel to the nozzle tip. If the barrel is too wide, the strength of the silicon wafer may be compromised. FIG. 9(*k*) shows a cross section of the wafer in the region of a nozzle after this step.

12) Isotropic RIE etch of all exposed molybdenum to a depth of 1 μm. This eliminates the residual metal in the bottom of the nozzle tip. If this is not removed, there is some chance that a short circuit may occur between the molybdenum heater contacts and the tantalum passivation layer. If this possibility is eliminated by other means, then this step is not required. FIG. 9(*l*) shows a cross section of the wafer in the region of a nozzle after this step.

13) Strip the resist. FIG. 9(*m*) shows a cross section of the wafer in the region of a nozzle after this step.

14) Form the insulation and passivation layers. As the monolithic head is in contact with heated water based ink during operation, effective passivation is essential. A desirable passivation layer is tantalum, which forms an extremely durable thin layer of $Ta_2O_5$ which rapidly re-establishes itself in the event of surface damage. However, tantalum is electrically conductive. This means that the circuit must be electrically insulated from the passivation layer. This can be achieved by a layer of $SiO_2$ or other electrical non-conductor. However, thermal coupling between the heater and the ink is best when the thermal conductivity of the passivation layers is high, and the specific heat capacity is low. The thermal conductivity of tantalum is high. However, the thermal conductivity of amorphous $SiO_2$ (glass) is low. A practical material for present use is silicon nitride. While the thermal conductivity is not as good as other non-conducting materials such as diamond or silicon carbide, passivation qualities are excellent, and the material is well known for semiconductor manufacturing. The 0.5 μm conformal layer of $Si_3N_4$ can be applied by PECVD. Use $SH_4$ at 200 sccm and $NH_3$ at 2000 sccm, pressure of 1.6 torr, temperature of 250° C., at 46 watts for 50 minutes. FIG. 9(*n*) shows a cross section of the wafer in the region of a nozzle after this step.

15) The 0.5 μm conformal layer of tantalum can be deposited using low pressure chemical vapor deposition (LPCVD). FIG. 9(*o*) shows a cross section of the wafer in the region of a nozzle after this step.

16) Form the drop overflow control. To accurately control the drop dimensions, the effective thickness of the nozzle wall must be very small. A thin 'rim' of tantalum can be fabricated at the nozzle tip by removing the front surface (i.e. the surface from which the drops are ejected, which is normally not in contact with the ink) of the tantalum. Then a small amount of $Si_3N_4$ is also removed, leaving the tantalum passivation layer on the inside of the nozzle protruding. The tantalum is anisotropically etched from the front surface of the wafer, leaving tantalum on all surfaces except the front surface. FIG. 9(*p*) shows a cross section of the wafer in the region of a nozzle after this step.

17) Isotropically etch the $Si_3N_4$. This can be achieved by a wet etch using buffered HF at 25° C. for 0.25 μm (approximately 4 minutes). A hydrophobic surface coating may be applied at this stage, if the coating chosen can survive the subsequent processing steps. Otherwise, the hydrophobic coating should be applied after TAB bonding. There are many hydrophobic coatings which may be used, and many methods which may be used to apply them. By way of illustration, one such suitable coating is fluorinated diamond-like carbon (F*DLC), an amorphous carbon film with the outer surface substantially saturated with fluorine. A method of applying such a film using plasma enhanced chemical vapor deposition (PECVD) equipment is described in U.S. Pat. No. 5,073,785. It is not essential to apply a separate hydrophobic layer. Instead, the exposed dielectric layer can be treated with a hydrophobizing agent. For example, if $SiO_2$ is used as the insulation layer in place of $Si_3N_4$, the device can be treated with dimethyldichlorosilane to make the exposed $SiO_2$ hydrophobic. This will affect the entire nozzle, unless the regions which are to remain hydrophilic are masked, as dimethyldichlorosilane fumes will affect any exposed $SiO_2$.

The application of a hydrophobic layer is required if the ink is water based, or based on some other polar solvent. If the ink is wax based or uses a nonpolar solvent, then the front surface of the print head should be lipophobic. In summary, the front surface of the print head should be fabricated or treated in such a manner as to repel the ink used. When using the physical device configuration disclosed herein, the hydrophobic layer need not be limited to the front surface of the device. The entire device may be coated with a hydrophobic layer (or lipophobic layer is non-polar ink is used) without significantly affecting the performance of the device. If the entire device is treated with an ink repellent layer, then the nozzle radius should be taken as the inside radius of the nozzle tip, instead of the outside radius.

FIG. 9(*q*) shows a cross section of the wafer in the region of a nozzle after this step.

18) Bond, package and test. The bonding, packaging, and testing processes can use standard manufacturing techniques. Tape automated bonding (TAB) is recommended as a connection means due to the low profile of TAB and the high current capability when a large width of contiguous connections can be used. Bonding pads must be opened out from the $Si_3N_4$ passivation layer. This can be achieved through standard masking and etching processes. After the bonding pads have been opened, the resist must be stripped, and the wafer cleaned. Then wafer testing can proceed. After wafer testing, solder bumps are applied. Then the wafer is diced. The wafers should be cut instead of scribed and snapped, to prevent breakage of long print heads, and because the wafer is weakened along the nozzle rows. The diced wafers (chips) are then mounted in the ink channels. For color print heads, the separate ink channels are scaled to the chip at this stage. After mounting, the TAB leadframes are applied, and dry device tests performed. The device is then be connected to the ink supply, ink pressure is applied, and functional testing can be performed. FIG. 9(*r*) shows a cross section of the wafer in the region of a nozzle after this step.

In FIG. 9(*a*) to FIG. 9(*r*), 100 is ink, 101 is silicon, 102 is CVD $SiO_2$,103 is the heater material, 104 is the tantalum passivation, 106 is the second layer metal interconnect (aluminum), 107 is resist, 108 is silicon nitride ($Si_3N_4$) and 109 is the hydrophobic surface coating.

Alternative fabrication processes

Many other manufacturing processes are possible. The above manufacturing process is not the simplest process that can be employed, and is not the lowest cost practical process. However, the above process has the advantage of simultaneous fabrication of high performance devices on the same wafer. The process is also readily scalable, and 1 mm line widths can be used if desired.

The use of 1 μm line widths (or even finer geometries) allows more circuitry to be integrated on the wafer, and allows a reduction in either the size or the on resistance (or both) of the drive transistors. The smaller device geometries can be used in the following, or a combination of the following, ways:

1) To reduce the width of the monolithic print head
2) To increase the yield of the head, by incorporating more sophisticated fault tolerance circuitry
3) To increase the number of nozzles on the head without increasing chip area.
4) To increase the resolution of the print head by more closely spacing the nozzles in terms of the linear dimensions.
5) To incorporate more of the total system circuitry on the chip. For example, data phasing circuits can be incorporated on chip, and the LIFT head can be supplied with a standard memory interface, via which it acquires the printing data by direct memory access.

It is possible to alter the nozzle formation processes in many ways. For example, it is possible to create the heater using high resolution planar techniques instead of the self-aligned vertical heater formation described herein.

It is also possible to reduce the accuracy and tolerance requirements of some of the processing steps by adding more processing steps. For example, in the preferred fabrication process described herein, the nozzle barrels are formed using a single anisotropic etch through the full 650 μm of the wafer thickness. This etch must be accurately controlled with respect to both sidewall angle and evenness of etch rate over the entire wafer. The tolerance requirements of this step can be reduced by using two major steps. In the first step a large channel is etched most of the way through the wafer, leaving a thickness of approximately 50 μm in the region of the nozzles. A multi-level resist is then applied to the base of this channel, and the nozzle barrels are imaged using a projection system with optical focus on the resist layer at the base of the channel. The nozzle barrels are then etched through the remaining 50 μm of silicon. This process reduces the sidewall angle tolerance requirements from 2 degrees to more than 10 degrees, thus making the process substantially easier to control. However, the physical strength of the chip is substantially reduced by this process, meaning that very careful mechanical handling is required to prevent breakage in subsequent processing steps.

The process described above is one preferred process for production of printing heads as it allows high resolution, full color heads to incorporate drive circuitry, data distribution circuitry, and fault tolerance. Also, the active circuitry of the head is protected from chemical attack by the ink by two passivation layers: silicon nitride and tantalum.

Conventional configuration

High quality printing requires consistent size ink drops. To produce consistently sized ink drops, the nozzle diameter should be accurately controlled. The temperature and duration of the heat pulse applied to the nozzle tip must also be accurately controlled.

Figure 10:
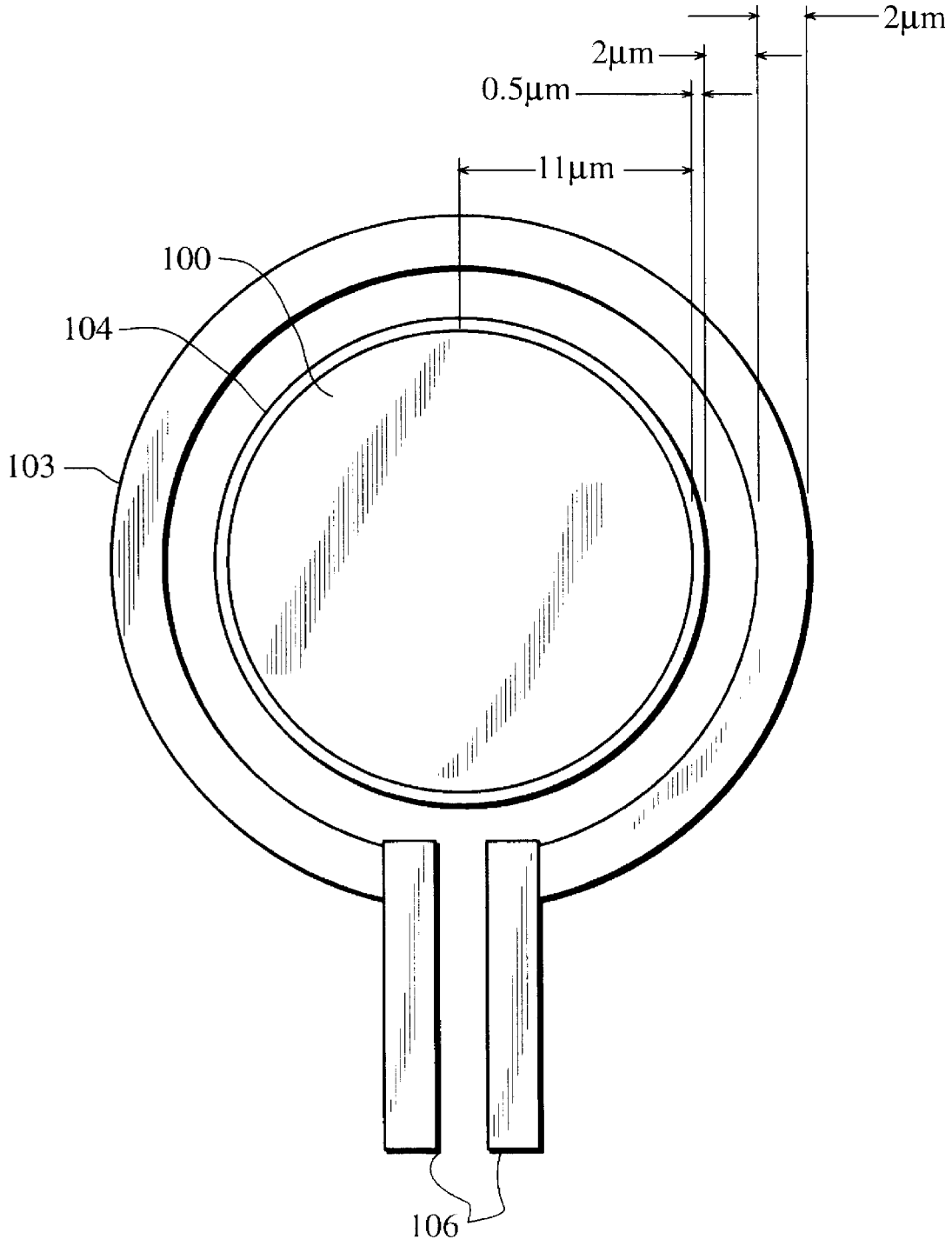
FIG. 10 shows a simple planar heater construction for a printing head in accordance with the invention.

FIG. 10 shows a simple planar construction in accordance with the invention for a nozzle heater, using lithography capable of resolving 2 μm line widths. In this example, the ink 100 in contained in a circular nozzle of radius 7 μm. This nozzle is coated with a passivation layer 104 which is 0.5 μm thick. The heater 103 is fabricated by planar lithography able to resolve 2 μm line widths. The contacts 106 to the heater are formed by aluminum, and are 2 μm wide. This heater configuration suffers the following problems:

1) The minimum width of the heater 103 is 2 μm. This reduces the heater resistance, meaning that higher currents are required to achieve a particular heater power than if the heater width was less.
2) The width of the heater 103 is controlled by lithography, with a typical variation of 0.5 μm. This variation means that heater resistance, and therefore heater power will vary from head to head.
3) The distance from the heater 103 to the passivation layer 104 must be at least 2 μm. This limits the efficiency of the thermal coupling between the heater and the ink.
4) The position of the heater in relation to the nozzle tip is determined by lithographic accuracy. If lithographic equipment capable of resolving 2 μm line widths is used, then the positional accuracy of the heater may vary by more than 1 μm in relation to the nozzle tip. This means that the heat from the heater will not be evenly distributed at the nozzle tip. This may result in improper or no ejection of the ink drop, and general degradation of the print quality achieved by the print head.

5) The region that the contacts 106 meet the heater 103 does not generate as much heat as the remainder of the heater. This results in a cold point in the circumference, potentially affecting drop formation.

These problems may be alleviated by using very accurate lithography. Lithographic equipment capable of resolving 0.35 $\mu$m line widths is used in volume production of semiconductor devices at present. However, such equipment is expensive compared to lithographic equipment with resolving power between 1 $\mu$m and 2 $\mu$m.

Fabrication of self aligned heaters

Preferred embodiments of the invention also provide a self-aligned heater design which allows a heater width less than the lithographic line width, with accurate control of heater width. The heater is fabricated by a series of isotropic deposition steps and anisotropic etching steps, which forms a heater with accurately controlled dimensions and position relative to the nozzle tip.

Self-aligned means that the alignment of the heater to the nozzle tip is a result of the manufacturing process steps, and is not determined by the alignment accuracy of lithographic processing steps. The heater dimensions and position are determined by deposition and etching steps, which can be controlled to much greater accuracy than lithographic steps.

Figure 11A:
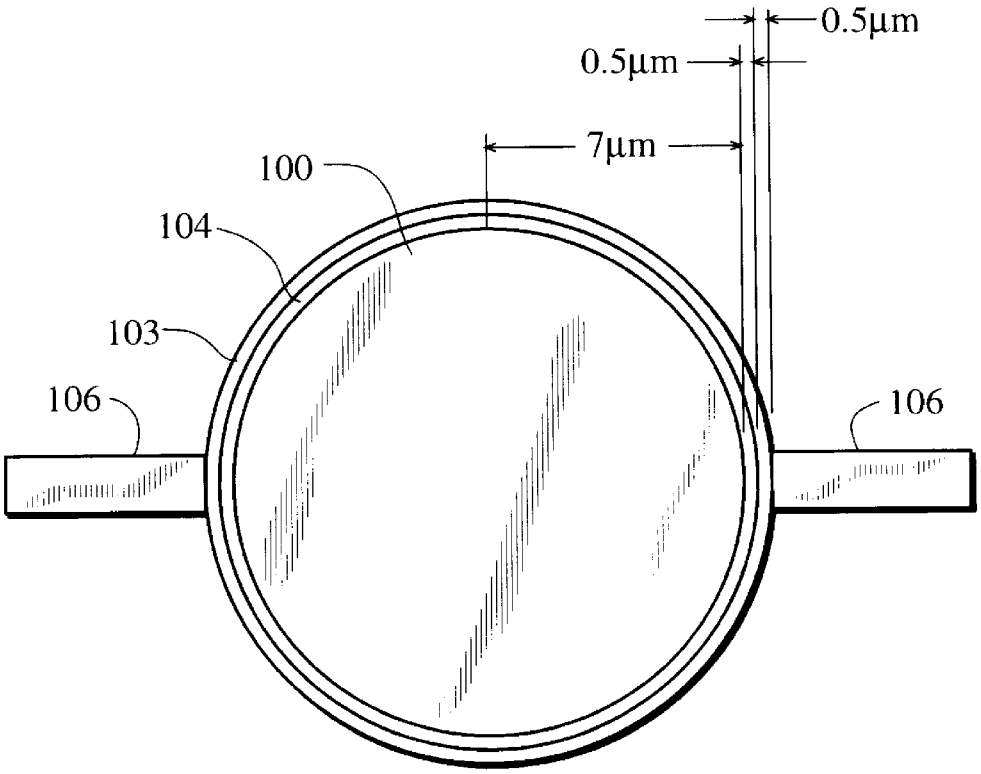
FIG. 11(*a*) shows a plan view of the self-aligned heater structure.
Figure 11B:
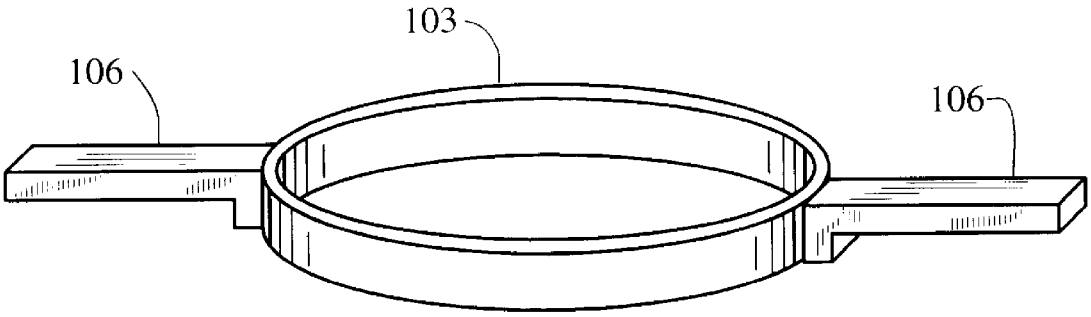

FIG. 11(*a*) shows a plan view of the nozzle tip, showing the self-aligned heater structure 103. The heater 103 is vertically oriented in relation to the wafer surface.

FIG. 11(*b*) shows an isometric view of the same heater structure.

The thickness of the heater, width of the heater, and position of the heater in relation to the nozzle tip are all determined by deposition and etching processes, which can readily be controlled very accurately. The fabrication process for this heater configuration also avoids the requirement for a heater mask and lithographic steps.

The physical dimensions of the nozzle are very small. It is not practical to manufacture these devices using manufacturing processes such as molding and milling. Instead, processes used in the manufacture of integrated circuits can be used. These processes are generally used to manufacture planar devices. However, three dimensional structures can be fabricated if the correct sequence of masks and manufacturing processes are used. The invention is a heater structure which is self-aligned to the nozzle, the dimensions of which are determined by deposition and etching processes. The heater structure and heater contacts are formed in the following fundamental steps;

a) etching of the nozzle tip;

b) isotropically coating the nozzle tip with an electrically conductive material suitable for heater contacts;

c) etching the electrically conductive material using a resist which is patterned with an appropriate pattern for heater contacts;

d) coating the nozzle tip and heater contact material with a substance;

e) etching the substance to a depth below the surface of the nozzle tip equal to the desired width of the heater;

f) isotropically coating the nozzle tip with a layer of heater material to a thickness equal to the desired thickness of the heater; and g) anisotropically etching the heater material in a manner as to remove all of the heater material except the required heater material in the nozzle tip.

To determine the appropriate drive voltage for the nozzle, the heater resistance must be known. The heater resistance can be calculated from the geometry of the heater and the thin film resistivity of the heater material. The preferred heater geometry is a circular band which is connected to drive circuitry at opposite sides. The resistance of the heater can therefore be calculated by the equation:

$$R_H = \frac{\rho \pi r}{2WT}$$

Where:

$R_H$ is the heater resistance $\rho$ is the thin film resistivity of the heater material r is the radius of the heater W is the width of the heater T is the heater thickness Evaluating for:

$\rho$=2.3 $\mu\Omega$m (TaAl)

r=7.5 $\mu$m

W=1.0 $\mu$m

T=0.05 $\mu$m

Then:

$R_H$=542$\Omega$

The table "LIFT Head Type A4-4-600" is a summary of some of the characteristics of an example process color print head, according to the invention, for printing an A4 page at 600 dpi in one second (see Appendix A). Another embodiment and fabrication process in accordance with the present invention provides advantages as to power dissipation and heater usage and is described in detail with reference to FIGS. 12–34.

Power dissipation in simple LIFT nozzle designs

When a large number of nozzles are incorporated into one monolithic structure, it becomes important to reduce the power required by each nozzle to the practical minimum.

Figure 12:
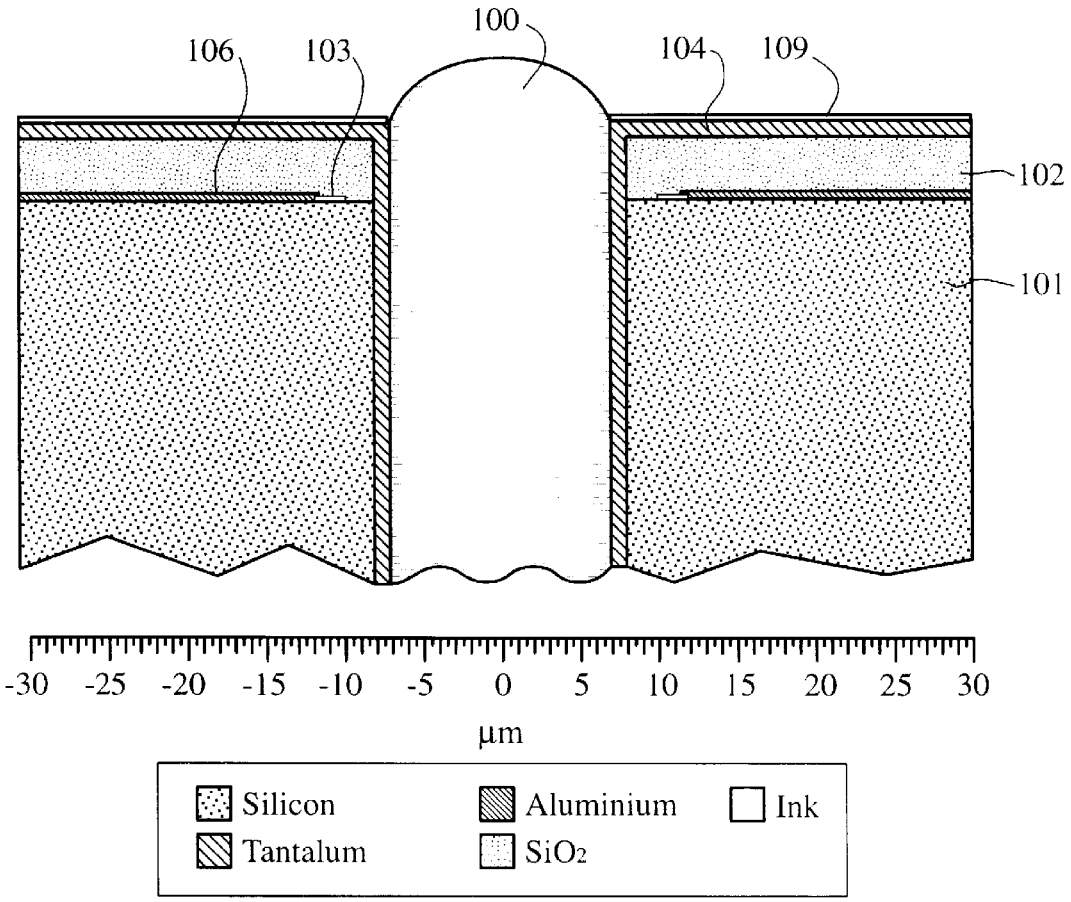
FIG. 12 shows a simple nozzle with high power dissipation

FIG. 12 shows a cross section through a simple nozzle constructed in accordance with an embodiment of the present invention. The ink 100 flows into a cylindrical barrel fabricated from the silicon substrate 101. The nozzle tip includes an electrically activated heater 103 protected by an electrically insulating material 102, for example Chemical Vapor Deposited glass (CVD $SiO_2$). The nozzle is protected from corrosion by the ink with a passivation layer 104, for example tantalum, with a thin oxide coating of tantalum pentoxide ($Ta_2O_5$). Ink is prevented from flowing along the surface of the nozzle by a hydrophobic coating 109. During operation of the device, the ink is placed under pressure. The ink pressure is sufficient to cause the meniscus to become convex, but insufficient to cause the ink to escape from the nozzle. The meniscus of the ink is shown in the 'equilibrium' state.

When an ink drop is to ejected, the heater 103 is turned on, by passing electrical current through the heater via the electrodes 106. Turning on the heater causes the surrounding material to increase in temperature. Heat flows from the heater until it reaches the ink in the region of the nozzle tip. Heating the ink causes the surface tension of the ink meniscus to reduce. By this method, the equilibrium is broken, and ink begins to flow out of the nozzle under pressure.

This nozzle configuration is simple to fabricate, but is inefficient in the amount of energy required to eject a drop. There are several sources of heat wastage in this configuration, including:

The heater is placed directly on the silicon substrate. Silicon is a relatively good conductor of heat, so most of the heat will simply be dissipated into the substrate.

The distance from the heater to the ink is limited by lithographic resolution, resulting in a long thermal path to the ink. This means that all of the material between the heater and region 106 must be raised above the required drop ejection temperature before the ink can reach the drop ejection temperature.

The basic geometry of the nozzle indicates that the thermal resistance of paths from the heater away from region 106 is lower than that of the path towards region 106, so the majority of the heat energy will not reach region 106.

Heater power reduction

The power requirement of a print head can be divided into two categories:

1) Quiescent power, which is the power that is consumed when no ink is being ejected. This power requirement mostly derived from the shift registers and drive circuitry of the head, as well as leakage currents of the main drive transistors. Using modern semiconductor processes, quiescent power consumption can be reduced to a level where it becomes insignificant, and will be dissipated by normal conduction and air convection around the head.
2) Active power, which is the amount of power consumed when the head is actually printing. This may be expressed as the amount of energy required to eject a single drop of ink, times the number of drops ejected in a specified time period (typically one second). For a four color 'process' head, active power will be zero when printing white, a maximum when printing solid four color black.

The active power is significantly affected by the detailed design of the nozzle, especially the location, size, and materials surrounding the heater.

Power reduction is achieved by several means as follows:

1) The provision of a thermally insulating layer between the heater and the substrate. This layer can be the thermal $SiO_2$ and CVD $SiO_2$ layers which are normally part of CMOS device fabrication.
2) Minimizing the thermal mass of the heater and surrounding solid material. This can be achieved by locating the heater so that it is on a 'pillar' of solid material, and therefore surrounded on most sides by either air (which is of low thermal conductivity) or ink (wherein the heat is not wasted, but required for drop selection).
3) Minimizing the distance between the heater and the ink meniscus. This can be achieved by placing the heater at the tip of the nozzle, at the point of contact of the ink meniscus.
4) Using a material of relatively high thermal conductivity to passivate the heater against corrosion by the ink. An optimum material for this purpose is diamond, or diamond-like carbon (DLC) with a low porosity. However, diamond and DLC require special processes to apply. For most applications, a low porosity silicon nitride will suffice.
5) Using a thin passivation material. The passivation layer should be as thin as practical commensurate with providing good protection against corrosion. A layer thickness of 2,000 Å is suitable.
6) Undercutting the substrate in the region of the heater.

Each of the above means effects a reduction in power requirements over a system which does not use these means. Using a combination of these effects, the energy required to eject of drop of ink can be reduced to the level where the head becomes self-cooling.

The preferred embodiment of this invention is shown in FIG. 1(*b*), which shows a simplified cross section through a high efficiency nozzle. The ink 100 flows into a cylindrical barrel which is formed of the silicon substrate material 101. The nozzle tip includes an electrically activated heater 103 surrounded by an electrically insulating material 102, for example Chemical Vapor Deposited glass (CVD $SiO_2$). The nozzle is protected from corrosion by the ink with a passivation layer 104, which is composed of a material with high electrical resistance, high resistance to permeation by hydroxyl ions, and high thermal conductivity. A suitable material is silicon nitride.

FIG. 1(*b*) is generally to scale, and shows one example of preferred dimensions for the various structural features.

Suitable processes for manufacturing such print heads with these features are described later in this document.

Print head manufacturing process for print head with nozzle rim heaters

The manufacture of monolithic printing heads in accordance with this embodiment, is similar to standard silicon integrated circuit manufacture. However, the normal process flow must be modified in several ways. This is essential to form the nozzles, the barrels for the nozzles, the heaters, and the nozzle tips. There are many different semiconductor processes upon which monolithic head production can be based. For each of these semiconductor processes, there are many different ways the basic process can be modified to form the necessary structures.

The manufacturing process for integrated printing heads can use <100> wafers for standard CMOS processing. The processing is substantially compatible with standard CMOS processing, as the MEMS specific steps can all be completed after the fabrication of the CMOS VLSI devices.

The wafers can be processed up to oxide on second level metal using the standard CMOS process flow. Some specific process steps then follow which can also be completed using standard CMOS processing equipment. The final etching of the nozzles through the chip can be completed at a MEMS facility, using a single lithographic step which requires only 10 $\mu$m lithography.

The process does not require any plasma etching of silicon: all silicon etching is performed with an EDP wet etch after the fabrication of active devices.

The nozzle diameter in this example is 16 $\mu$m, for a drop volume of approximately 8 pl. The process is readily adaptable for a wide range on nozzle diameters, both greater than and less than 16 $\mu$m.

The process uses anisotropic etching on a <100> silicon wafer to etch simultaneously from the ink channels and nozzle barrels. High temperature steps such as diffusion and LPCVD are avoided during the nozzle formation process.

Layout example

Figure 13:
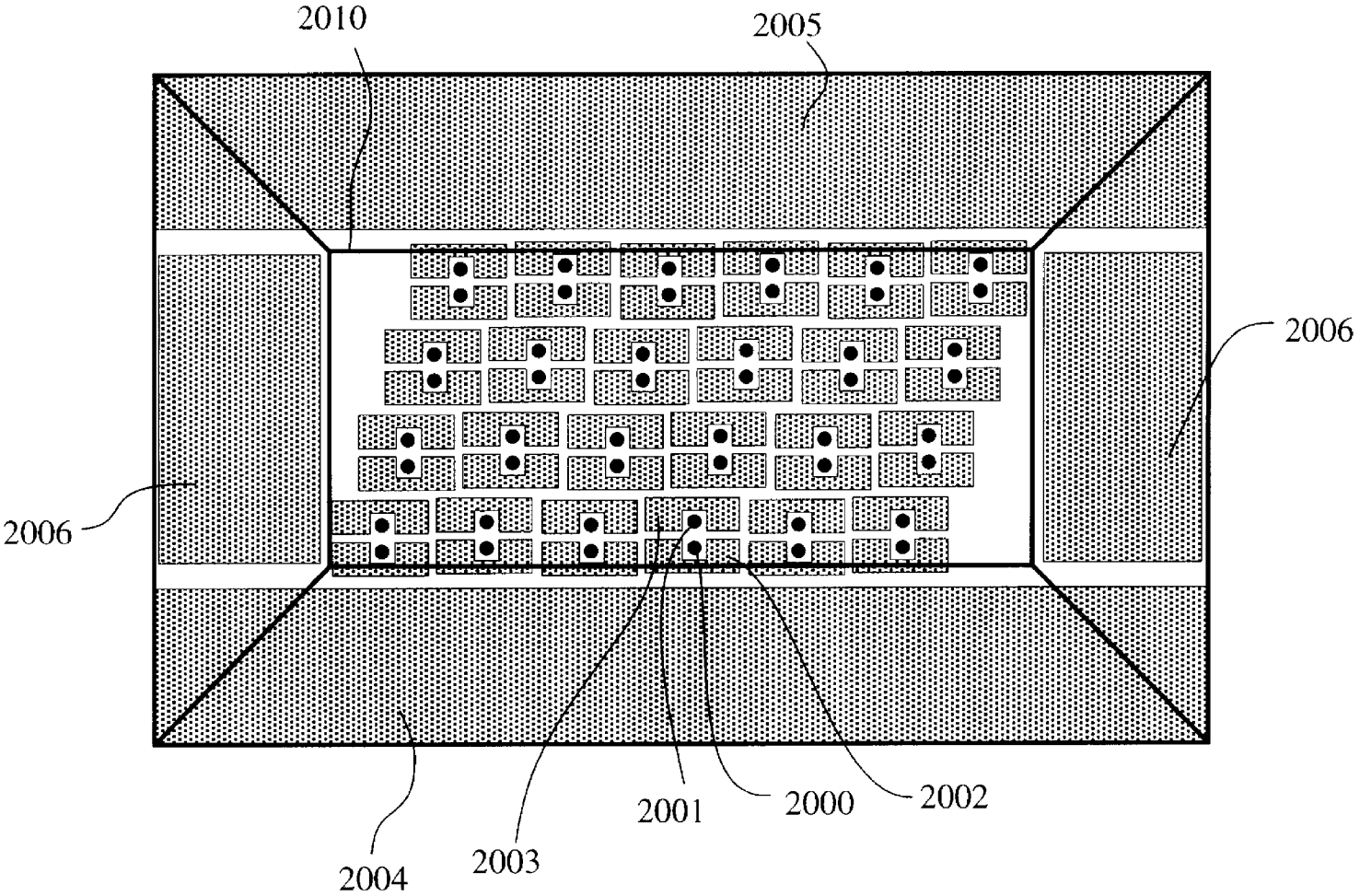
FIG. 13 shows a nozzle layout for a small section of the print head.

FIG. 13 shows an example layout for a small section of an 800 dpi print head. This shows the layout of nozzles and drive circuitry for 48 nozzles which are in a single ink channel pit. The black circles in this diagram represent the positions of the nozzles, and the grey regions represent the positions of the active circuitry.

The 48 nozzles comprise 24 main nozzles 2000, and 24 redundant nozzles 2001. The position of the MOS main drive transistors 2002 and redundant drive transistors 2003 are also shown. The ink channel pit 2010 is the shape of a truncated rectangular pyramid etched from the rear of the wafer. The faces of the pyramidical pit follow the {111} planes of the single crystal silicon wafer. The nozzles are located at the bottom of the pyramidical pits, where the wafer is thinnest. In the thicker regions of the wafer, such as the sloping walls of the ink channel pits, and the regions between pits, no nozzles can be placed. These regions can be used for the data distribution and fault tolerance circuitry. If a two micron or finer CMOS process is used, there is plenty of room to include extensive redundancy and fault tolerance in the shift registers, clock distribution, and other circuits used. FIG. 13 shows a suitable location for main shift registers 2004, redundant shift registers 2005, and fault tolerance circuitry 2006.

Figure 14:
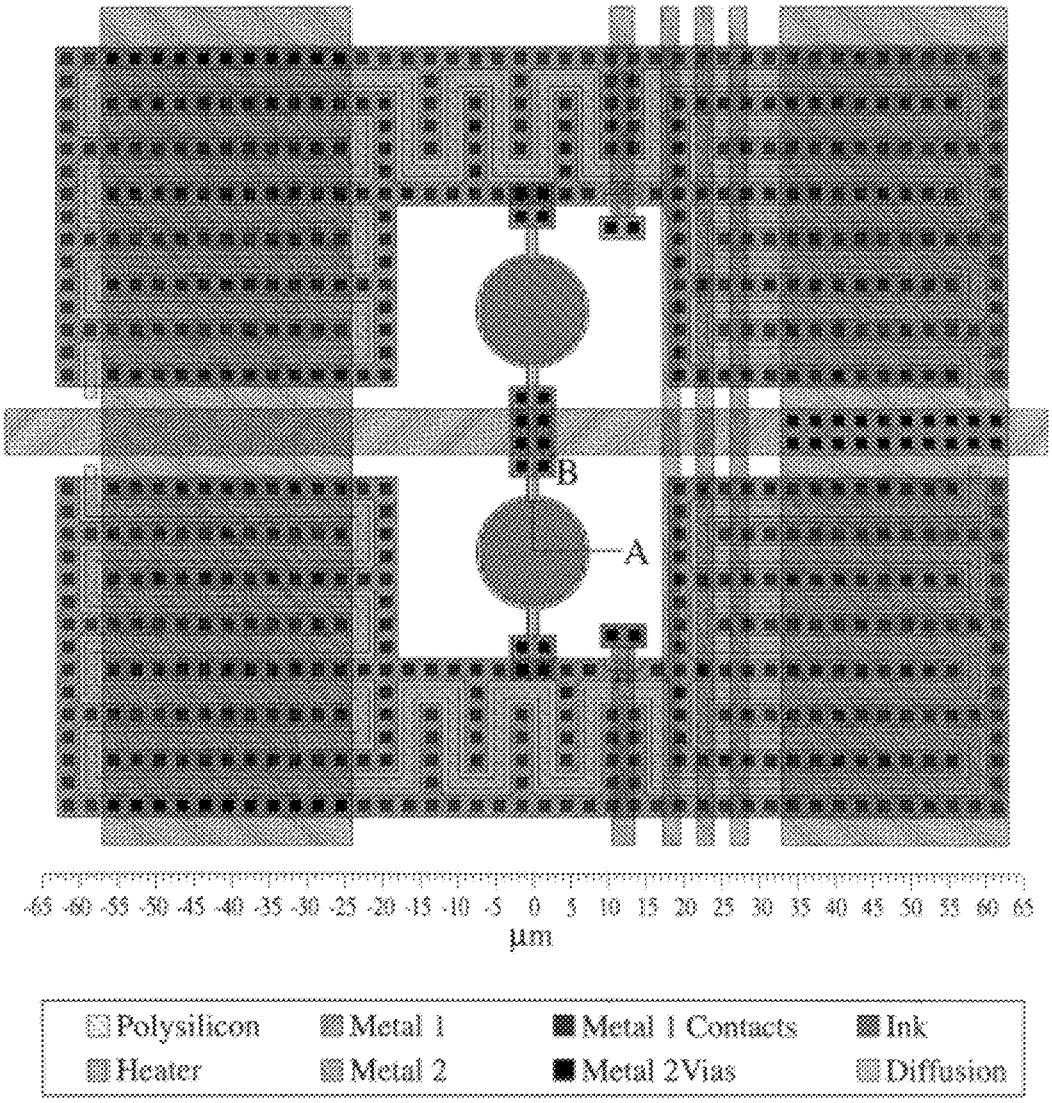
FIG. 14 shows a detail of the layout of two nozzles and two drive transistors.

FIG. 14 is a detail layout of one pair of nozzles (a main nozzle and its redundant counterpart), along with the drive transistors for the nozzle pair. The layout is for a 1.5 micron VLSI process. The layout shows two nozzles, with their corresponding drive transistors. The main and redundant nozzles are spaced one pixel width apart, in the print scanning direction. The main and redundant nozzles can be placed adjacent to each other without electrostatic or fluidic interference, because both nozzles are never fired simultaneously. Drive transistors can be placed very close to the nozzles, as the temperature rise resulting from drop selection is very small at short distances from the heater.

The large $V^+$ and $V^-$ currents are carried by a matrix of wide first and second level metal lines which covers the chip. The $V^+$ and $V^-$ terminals extend along the entire two long edges of the chip.

Alignment to crystallographic planes

The manufacturing process described in this chapter uses the crystallographic planes inherent in the single crystal silicon wafer to control etching. The orientation of the masking procedures to the {111} planes must be precisely controlled. The orientation of the primary flats on a silicon wafer are normally only accurate to within ±1° of the appropriate crystal plane. It is essential that this angular tolerance be taken into account in the design of the mask and manufacturing processes. The surface orientation of the wafer is also only accurate to ±1°. However, since the wafer is thinned to approximately 300 μm before the ink channels are etched, a ±1° error in alignment of the surface contributes a maximum of 5.3 μm of positional inaccuracy when etching through the ink channels. This can be accommodated in the design of the mask for back face etching.

Manufacturing process summary

The starting wafer can be a standard 6" silicon wafer, except that wafers polished on both sides are required.

Figure 15:
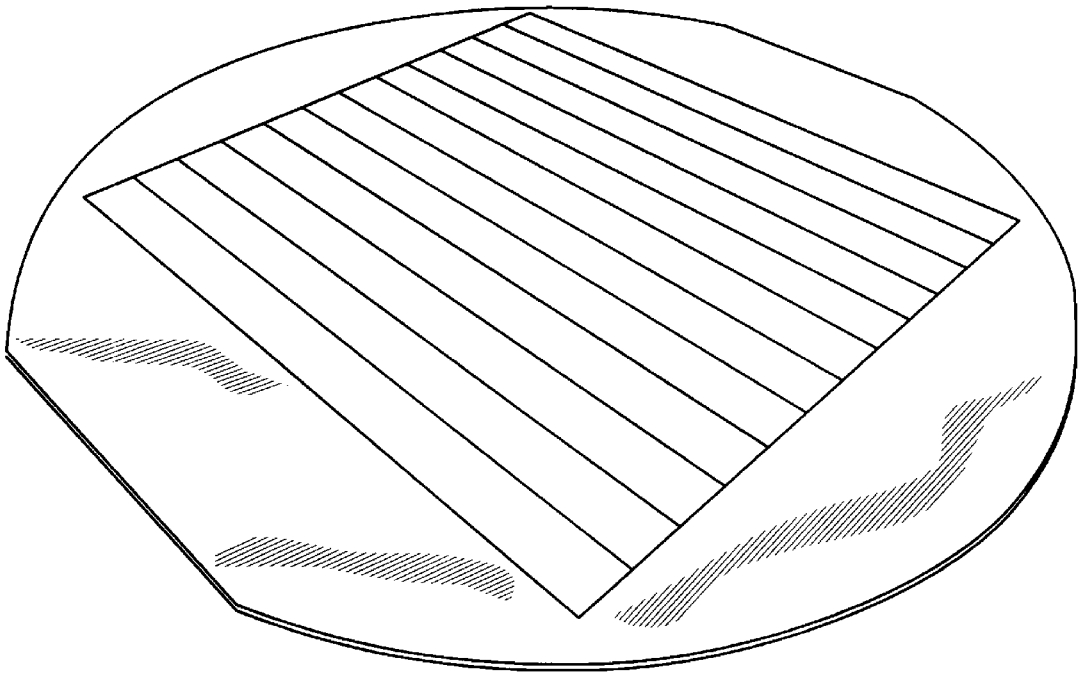
FIG. 15 shows the layout of a number of print heads fabricated on a standard silicon wafer

FIG. 15 shows a 6" wafer with 12 full color print heads, each with a print width of 105 mm. Two of these print heads can be combined to form an A4/US letter sized pagewidth print head, four can be combined to provide a 17" web commercial printing head, or they can be used individually for photograph format printing, for example in digital 'minilabs', A6 format printers, or digital cameras.

Example wafer specifications are:

| | |
|---|---|
| Size | 150 mm (6") |
| Orientation | <100> |
| Doping | n/n+ epitaxial |
| Polish | Double-sided |
| Nominal thickness | 625 micron |
| Angle to crystal planes | ±1° |

The major manufacturing steps are as follows:

1) Complete the CMOS process, fabricating drive transistors, shift registers, clock distribution circuitry, and fault tolerance circuitry according to the normal CMOS process flow. A two level metal CMOS process with line widths 1.5 μm or less is preferred. The CMOS process is completed up until oxide over second level metal.

Figure 16:
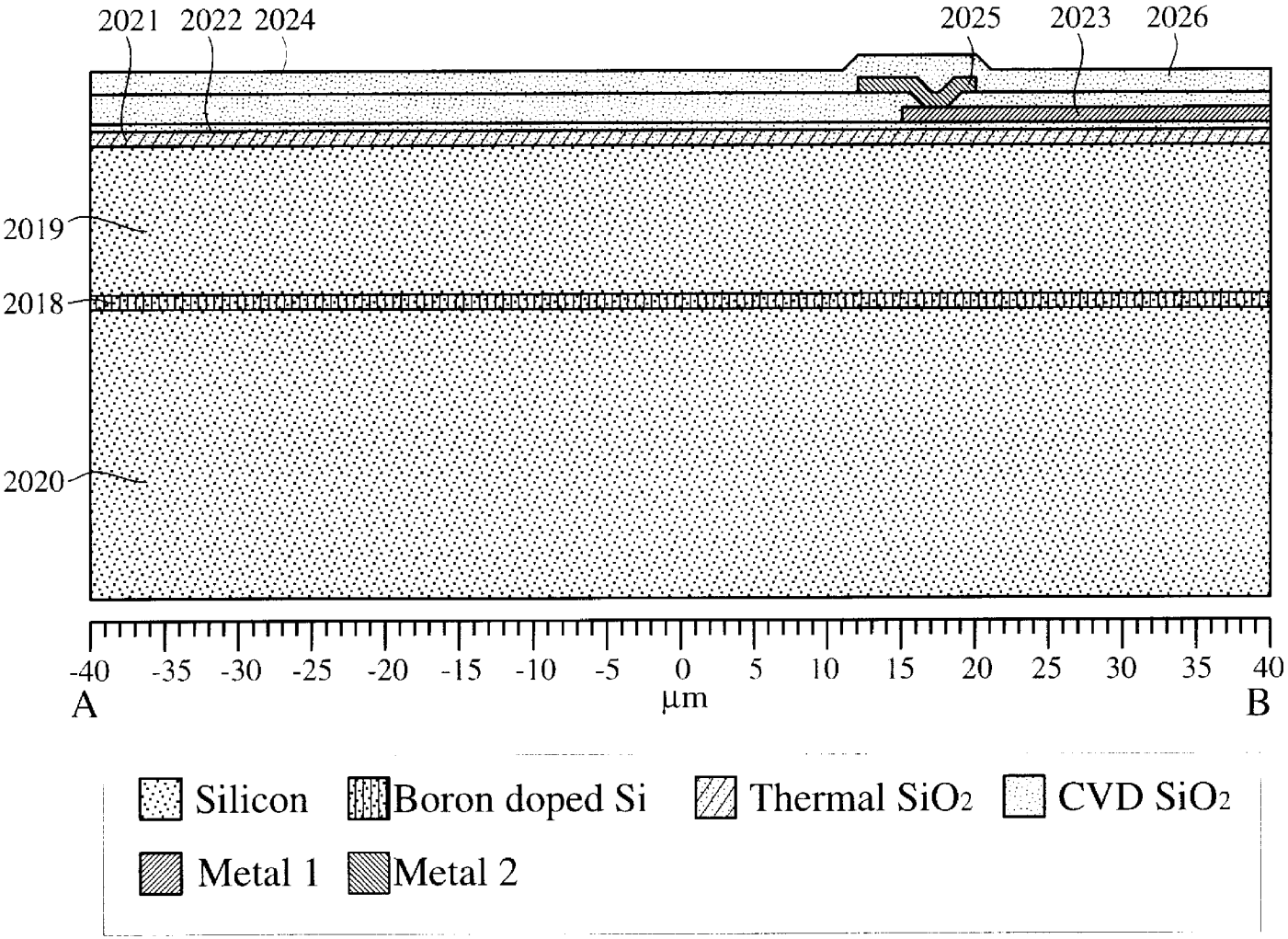
FIGS. 16 to 27 show cross sections of the print head in a small region at the tip of one nozzle at various stages during the manufacturing process.

FIG. 16 shows a cross section of wafer in the region of a nozzle tip after the completion of the standard CMOS process flow.

This diagram shows the silicon wafer 2020, field oxide 2021, first interlevel oxide 2022, first level metal 2023, second interlevel oxide 2024, second level metal 2025, and passivation oxide 2026.

The layer thicknesses in this example are as follows:

a) Field oxide 2021: 1 μm.

b) First interlevel oxide 2022: 0.5 μm.

c) First level metal 2023: 1 μm.

d) Second interlevel oxide 2024: 1.5 μm, planarized.

e) Second level metal 2025: 1 μm.

f) Passivation oxide 2026: 2 μm, planarized.

There are two interlevel vias at the nozzle tip, shown connecting the first level metal 2023 and a small patch of second level metal 2025.

2) Mask the nozzle tip using resist. The nozzle tip hole is formed to cut the interlevel vias at the nozzle tip in half. This is to provide a 'taller' connection to the heater. On the same mask as the nozzle tip holes are openings which delineate the edge of the chip. This is for front-face etching of the chip boundary for chip separation from the wafer. The chip separation from the wafer is etched simultaneously to the ink channels and nozzles.

3) Plasma etch the nozzle tip and front face chip boundary. This is a anisotropic plasma etch of the surface oxide layers. This etch removes approximately 5 μm of $SiO_2$. Etch sidewalls should be as steep as possible. Here 85° sidewalls are assumed. The etch proceeds until the silicon is reached.

Figure 17:
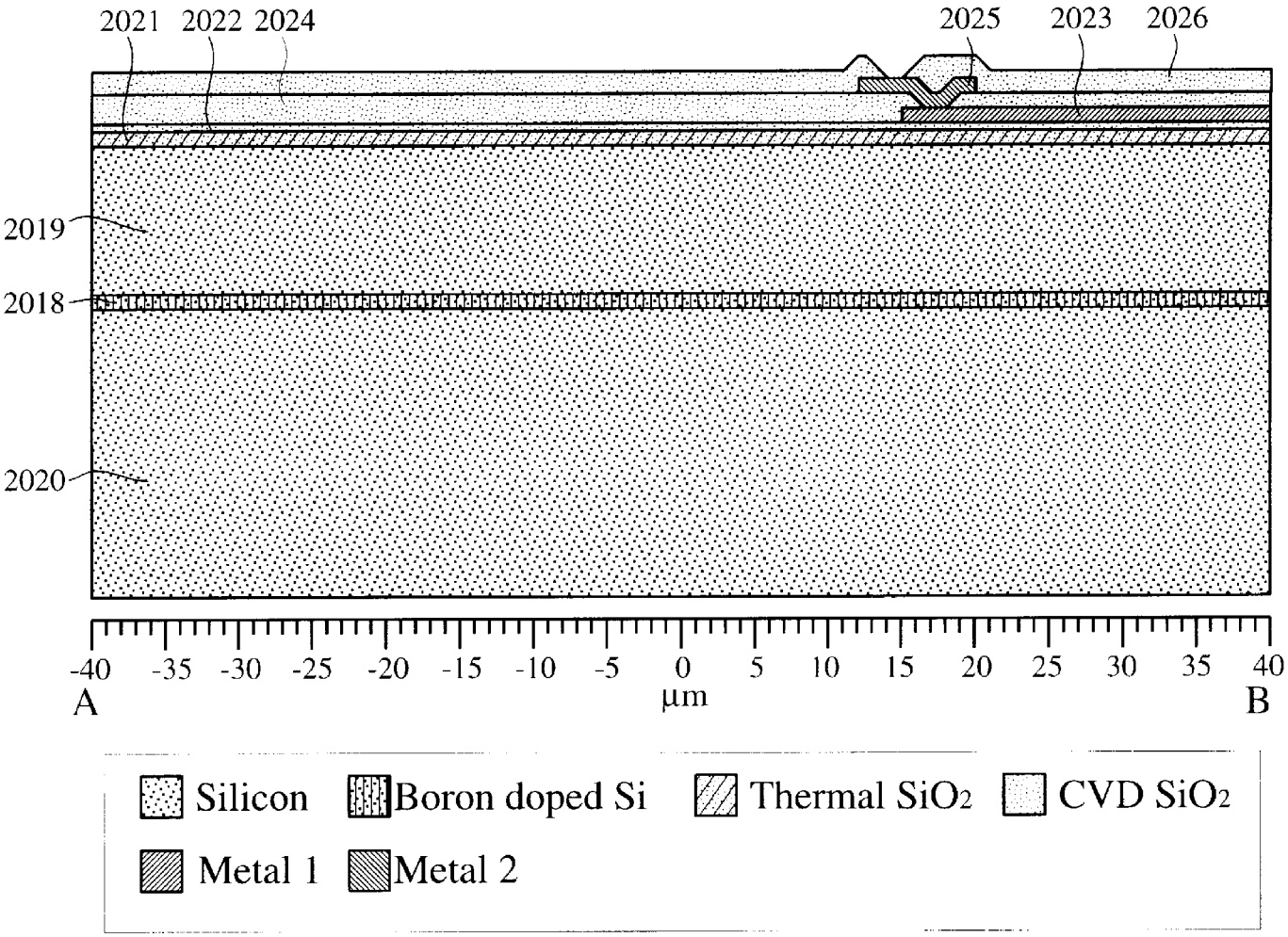
Figure 18:
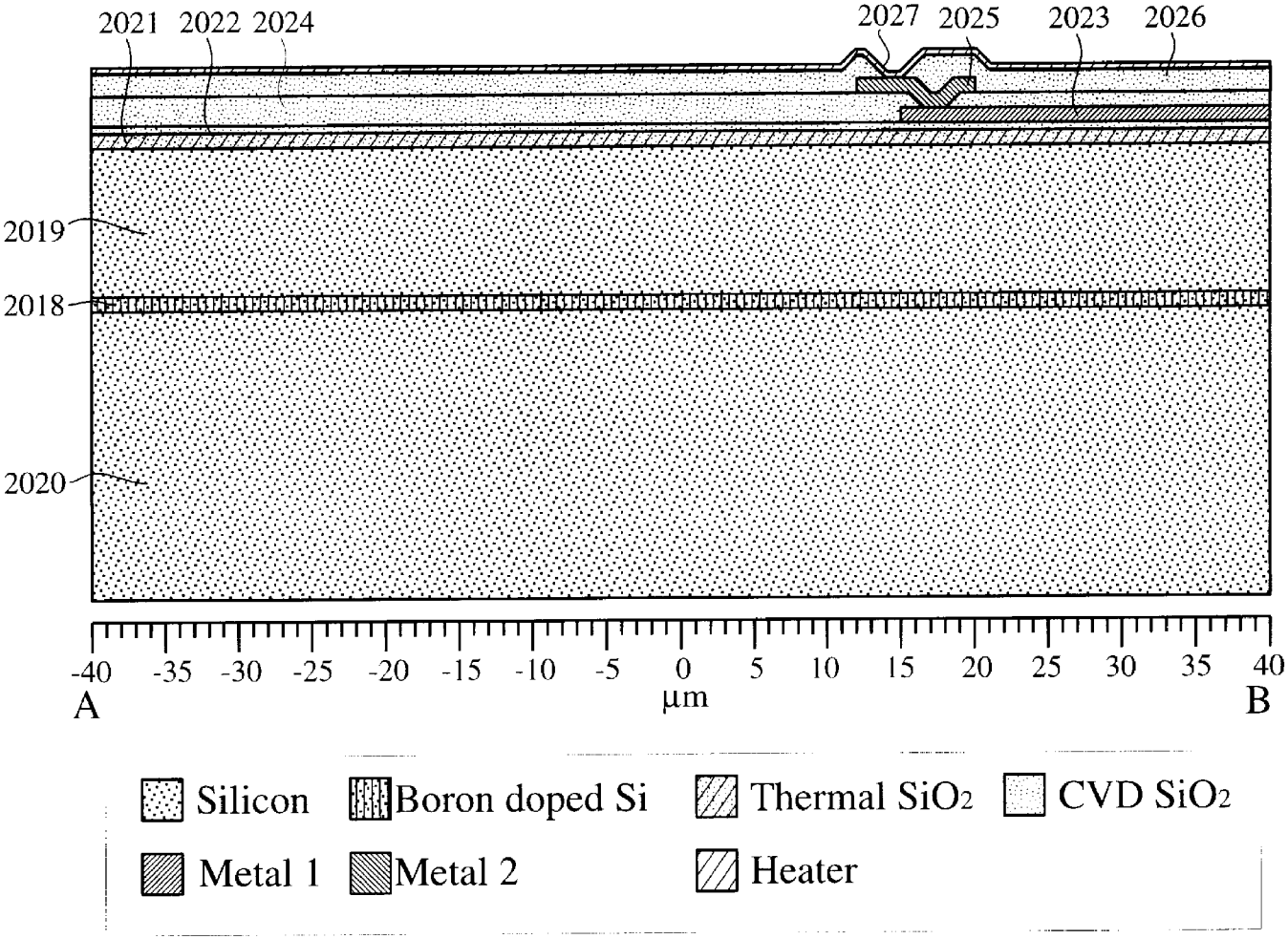

FIG. 17 is a cross section of the nozzle tip region after the nozzle tip has been etched.

Figure 19:
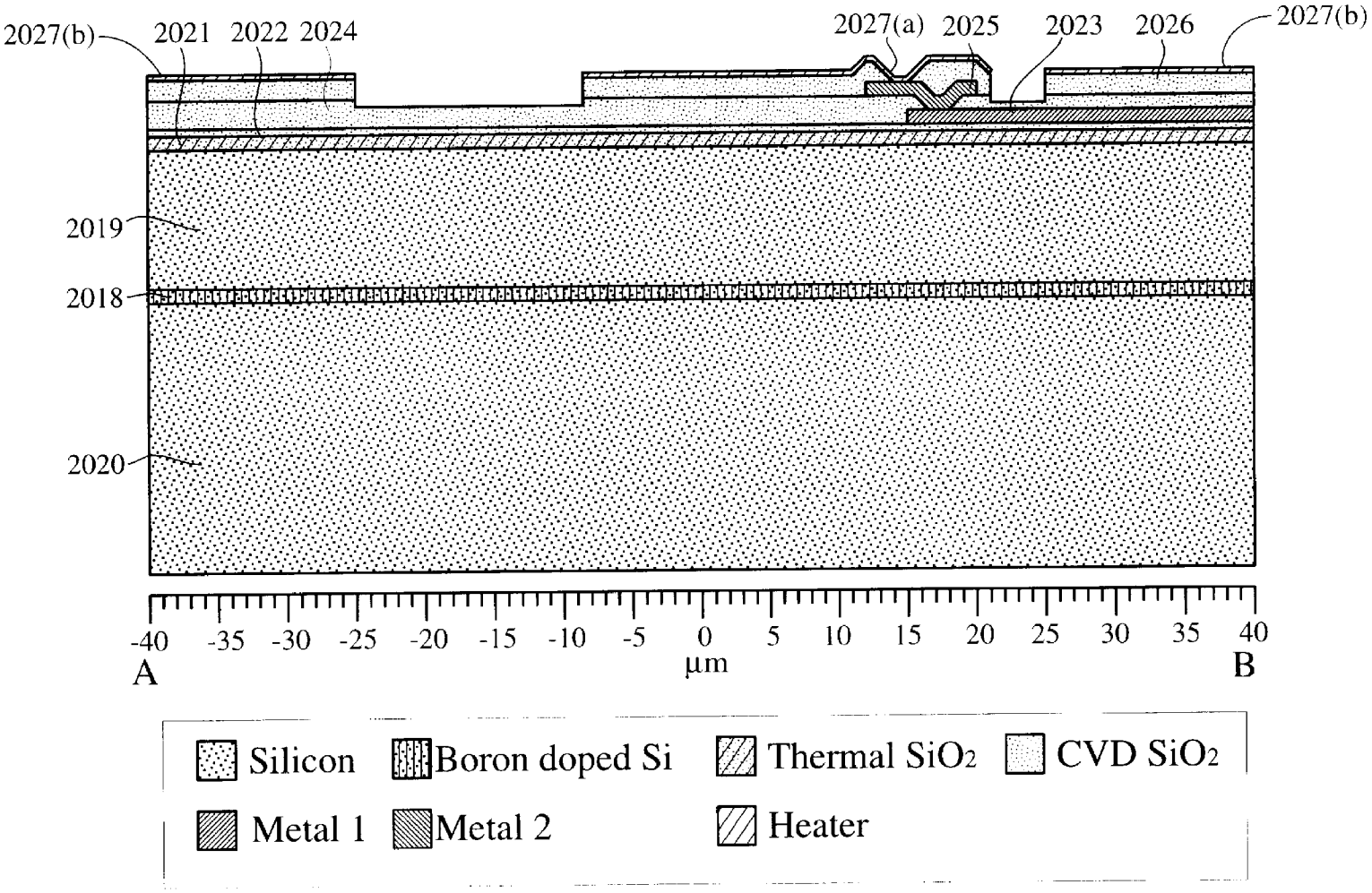

4) Deposit a thin layer of heater material 2027. The layer thickness depends upon the resistivity of the heater material chosen. Many different heater materials can be used, including nichrome, tantalum/aluminum alloy, tungsten, polysilicon doped with boron, zirconium diboride, hafnium diboride, and others. The melting point of the heater material does not need to be very high, so heater materials which can be evaporated instead of sputtered can be chosen. FIG. 19 is a cross section of the nozzle tip region after this deposition step.

5) Chemically thin the wafer to a thickness of approximately 300 microns.

6) Deposit 0.5 micron of PECVD $Si_3N_4$ (nitride) 2028 on both the front and back face of the wafer. FIG. 19 is a cross section of the nozzle tip region after this deposition step.

7) Spin-coat resist on the back of the wafer. Mask the back face of the wafer for anisotropic etching of the ink channels, and chip separation (dicing). The mask contains concave rectangular holes to form the ink channels, and holes which delineate the edge of the chip. As some angles of the chip edge boundary are convex, mask undercutting will occur. The shape of the chip edge can be adjusted by placing protrusions on the mask at convex comers. The mask patterns are aligned to the {111} planes. The resist is used to mask the etching of the PECVD nitride previously deposited on the back face of the wafer. Etch the backface nitride, and strip the resist.

8) Etch the wafer in EDP at 110° C. until the wafer thickness in the nozzle tip region is approximately 100 μm. The etch time should be approximately 4 hours. The duration of this etch, and resulting silicon thickness in the nozzle region, can be adjusted to control the geometry of the chamber behind the nozzle tip (the nozzle barrel). While the etch is eventually right through the wafer, it is interrupted part way through to start etching from the front surface of the wafer as well as the back. This two stage etching allows precise control of the amount of undercutting of the nozzle tip region that occurs. An undercut of between 1 micron and 8 microns is desirable, with an undercut of approximately 3 microns being preferred. This etch is completed in step 12.

Figure 20:
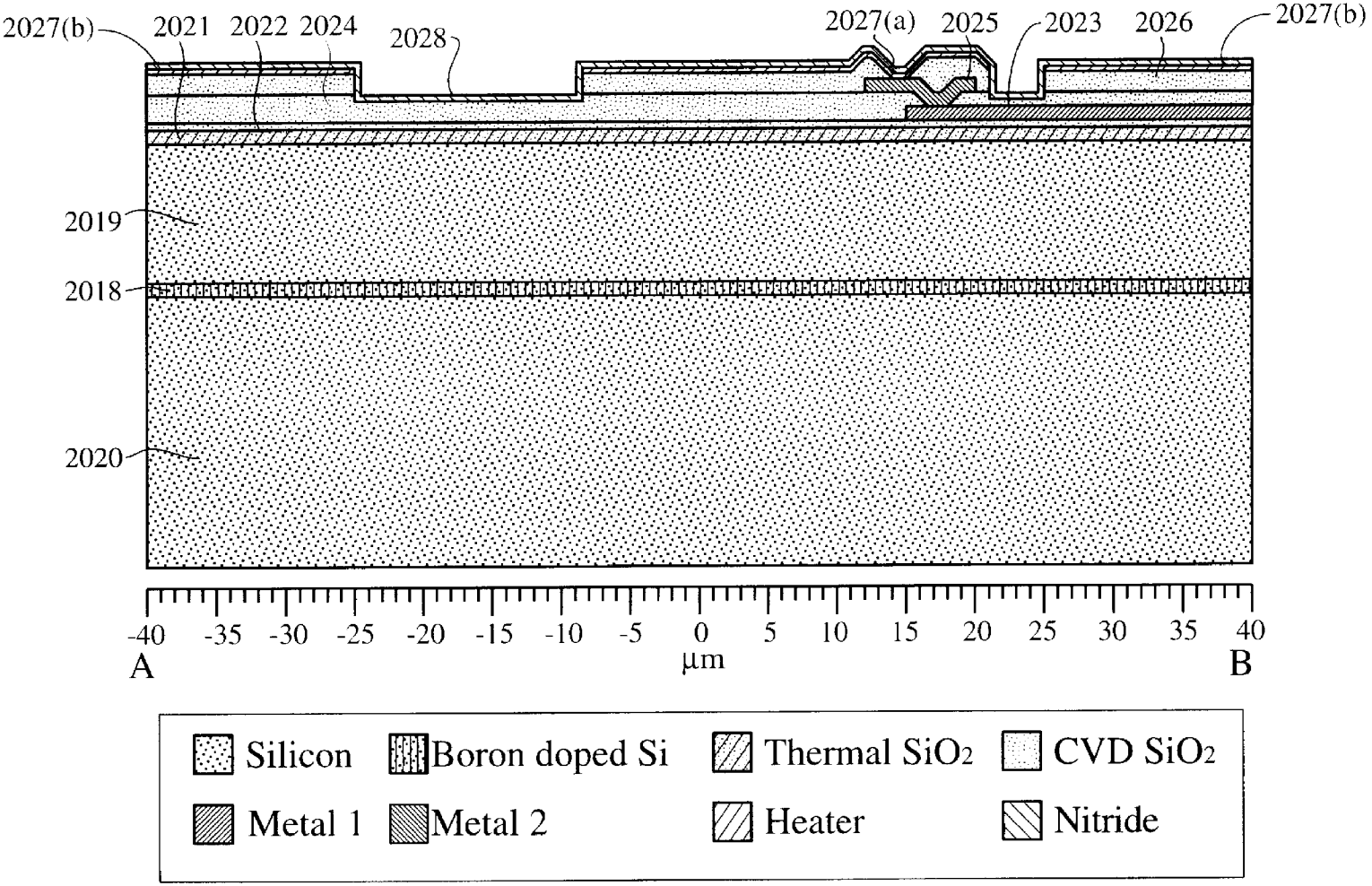

9) Anisotropically etch the surface nitride 2028 and heater 2027 layers. The anisotropic etch can be a reactive ion plasma etch (RIE). This etching step should remove all heater 2027 and nitride 2028 material from horizontal surfaces, while leaving most of the nitride 2028 and all of the heater 2027 material on the near vertical surface of the nozzle tip. FIG. 20 is a cross section of the nozzle tip region after this etching step.

10) Open the bonding pads using standard lithographic and etching processes.

Figure 21:
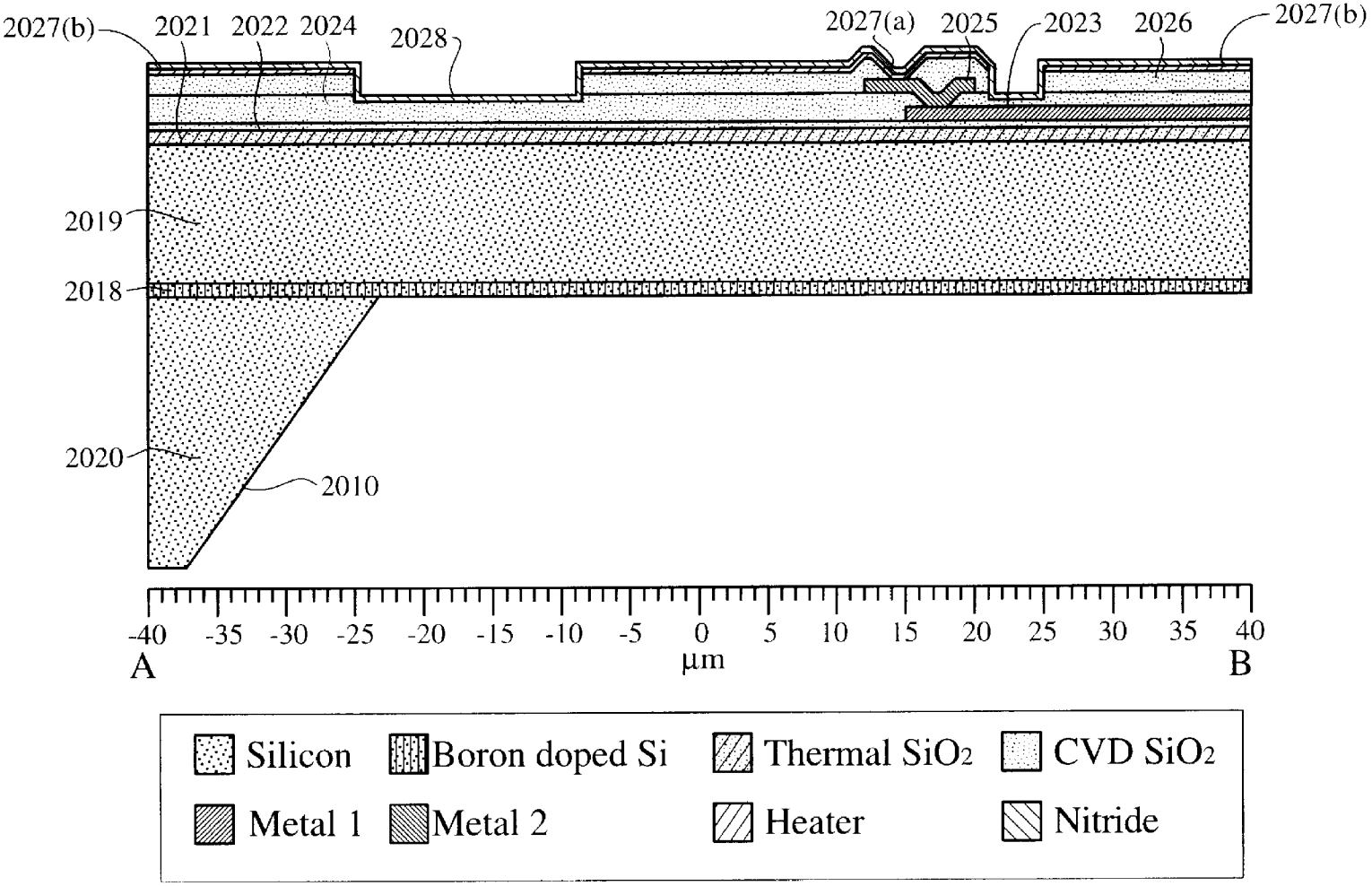

11) Isotropically etch 1 micron of $SiO_2$ 2026, without using a mask. This can be achieved with a wet etch which has a high selectivity against $Si_3N_4$. This forms a silicon nitride rim around the nozzle tip. FIG. 21 is a cross section of the nozzle tip region after this etching step.

12) Complete the wafer etch begun in step 8. Etch using EDP at 110° C. This etch proceeds from both sides of the wafer: through the nozzle tip holes from the front, and through the ink channel holes from the back. The etch rates are approximately as per the following table:

| | |
|---|---|
| Wet Etchant | EDP type S:<br>Ethylenediamine - 1 l<br>Water - 133 ml<br>Pyrocatechol - 160 grams<br>Pyrazine - 6 grams |
| Etch temperature | 110° C. |
| Silicon [100]etch rate | 55 μm per hour |
| Silicon [111]etch rate | 1.5 μm per hour |
| $SiO_2$ etch rate | 60 Å per hour |

These etch rates are from H. Seidel, "The Mechanism of Anisotropic Silicon Etching and its relevance for Micromachining," Transducers '87, Rec. of the 4th Int. Conf. on Solid State Sensors and Actuators, 1987, PP. 120–125.

The etch time is critical, as there is no etch stop. As each batch will vary somewhat in etch rate, wafers should be checked periodically near the end of the etch period. The etch is nearly complete when light first begins to shine through the nozzle tip holes. At this stage, the wafer is returned to the etch for another six minutes. It is desirable that the wafers that are processed simultaneously have matched wafer thicknesses.

Figure 22:
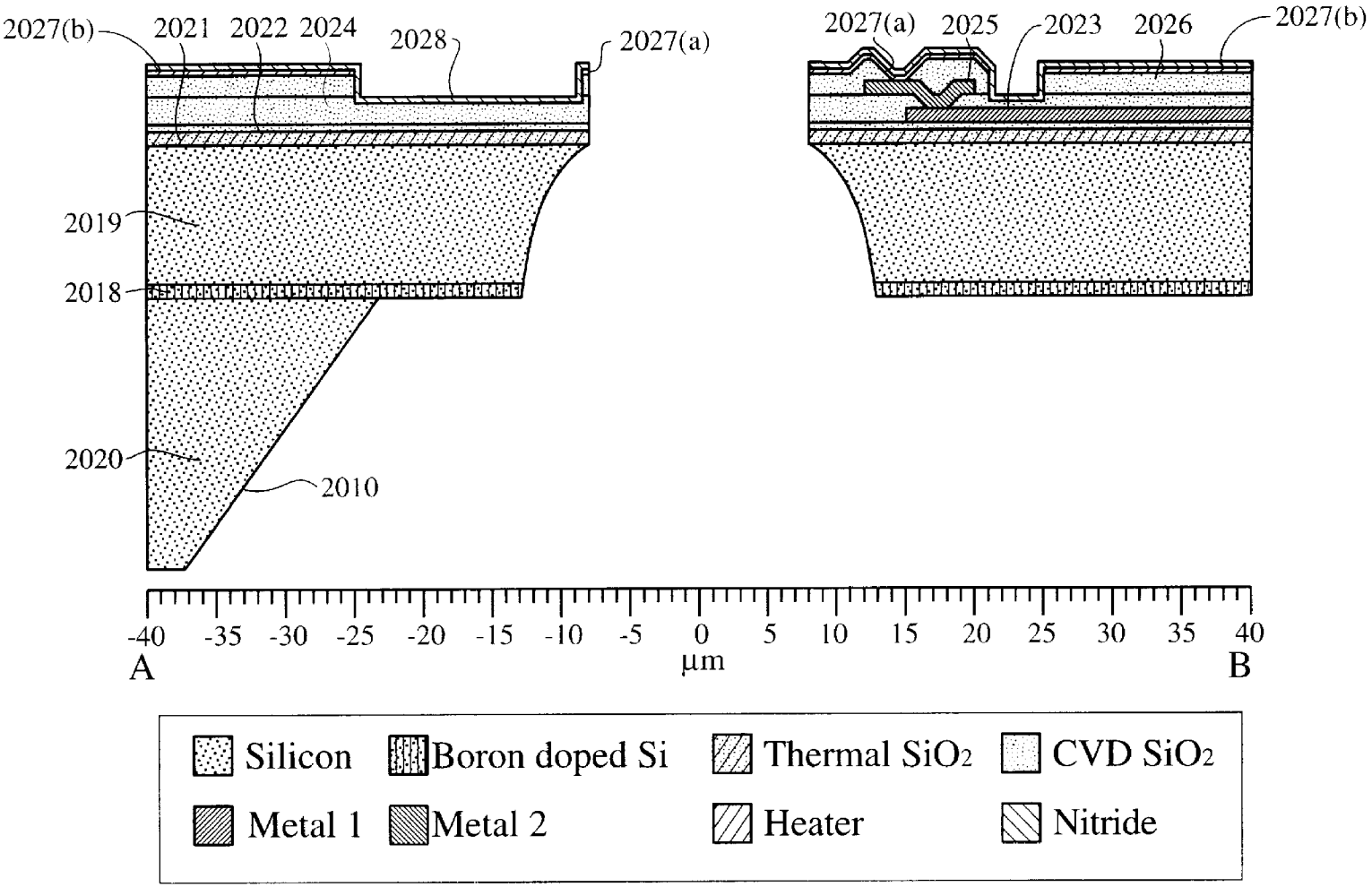
Figure 23:
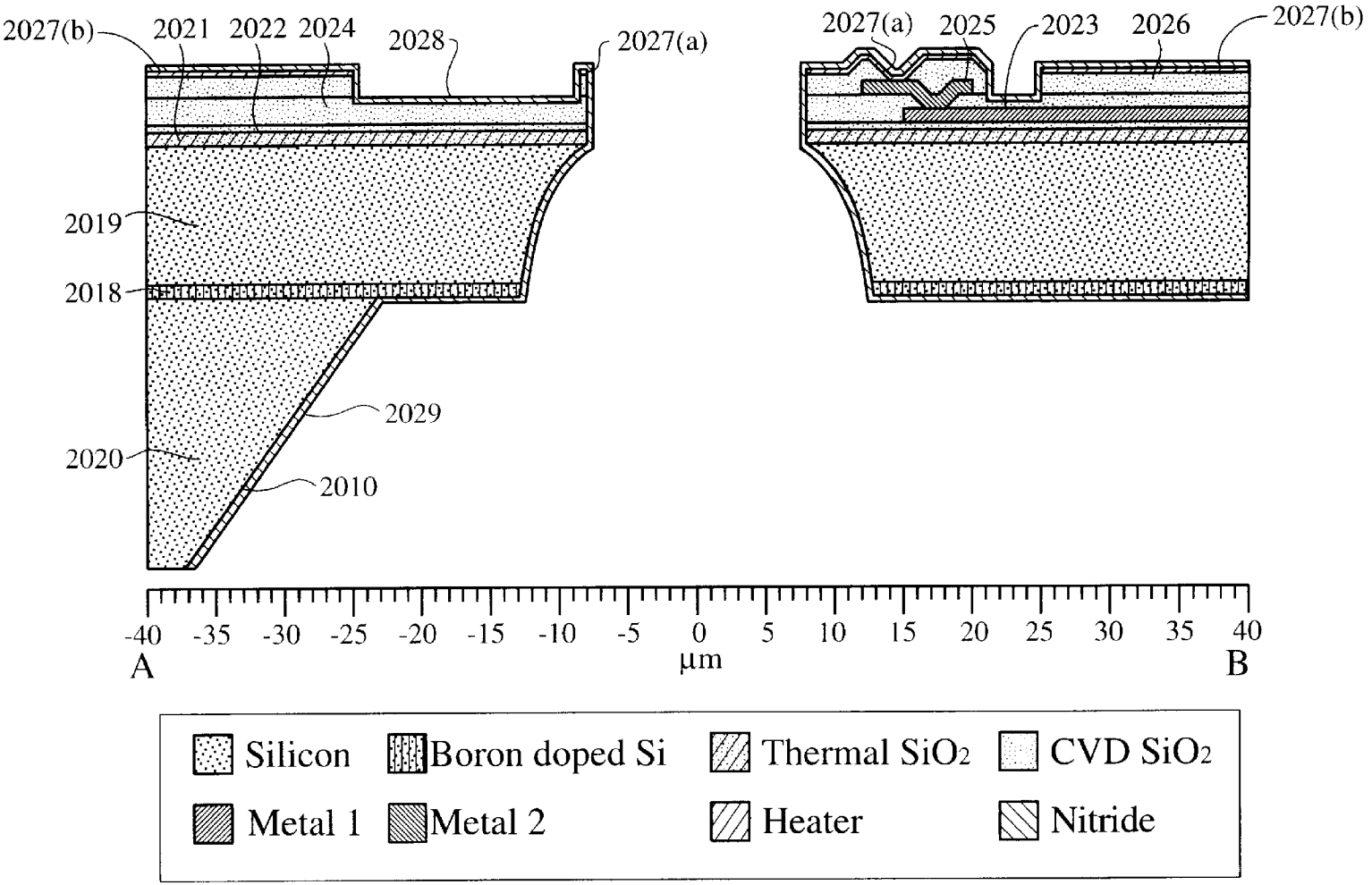

The etch proceeds in three stages:

a) During the first 10 minutes, the etch proceeds at the <100> etch rate from both the front side (through the nozzle tip) and the back side of the wafer. The depth of the etch from the front side will be the radius of the nozzle tip hole/÷2 (approximately 10 μm for a 7 μm radius nozzle tip hole). FIG. 22 is a cross section of the nozzle tip region at this time.

b) During the next approximately 1 hour and 40 minutes, the etch proceeds at the <100> rate from the back face of the wafer, but at the <111> rate through the nozzle tip holes. The etch depth through the back face holes is around 90 μm, and the etch depth through the nozzle tip holes is around 2.5 μm in the [111] directions (approximately 3 μm in the <100> direction). FIG. 23 is a cross section of the nozzle tip region at this time.

Figure 24:
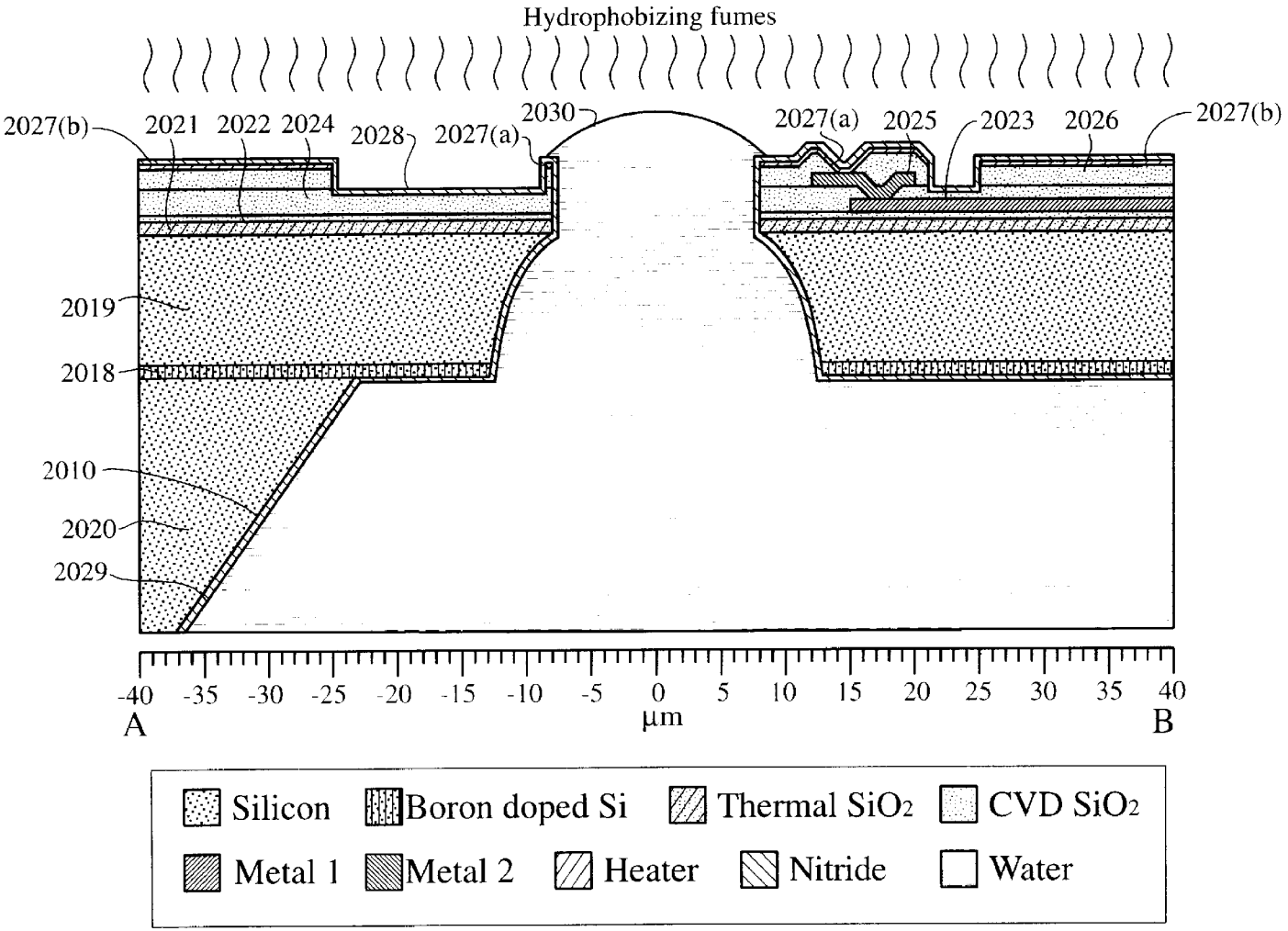

At this time, the nozzle tip holes meet the ink channel holes, resulting in exposed convex silicon surfaces, with relatively high etch rates. During the next six minutes, the etch proceeds at the <100> rate in the ink channels, and at various accelerated rates around the convex silicon. FIG. 24 is a cross section of the nozzle tip region at this time.

The amount of undercut of the nozzle tip can be controlled by altering the relative amount of etching from the front surface and the back surface. This can readily be achieved by starting the back surface etch some time before starting the front surface etch. As the total etch time is measured in hours, it is readily possible to accurately adjust the amount of time that the wafer is initially etched in EDP before removing the nitride from the nozzle tip region.

This method can compensate for different wafer thicknesses, different <111>/<100> etch ratios of the etchant, as well as give a high degree of control of the thickness of the silicon membrane and the amount of undercut of the heater.

At this stage the chip edges have also been etched, as the chip edge etch proceeds simultaneously to the ink channel etch. The design of the chip edge masking pattern can be adjusted so that the chips are still supported by the wafer at the end of the etching step, leaving only thin 'bridges' which are easily snapped without damaging the chips. Alternatively, the chips may be completely separated from the wafer at this stage.

To ensure that the chips are fully separated during the EDP etch, allow etching from both sides of the wafer.

The mask slots on the front side of the wafer can be much narrower than that those on the back side of the wafer (a 10 μm width is suitable). This reduces wasted wafer area between the chips to an insignificant amount.

Figure 25:
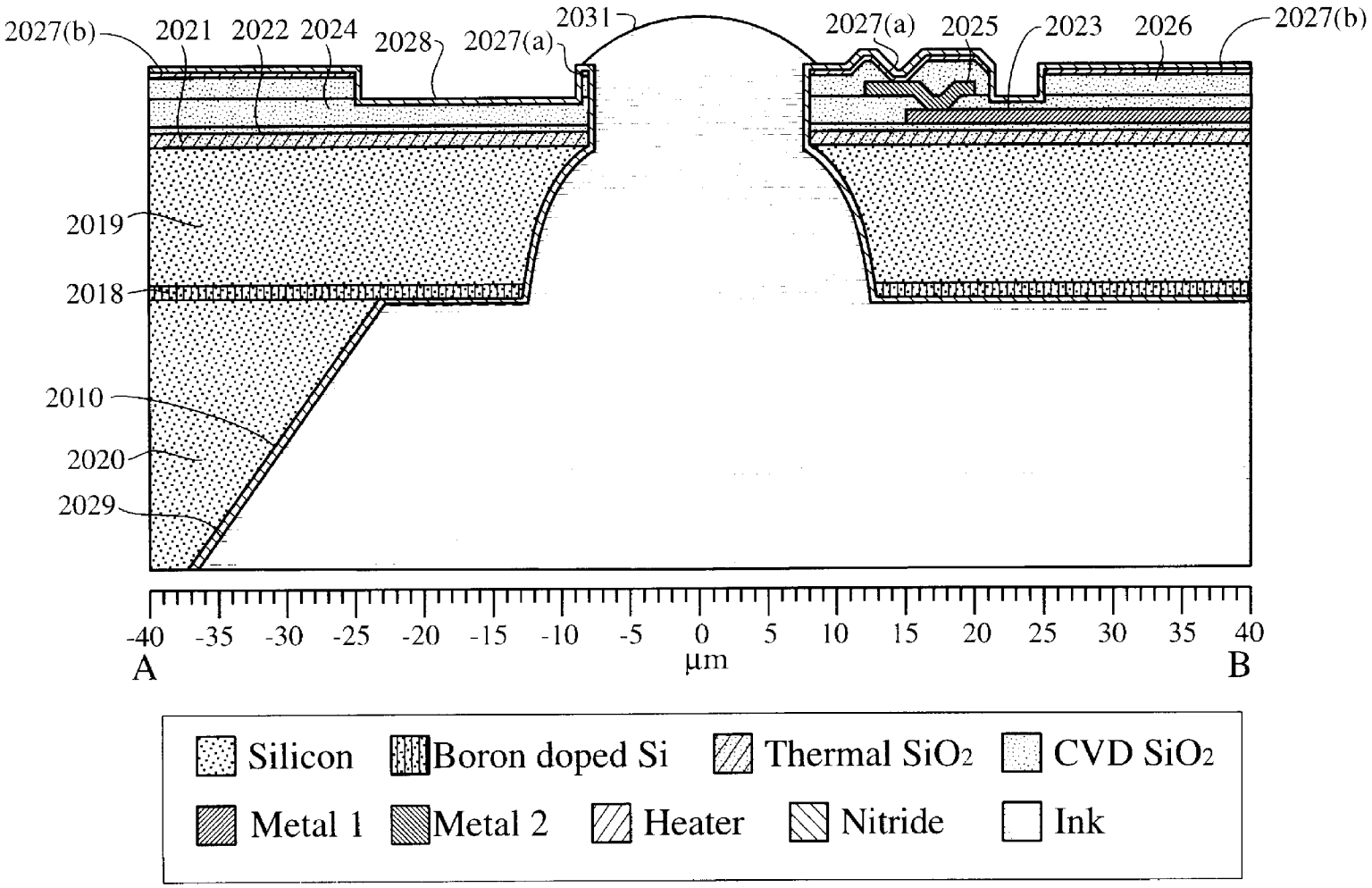

13) Deposit a passivation layer from the back surface of the chip. One micron of PECVD $Si_3N_4$ may be used. FIG. 25 is a cross section of the nozzle tip region after this deposition step.

14) Fill the print head with water 2030 under slight positive pressure (approx. 10 kPa). Care must be taken to prevent water droplets or condensation on the front face of the wafer, as this will block the hydrophobizing process.

Expose the print head to fumes of a hydrophobizing agent such as a fluorinated alkyl chloro silane. Suitable hydrophobizing agents include (in increasing order of preference):

1) dimethyldichlorosilane $(CH_3)_2SiCl_2$ (not preferred)
2) (3,3,3-trifluoropropyl)-trichlorosilane $CF_3(CH_2)_2SiCl_3$
3) pentafluorotetrahydrobutyl-trichlorosilane $CF_3CF_2(CH_2)_2SiCl_3$
4) heptafluorotetrahydropentyl-trichlorosilane $CF_3(CF_2)_2(CH_2)_2SiCl_3$
5) nonafluorotetrahydrohexyl-trichlorosilane $CF_3(CF_2)_3(CH_2)_2SiCl_3$
6) undecafluorotetrahydroheptyl-trichlorosilane $CF_3(CF_2)_4(CH_2)_2SiCl_3$
7) tridecafluorotetrahydrooctyl-trichlorosilane $CF_3(CF_2)_5(CH_2)_2SiCl_3$
8) pentadecafluorotetrahydrononyl-trichlorosilane $CF_3(CF_2)_6(CH_2)_2SiCl_3$ Many other alternatives are available. A fluorinated surface is preferable to an alkylated surface, to reduce physical adsorption of the ink surfactant.

Figure 26:
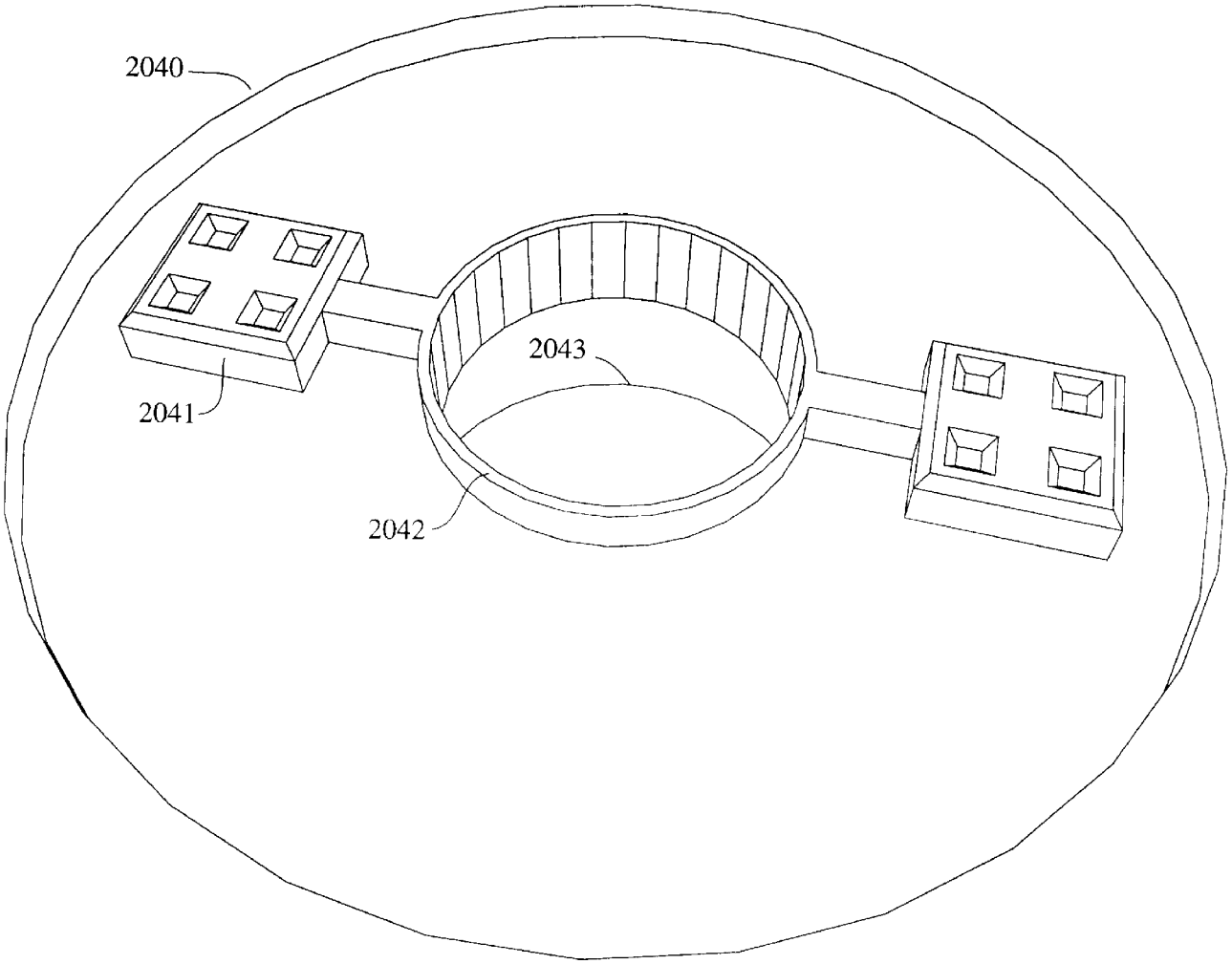

The water prevents the hydrophobizing agent from affecting the inner surfaces of the print head, allowing the print head to fill by capillarity. FIG. 26 shows a cross section of the a nozzle during the hydrophobizing process.

Figure 27:
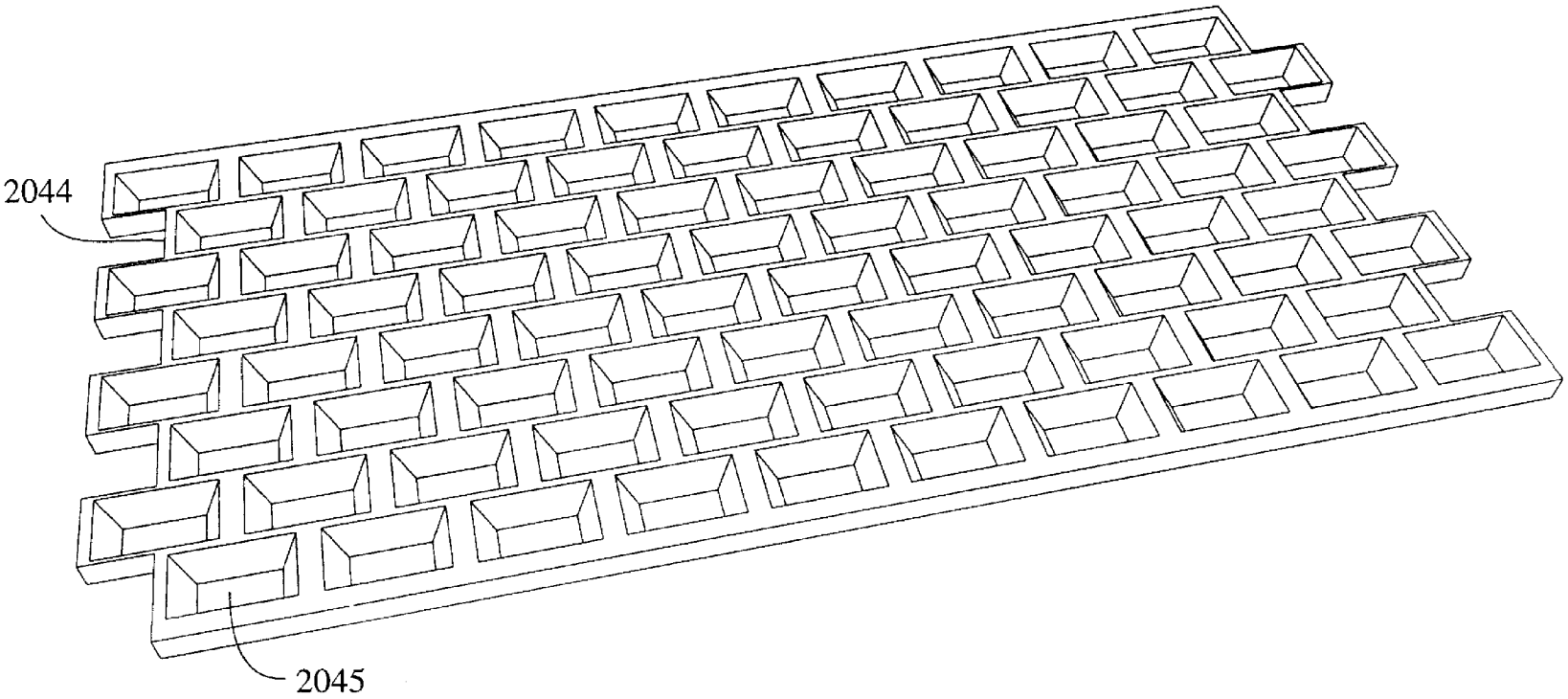

15) Package and wire bond. The device can then be connected to the ink supply, ink pressure applied, and functional testing can be performed. FIG. 27 shows a cross section of the a nozzle filled with ink 2031 in the quiescent state.

Figure 28:
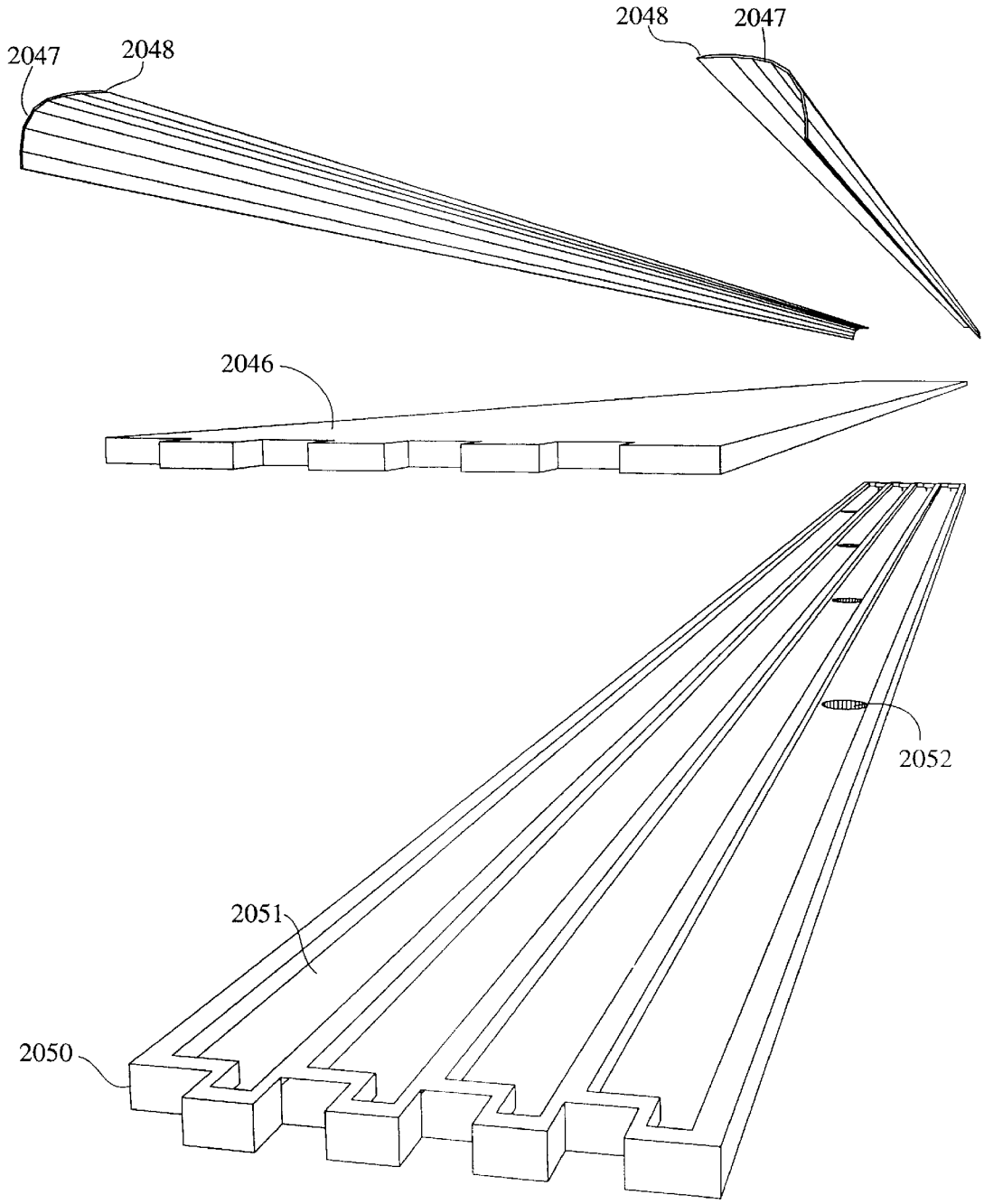
FIG. 28 shows a perspective view of the back on one print head chip.

FIG. 28 shows a perspective view of the ink channels seen from the back face of a chip.

Figure 29A:
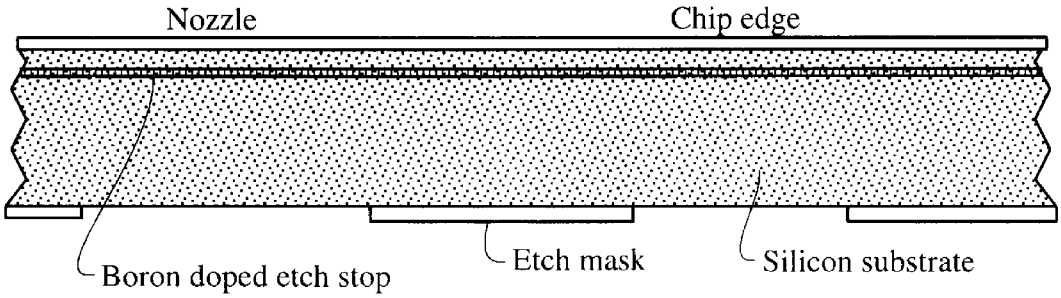
FIGS. 29(*a*) to 29(*c*) show the simultaneous etching of nozzles and chip separation. These diagrams are not to scale.
Figure 29B:
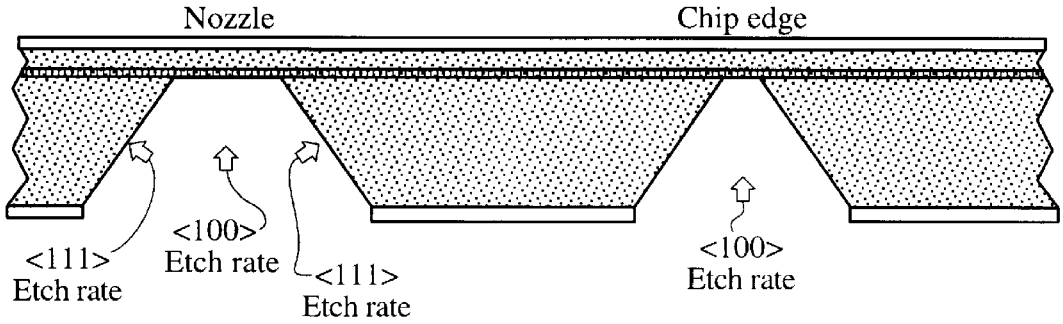
Figure 29C:
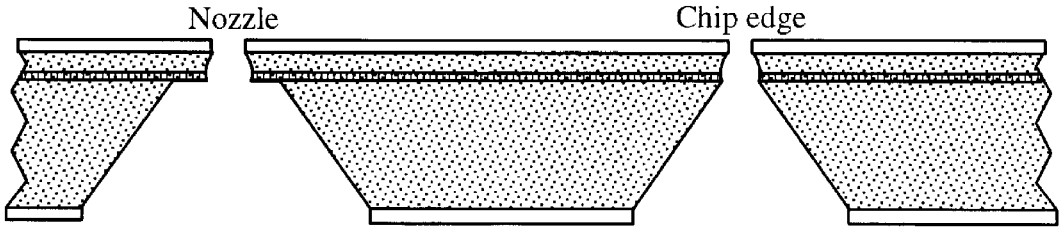

FIGS. 29(*a*) to 29(*e*) are cross sections of the wafer which show the simultaneous etching of nozzles and chip edges for chip separation. These diagrams are not to scale. FIG. 29(*a*) shows two regions of the chip, the nozzle region and the chip edge region before etching, along with the masked regions for nozzle tips, ink channels, and chip edges. FIG. 29(*b*) shows the wafer after the nozzle tip holes have been etched at the <100> etch rate, forming pyramidical pits. At this time, etching of the nozzle tip holes slows to the <111> etch rate. Etching of the chip edges and the ink channels proceeds simultaneously. FIG. 29(*c*) shows the wafer at the time that the pit being etched at the chip edge from the front side of the wafer meets the pit being etched from the back side of the wafer. FIG. 29(*d*) shows the wafer at the time that ink channel pit meets the nozzle tip pit. The etching of the edges of the wafer has proceeded simultaneously at the <100> rate in a horizontal direction. FIG. 29(*e*) shows the wafer after etching is complete, and the nozzles have been formed.

Figure 30:
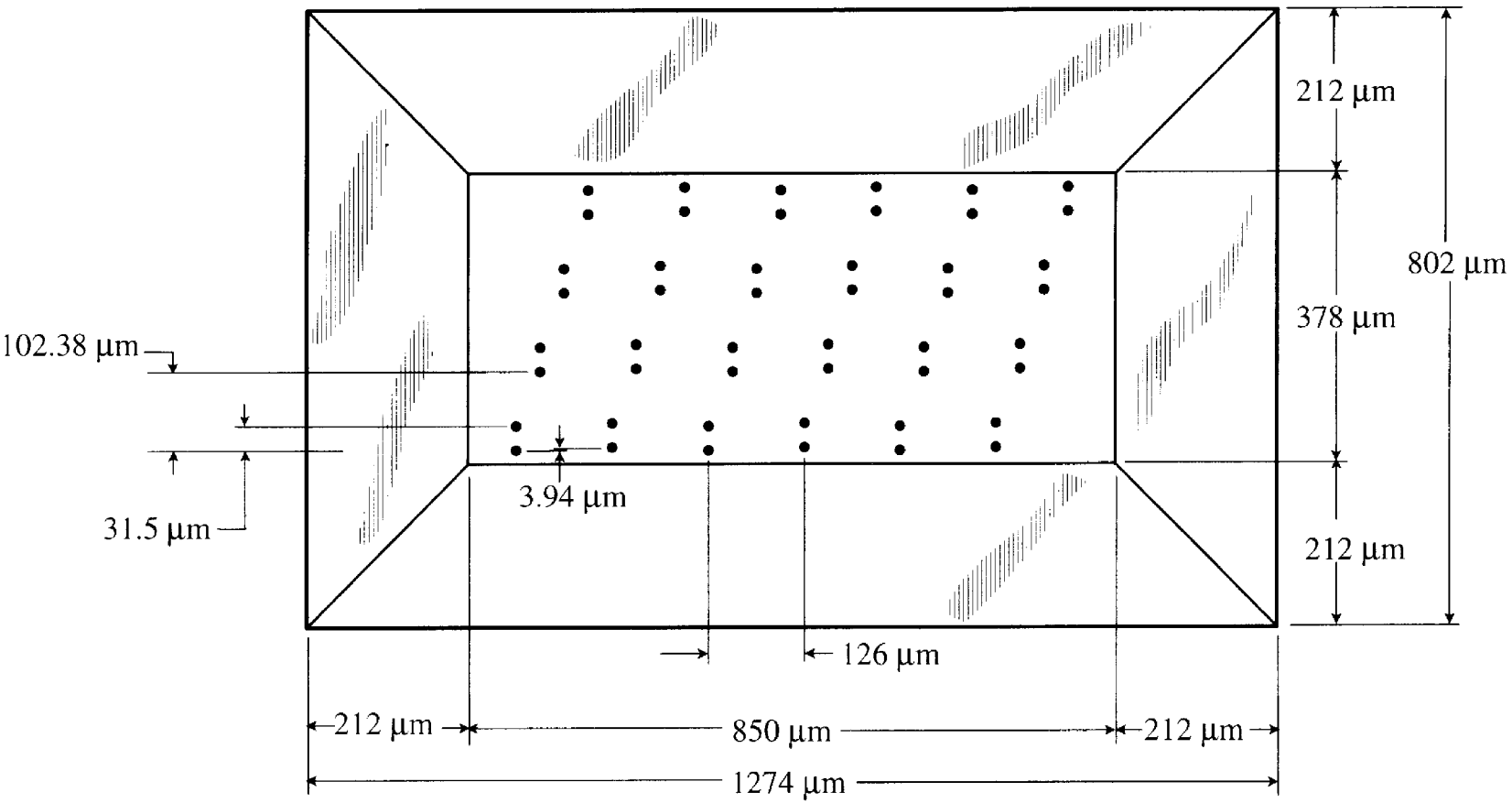
FIG. 30 shows dimensions of the layout of a single ink channel pit with 24 main nozzles and 24 redundant nozzles.

FIG. 30 shows dimensions of the layout of a single ink channel pit with 24 main nozzles and 24 redundant nozzles manufactured by the method disclosed herein.

Figure 31:
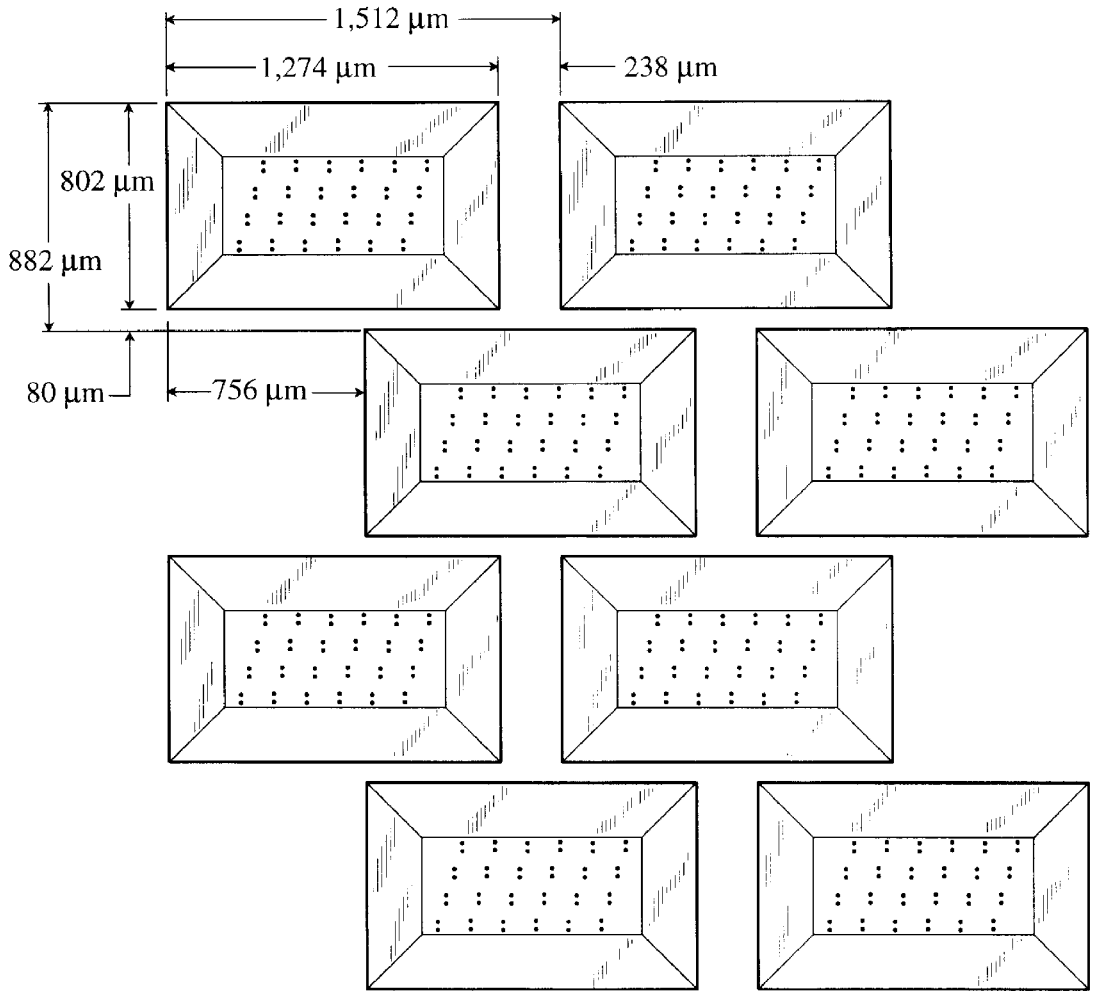
FIG. 31 shows an arrangement and dimensions of 8 ink channel pits, and their corresponding nozzles, ink a print head.

FIG. 31 shows an arrangement and dimensions of 8 ink channel pits, and their corresponding nozzles, ink a print head.

Figure 32:
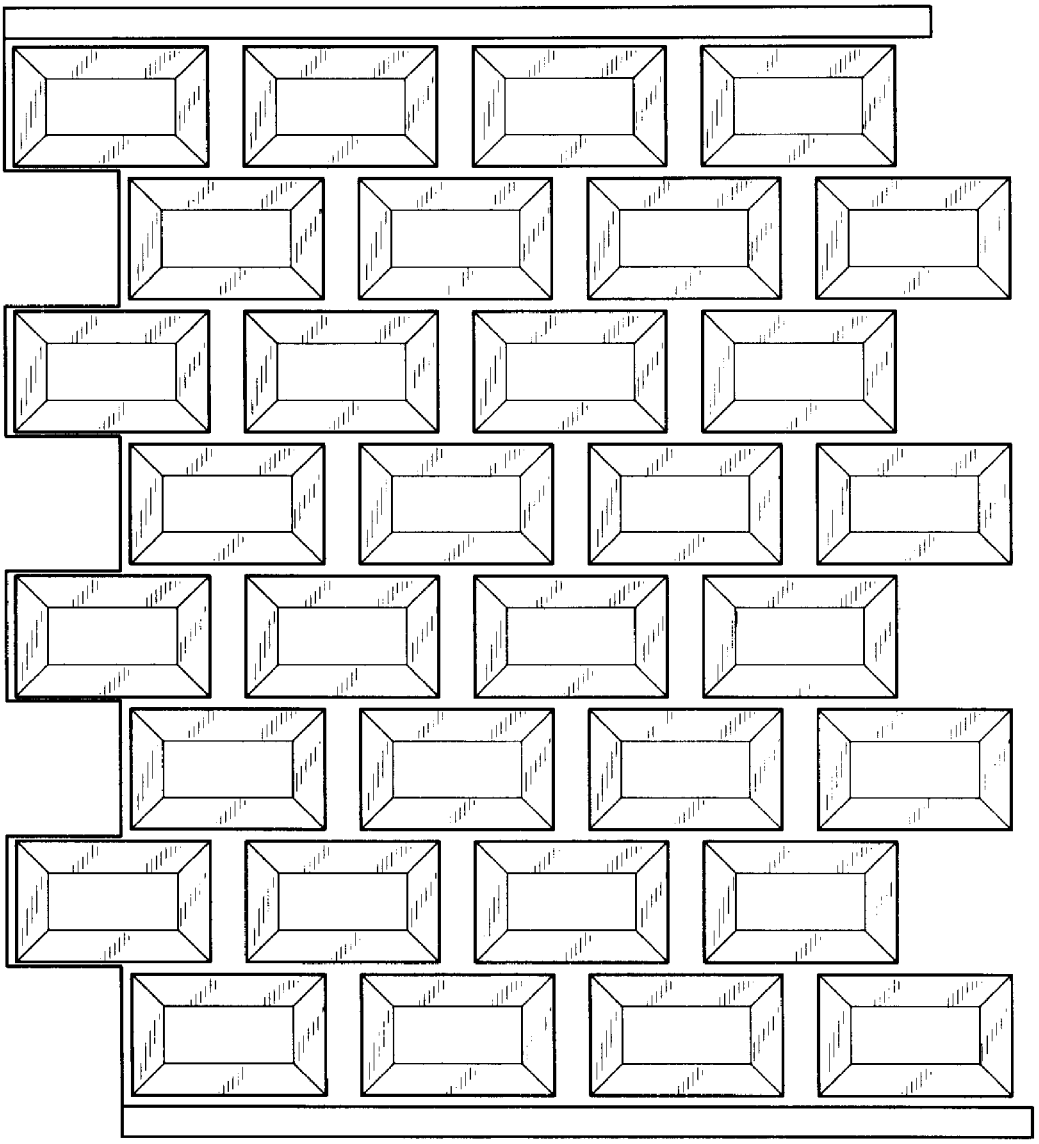
FIG. 32 shows 32 ink channel pits at one end of a four color print head.

FIG. 32 shows 32 ink channel pits at one end of a four color print head. There are two rows of ink channel pits for each of the four process colors: cyan, magenta, yellow and black.

Figure 33A:
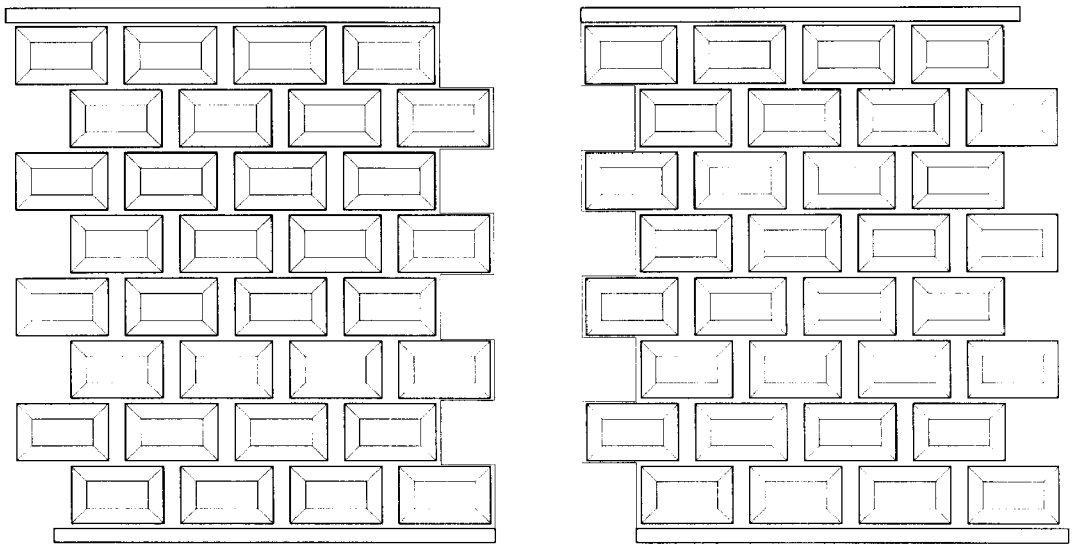
FIG. 33(*a*) and FIG. 33(*b*) show the ends of two adjacent print head chips (modules) as they are butted together to form longer print heads.
Figure 33B:
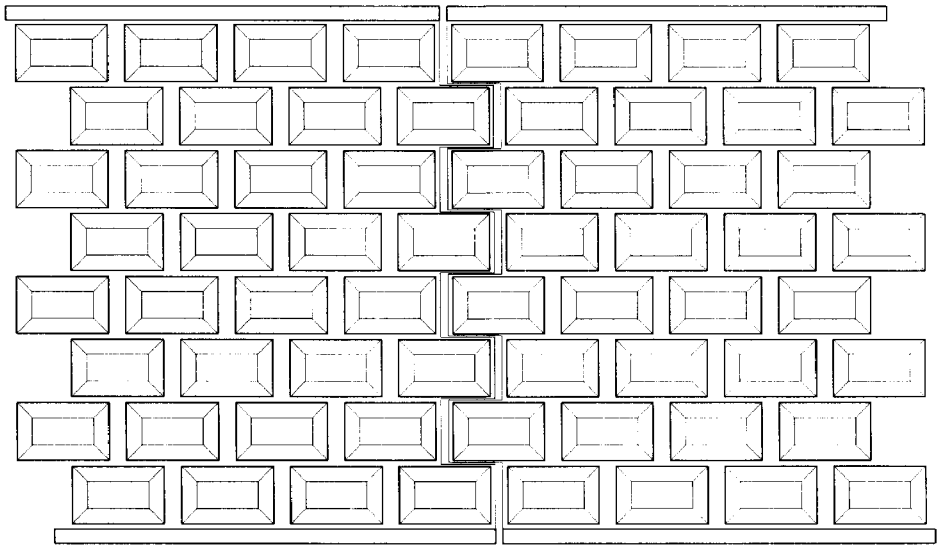

FIG. 33(*a*) and FIG. 33(*b*) show the ends of two adjacent print head chips (modules) as they are butted together to form longer print heads. The precise alignment of the print head chips, without offsetting the print head chips in the scan direction, allows printing without visible joins between the printed swaths on the page.

Figure 34:
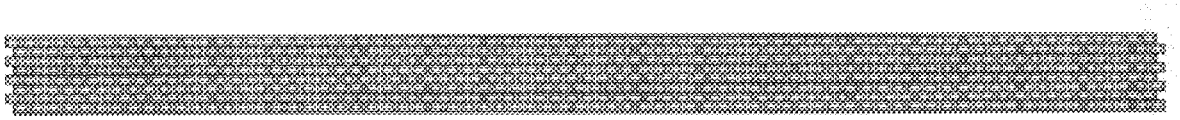
FIG. 34 shows the full complement of ink channel pits on a 4" (100 mm) monolithic print head module.

FIG. 34 shows the full complement of ink channel pits on a 4" (100 mm) monolithic print head module.

The foregoing describes a number of preferred embodiments of the present invention. Modifications, obvious to those skilled in the art, can be made thereto without departing from the scope of the invention.

APPENDIX A

Monolithic LIFT head type A4-4-600
This is a four color print head for A4 size printing. The Print head is fixed, and is the full width of the A4 paper. Resolution is 600 dpi bi-level for medium quality output

| | | | Derivation |
|---|---|---|---|
| **Basic specifications** | | | |
| Resolution | 600 | dpi | Specification |
| Print head length | 215 | mm | Width of print area, plus 5 mm |
| Print head width | 5 | mm | Derived from physical and layout constraints of head |
| Ink colors | 4 | | CMYK |
| Page size | A4 | | Specification |
| Print area width | 210 | mm | Pixels per line/Resolution |
| Print area length | 297 | mm | Total length of active printing |
| Page printing time | 1.3 | seconds | Derived from fluid dynamics, number of nozzles, etc. |
| Pages per minute | 45 | ppm | Per head, for full page size |
| Recording medium speed | 22.0 | cm/sec | 1/(resolution * actuation period times phases) |
| Basic IC process | 1.5 | μm CMOS | Recommendation |
| Bitmap memory requirement | 16.6 | MBytes | Memory required when compression is not used |
| Pixel spacing | 42.33 | μm | Reciprocal of resolution |
| Pixels per line | 4,960 | | Active nozzles/Number of colors |
| Lines per page | 7,015 | | Scan distance * resolution |
| Pixels per page | 34,794,400 | | Pixels per line * lines per page |
| Drops per page | 139,177,600 | | Pixels per page * simultaneous ink colors |
| Average data rate | 12.3 | MByte/sec | Pixels per second * ink colors/8 MBits |
| **Yield and cost** | | | |
| Number of chips per head | 1 | | Recommendation |
| Wafer size | 300 | mm (12") | Recommendation for full volume production |
| Chips per wafer | 36 | | From chip size and recommended wafer size |
| Print head chip area | 10.7 | $cm^2$ | Chip width * Length |
| Sort yield without fault tolerance | 0.87% | | Using Murphy's method, defect density = 1 per $cm^2$ |
| Sort yield with fault tolerance | 90% | | See fault tolerant yield calculations ($D = 1/cm^2$, CF = 2) |
| Total yield with fault tolerance | 72% | | Based on mature process yield of 80% |
| Functional print heads per month | 260,208 | | Assuming 10,000 wafer starts per month |
| Print head assembly cost | $10 | | Estimate |
| Factory overhead per print head | $13 | | Based on $120 m. cost for refurbished 1.5 μm Fab line amortised over 5 years, plus $16 m. P.A. operating cost |
| Wafer cost per print head | $23 | | Based on materials cost of $600 per wafer |
| Approx. total print head cost | $46 | | Sum of print head assembly, overhead, and wafer costs |
| **Nozzle and actuation specifications** | | | |
| Nozzle radius | 14 | μm | Specification |
| Number of actuation phases | 8 | | Specification |
| Nozzles per phase | 2,480 | | From page width, resolution and colors |
| Active nozzles per head | 19,840 | | Actuation phases * nozzles per phase |
| Redundant nozzles per head | 19,840 | | Same as active nozzles for 100% redundancy |
| Total nozzles per head | 39,680 | | Active plus redundant nozzles |
| Drop rate per nozzle | 5,208 | Hz | 1/(heater active period * number of phases) |
| Heater radius | 14.5 | μm | From nozzle geometry and radius |
| Heater thin film resistivity | 2.3 | μΩm | For heater formed from TaAl |

APPENDIX A-continued

Monolithic LIFT head type A4-4-600
This is a four color print head for A4 size printing. The Print head is fixed, and is the full width of the A4 paper. Resolution is 600 dpi bi-level for medium quality output

| | | Derivation |
|---|---|---|
| Heater resistance | 2,095 Ω | From heater dimensions and resistivity |
| Average heater pulse current | 5.6 mA | From heater power and resistance |
| Heater active period | 24 μs | From finite element simulations |
| Settling time petween pulses | 168 μs | Active period * (actuation phases-1) |
| Clock pulses per line | 2,834 | Assuming multiple clocks and no transfer register |
| Clock frequency | 14.8 MHz | From clock pulses per line, and lines per second |
| Drive transistor on resistance | 42 Ω | From recommended device geometry |
| Average head drive voltage | 12.0 V | Heater current * (heater + drive transistor resistance) |
| Drop selection temperature | 75° C. | m.p. of surfactant sol or PIT of microemulsion |
| Heater peak temperature | 120° C. | From finite element simulations |
| Ink specifications | | |
| Basic ink carrier | Water | Specification |
| Surfactant | Arachidic acid | Suggested method of achieving temperature threshold |
| Ink drop volume | 18 pl | From finite element simulations |
| Ink density | 1.030 g/cm$^3$ | Black ink density at 60° C. |
| Ink drop mass | 18.5 ng | Ink drop volume * ink density |
| Ink specific heat capacity | 4.2 J/Kg/°C. | Ink carrier characteristic |
| Max. energy for self cooling | 2,715 nJ/drop | Ink drop heat capacity * temperature increase |
| Ejection energy per drop | 1,587 nJ | Energy applied to heater in finite element simulations |
| Energy to print full black page | 221 J | Drop ejection energy * drops per page |
| TotaI ink per color per page | 0.63 ml | Drops per page per color * drop volume |
| Maximum ink flow rate per color | 0.47 ml/sec | Ink per color per page/page print time |
| Full black ink coverage | 40.2 ml/m$^2$ | Ink drop volume * colors * drops per square meter |
| Ejection ink surface tension | 38.5 mN/m | Surface tension required for ejection |
| Ink pressure | 5.5 kPa | 2 * Ejection ink surface tension/nozzle radius |
| Ink column height | 545 mm | Ink column height to achieve ink pressure |

I Claim:

1. A drop on demand printing head comprising:

(a) at least one nozzle formed on a substrate and having an associated electrothermal heater, the substrate material in the region of the heater being removed to form said nozzle;

(b) a plurality of drop-emitter nozzles;

(c) a body of ink associated with said nozzles;

(d) a pressurizing device adapted to subject ink in said body of ink to a pressure of at least 2% above ambient pressure, at least during drop selection and separation to form a meniscus with an air/ink interface;

(e) drop selection apparatus operable upon the air/ink interface to select predetermined nozzles and to generate a difference in meniscus position between ink in selected and non-selected nozzles; and (f) drop separation apparatus adapted to cause ink from selected nozzles to separate as drops from the body of ink, while allowing ink to be retained in non-selected nozzles.

2. A drop on demand printing head comprising:

(a) at least one nozzle formed on a substrate and having an associated electrothermal heater, the substrate material in the region of the heater being removed to form said nozzle;

(b) a plurality of drop-emitter nozzles;

(c) a body of ink associated with said nozzles, said body of ink forming a meniscus with an air/ink interface at each nozzle;

(d) drop selection apparatus operable upon the air/ink interface to select predetermined nozzles and to generate a difference in meniscus position between ink in selected and non-selected nozzles; and (e) drop separation apparatus adapted to cause ink from selected nozzles to separate as drops from the body of ink, while allowing ink to be retained in non-selected nozzles, said drop selection apparatus being capable of producing said difference in meniscus position in the absence of said drop separation apparatus.

3. A drop on demand printing head comprising:

(a) at least one nozzle formed on a substrate and having an associated electrothermal heater, the substrate material in the region of the heater being removed to form said nozzle;

(b) a plurality of drop-emitter nozzles;

(c) a body of ink associated with said nozzles, said body of ink forming a meniscus with an air/ink interface at each nozzle and said ink exhibiting a surface tension decrease of at least 10 mN/m over a 30° C. temperature range;

(d) drop selection apparatus operable upon the air/ink interface to select predetermined nozzles and to generate a difference in meniscus position between ink in selected and non-selected nozzles; and (e) drop separation apparatus adapted to cause ink from selected nozzles to separate as drops from the body of ink, while allowing ink to be retained in non-selected nozzles.

4. A drop on demand printing head as claimed in claim 3 wherein said heater is situated on a rim, said rim protruding from a surface of said printing head in the immediate vicinity of said rim.

5. A drop on demand printing head as claimed in claim 4 where the printing head is fabricated on a silicon wafer which forms said substrate.

6. A drop on demand printing head as claimed in claim 5 wherein said nozzles are formed as holes which pass from the front surface of said wafer to the back surface of said wafer.

7. A drop on demand printing head as claimed in claim 5 wherein a dielectric layer of material with a thermal conductivity less than the thermal conductivity of the substrate is provided between the heater and the substrate.

8. A drop on demand printing head as claimed in claim 7 wherein the layer of material between the heater and the substrate is silicon dioxide.

9. A method of manufacture of a drop on demand printing head as claimed in claim 7 wherein the substrate is undercut in the region of the heater by an isotropic etching process which etches the substrate at a faster rate than the process etches the dielectric layer containing the heater.

10. A drop on demand printing head as claimed in claim 4 where a plurality of said nozzles are formed on a single substrate.

11. A method of manufacture of a drop on demand printing head as claimed in claim 3 wherein the nozzle is formed by anisotropic etching of a dielectric layer containing the heater.

12. A method of manufacture of a drop on demand printing head as claimed in claim 3 wherein the nozzle formation process includes anisotropic etching of the substrate.

13. A method of manufacture of a drop on demand printing head as claimed in claim 3 wherein the nozzle formation process includes etching from both the front surface and the back surface of the substrate.

14. The printing head claimed in claim 3 wherein said heater comprises an annular member coaxial, with said nozzle near its top end.

15. The invention defined in claim 14 comprising a dielectric layer formed on a silicon substrate and wherein said nozzle tip is formed in said dielectric layer.

16. The invention defined in claim 15 wherein said heater is formed on the surface of the nozzle tip and further comprising an electrically insulative, thermally conductive coating overlying said heater.

17. The invention defined in claim 16 wherein said coating comprises $S_i3_{N4}$.

18. The invention defined in claim 17 further comprising a passivation material layer intermediate said heater and said coating.

19. The invention defined in claim 17 wherein said passivation layer comprises a tantalum material.

20. The invention defined in claim 3 wherein said heater and nozzle are self-aligned.

* * * * *